US009348284B2

(12) United States Patent
Watanabe et al.

(10) Patent No.: US 9,348,284 B2
(45) Date of Patent: May 24, 2016

(54) SHEET CONVEYOR AND IMAGE FORMING APPARATUS INCORPORATING THE SHEET CONVEYOR

(71) Applicants: Takeshi Watanabe, Kanagawa (JP); Kenji Ishii, Ibaraki (JP); Yuji Karikusa, Ibaraki (JP); Junji Shirakawa, Ibaraki (JP)

(72) Inventors: Takeshi Watanabe, Kanagawa (JP); Kenji Ishii, Ibaraki (JP); Yuji Karikusa, Ibaraki (JP); Junji Shirakawa, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/610,121

(22) Filed: Jan. 30, 2015

(65) Prior Publication Data

US 2015/0220030 A1 Aug. 6, 2015

(30) Foreign Application Priority Data

| | | |
|---|---|---|
| Feb. 4, 2014 | (JP) | 2014-019305 |
| May 13, 2014 | (JP) | 2014-099468 |
| Sep. 1, 2014 | (JP) | 2014-177320 |

(51) Int. Cl.
*G03G 15/20* (2006.01)
*B65H 1/04* (2006.01)
(Continued)

(52) U.S. Cl.
CPC ..... *G03G 15/2085* (2013.01); *B65H 1/04* (2013.01); *B65H 1/28* (2013.01); *B65H 5/023* (2013.01); *B65H 5/068* (2013.01); *B65H 5/26* (2013.01); *B65H 7/20* (2013.01); *B65H 29/58* (2013.01);
(Continued)

(58) Field of Classification Search
CPC ..... G03G 15/60; G03G 15/602; G03G 2215/00544; G03G 15/2085; B65H 1/04; B65H 2406/42; B65H 2404/2614
USPC ..... 399/124
See application file for complete search history.

(56) References Cited

U.S. PATENT DOCUMENTS

| | | | |
|---|---|---|---|
| 2005/0201765 | A1 | 9/2005 | Shinga |
| 2012/0315069 | A1 | 12/2012 | Ikeda et al. |

(Continued)

FOREIGN PATENT DOCUMENTS

| | | |
|---|---|---|
| JP | 2005-298209 | 10/2005 |
| JP | 2006-010934 | 1/2006 |

(Continued)

OTHER PUBLICATIONS

Machine translation of JP 2010-002644.*
U.S. Appl. No. 14/487,435, filed Sep. 16, 2014.
U.S. Appl. No. 14/477,129, filed Sep. 4, 2014.

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

A sheet conveyor, which is incorporated in an image forming apparatus, includes a first conveyor to convey a sheet via a first sheet conveying path and move in a direction intersecting a sheet thickness direction, a second conveyor to convey the sheet via a second sheet conveying path and include a third conveyor and a fourth conveyor bringing either one close to and away from the other via the second sheet conveying path in the sheet thickness direction, a first attaching part provided to the first conveyor to attach the first conveyor to the sheet conveyor, and a state changer to change a state of one of the first attaching part to a movement allowed state and the second conveyor to a sheet releasing state in conjunction with a releasing action of the other of the first attaching part and the second conveyor.

20 Claims, 31 Drawing Sheets

(51) Int. Cl.

| | |
|---|---|
| ***B65H 1/28*** | (2006.01) |
| ***B65H 5/06*** | (2006.01) |
| ***B65H 5/26*** | (2006.01) |
| ***B65H 7/20*** | (2006.01) |
| ***B65H 29/58*** | (2006.01) |
| ***B65H 5/02*** | (2006.01) |

(52) U.S. Cl.
CPC ..... *B65H 2301/5144* (2013.01); *B65H 2402/31* (2013.01); *B65H 2402/45* (2013.01); *B65H 2402/542* (2013.01); *B65H 2404/253* (2013.01); *B65H 2404/2612* (2013.01); *B65H 2404/2614* (2013.01); *B65H 2404/2693* (2013.01); *B65H 2406/42* (2013.01); *B65H 2601/11* (2013.01); *B65H 2801/27* (2013.01)

(56) References Cited

U.S. PATENT DOCUMENTS

| | | | |
|---|---|---|---|
| 2014/0060782 | A1 | 3/2014 | Ikeda et al. |
| 2014/0186080 | A1 | 7/2014 | Ikeda et al. |
| 2014/0186081 | A1 | 7/2014 | Hirasawa et al. |
| 2014/0233996 | A1 | 8/2014 | Ikeda et al. |
| 2014/0308058 | A1 | 10/2014 | Ikeda et al. |
| 2014/0334858 | A1 | 11/2014 | Miyagawa et al. |

FOREIGN PATENT DOCUMENTS

| | | | |
|---|---|---|---|
| JP | 2010-002644 | * | 7/2010 |
| JP | 2011-123254 | | 6/2011 |

* cited by examiner

SHEET CONVEYOR AND IMAGE FORMING APPARATUS INCORPORATING THE SHEET CONVEYOR

CROSS-REFERENCE TO RELATED APPLICATIONS

This patent application is based on and claims priority pursuant to 35 U.S.C. §119(a) to Japanese Patent Application Nos. 2014-019305, filed on Feb. 4, 2014, 2014-099468, filed on May 13, 2014, and 2014-177320, filed on Sep. 1, 2014, in the Japan Patent Office, the entire disclosure of each of which is hereby incorporated by reference herein.

BACKGROUND

1. Technical Field

This disclosure relates to a sheet conveyor to convey a sheet-like recording medium, and an image forming apparatus incorporating the sheet conveyor.

2. Related Art

As an example, an image forming apparatus includes a first conveyor and a second conveyor disposed on an upstream side and a downstream side in a sheet conveying direction so as to sandwich and convey a sheet. The first conveyor is movable in a direction intersecting a sheet thickness direction of the sheet. When a paper jam occurs in the image forming apparatus while a jammed sheet remains across both the first conveyor and the second conveyor, a known configuration of the image forming apparatus allows the first conveyor to be moved after the jammed sheet is removed from the second conveyor in order to prevent the jammed sheet from tearing or a jammed sheet tearing in which the jammed sheet is torn by moving one of the first conveyor and the second conveyor.

SUMMARY

At least one aspect of this disclosure provides a sheet conveyor including a first conveyor, a second conveyor, a first attaching part, and a state changer. The first conveyor has a first sheet conveying path therein to convey a sheet via the first sheet conveying path and moves in a direction intersecting a sheet thickness direction. The second conveyor has a second sheet conveying path therein to convey the sheet via the second sheet conveying path. The second conveyor includes a third conveyor and a fourth conveyor disposed facing the third conveyor via the second sheet conveying path in the sheet thickness direction. The third conveyor and the fourth conveyor bring either one close to and away from the other via the second sheet conveying path in the sheet thickness direction. The first attaching part is provided to the first conveyor to attach the first conveyor to the sheet conveyor. The state changer changes a state of the second conveyor from a sheet holding state to a sheet releasing state in conjunction with a releasing action of the first attaching part.

Further, at least one aspect of this disclosure provides a sheet conveyor including a first conveyor, a second conveyor, a first attaching part, and a state changer. The first conveyor has a first sheet conveying path therein to convey a sheet via the first sheet conveying path and moves in a direction intersecting a sheet thickness direction. The second conveyor has a second sheet conveying path therein to convey the sheet via the second sheet conveying path. The second conveyor includes a third conveyor and a fourth conveyor disposed facing the third conveyor via the second sheet conveying path in the sheet thickness direction. The third conveyor and the fourth conveyor bring either one close to and away from the other via the second sheet conveying path in the sheet thickness direction. The first attaching part is provided to the first conveyor to attach the first conveyor to the sheet conveyor. The state changer changes a state of the first attaching part from a movement restricted state to a movement allowed state in conjunction with a separating action of the second conveyor.

Further, at least one aspect of this disclosure provides an image forming apparatus including one of the above-described sheet conveyors and an image forming part to form a toner image on the sheet. The first conveyor includes a fixing device to fix the toner image formed in the image forming part.

DETAILED DESCRIPTION

Figure 1:
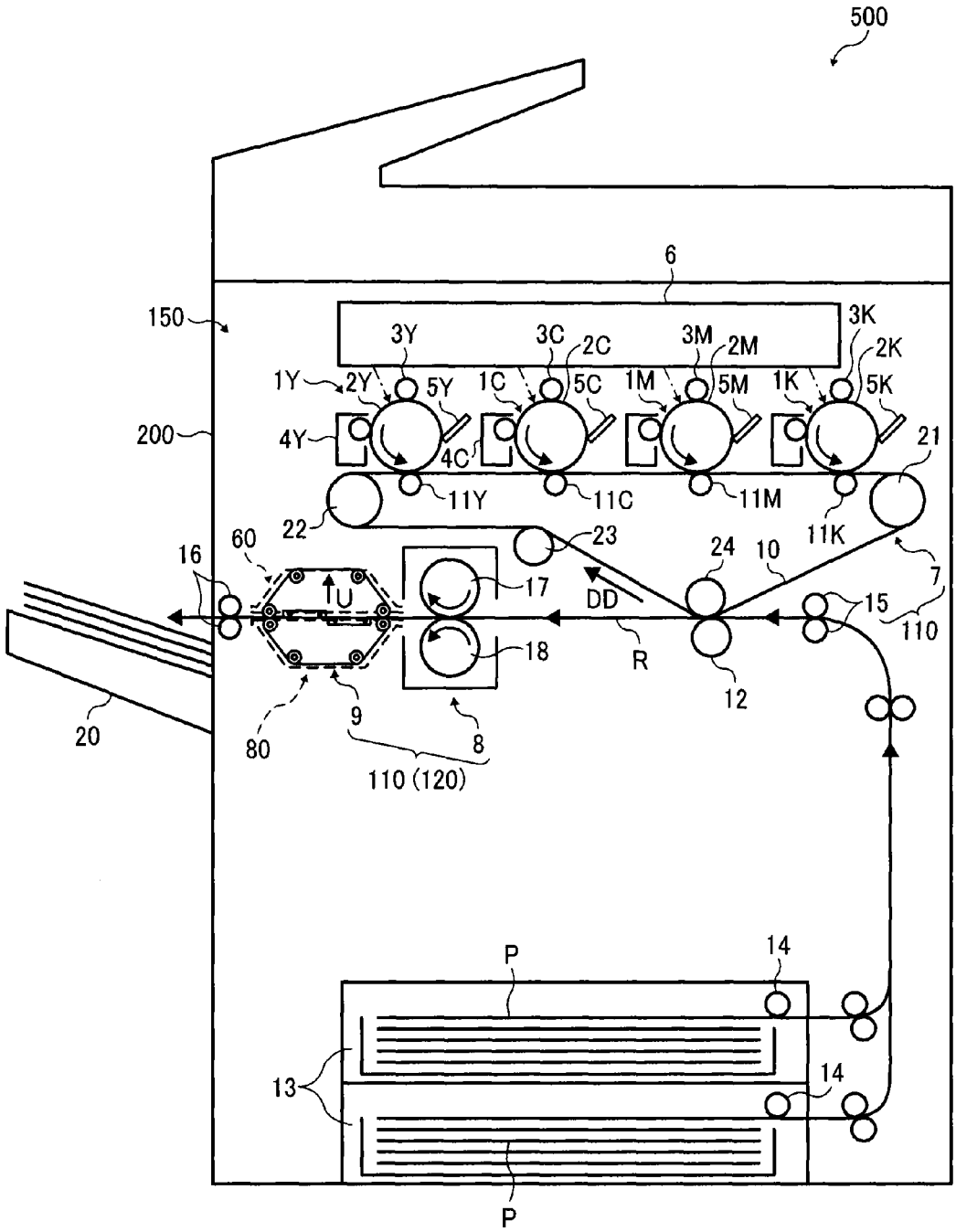
FIG. 1 is a schematic diagram illustrating an image forming apparatus according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an image forming apparatus 500 according to an example of this disclosure.

The image forming apparatus 500 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 500 is an electrophotographic printer that forms toner images on a sheet or sheets by electrophotography.

Further, this disclosure is also applicable to image forming apparatuses adapted to form images through other schemes, such as known ink jet schemes, known toner projection schemes, or the like as well as to image forming apparatuses adapted to form images through electro-photographic schemes.

It is also to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, sheet member, and recording material to which the developer or ink is attracted.

A description is given of an image forming apparatus 500 according to an example of this disclosure with reference to FIGS. 1 through 9.

First, referring to FIG. 1, a description is given of an entire configuration of the image forming apparatus 500 according to an example of this disclosure.

FIG. 1 is a schematic diagram illustrating the image forming apparatus 500 according to an example of this disclosure.

As illustrated in FIG. 1, the image forming apparatus 500 has an apparatus body 200 that includes a tandem-type image forming part 150, an exposure device 6, a transfer device 7, and four primary transfer rollers 11Y, 11C, 11M, and 11K.

The tandem-type image forming part 150 includes four process units 1Y, 1C, 1M, and 1K functioning as image forming units aligned in tandem. Suffixes, which are Y, C, M, and K, are used to indicate respective colors of toners (e.g., yellow, cyan, magenta, and black toners) for the process units. The process units 1Y, 1C, 1M, and 1K have substantially the same configuration except for containing different color toners of yellow (Y), cyan (C), magenta (M), and black (K) corresponding to color separation components of a color image. The process units 1Y, 1C, 1M, and 1K are detachably attachable to the apparatus body 200 of the image forming apparatus 500.

Specifically, the four process units 1Y, 1C, 1M, and 1K form respective single color toner images of yellow (Y), cyan (C), magenta (M), and black (K) on photoconductors 2Y, 2C, 2M, and 2K, respectively.

The exposure device 6 is disposed above the process units 1Y, 1C, 1M, and 1K and exposes respective surfaces of the photoconductors 2Y, 2C, 2M, and 2K, respectively, to form respective electrostatic latent images thereon.

It is to be noted that FIG. 1 illustrates the four process units 1Y, 1C, 1M, and 1K having the identical configuration and functions to each other except toner colors, which are yellow (Y), cyan (C), magenta (M), and black (K). Each process unit 1 includes the photoconductor 2 (i.e., photoconductors 2Y, 2C, 2M, and 2K) and image forming components disposed around the photoconductor 2 in a counterclockwise direction in the drawing. Specifically, the image forming components are a charging roller 3 (i.e., charging rollers 3Y, 3C, 3M, and 3K) that is disposed substantially upward from a rotation center of the photoconductor 2, a developing device 4 (i.e., developing devices 4Y, 4C, 4M, and 4K), and a photoconductor cleaning blade 5 (i.e., photoconductor cleaning blades 5Y, 5C, 5M, and 5K). Specifically, the photoconductor 2 has a drum shape and functions as a latent image bearer. The charging roller 3 serves as a charger to charge a surface of the photoconductor 2. The developing device 4 forms a toner image on the surface of the photoconductor 2. The photoconductor cleaning blade 5 serves as a cleaner to clean the surface of the photoconductor 2.

In FIG. 1, the exposure device 6 is disposed above the process units 1Y, 1C, 1M, and 1K to emit respective lights to irradiate the respective surfaces of the photoconductors 2Y, 2C, 2M, and 2K.

The exposure device 6 includes, e.g., a light source, polygon mirrors, f-theta lenses, and reflection mirrors to emit a laser beam onto the surface of the photoconductor 2.

The transfer device 7 is disposed below the process units 1Y, 1C, 1M, and 1K. The transfer device 7 includes an intermediate transfer belt 10 including an endless belt that functions as an intermediate transfer body.

The intermediate transfer belt 10 is stretched over multiple rollers 21, 22, 23, and 24 functioning as supports. One of the rollers 21, 22, 23, and 24 is rotated as a driving roller to circulate (rotate) the intermediate transfer belt 10 in a direction indicated by arrow DD in FIG. 1.

Four primary transfer rollers 11Y, 11C, 11M, and 11K functioning as primary transfer units are disposed at positions at which the primary transfer rollers 11Y, 11C, 11M, and 11K face the respective photoconductors 2Y, 2C, 2M, and 2K. At respective positions, the primary transfer rollers 11Y, 11C, 11M, and 11K are pressed against an inner circumferential surface of the intermediate transfer belt 10. Thus, primary transfer nip regions are formed at positions at which the photoconductors 2Y, 2C, 2M, and 2K contact pressed portions of the intermediate transfer belt 10. Each of the primary transfer rollers 11Y, 11C, 11M, and 11K is connected to a power source, and a given direct current (DC) voltage and/or an alternating current (AC) voltage are supplied to the primary transfer rollers 11Y, 11C, 11M, and 11K.

A secondary transfer roller 12 that functions as a secondary transfer unit is disposed at a position at which the secondary transfer roller 12 faces the roller 24 that is one of the rollers over which the intermediate transfer belt 10 is stretched. At respective positions, the secondary transfer roller 12 is pressed against an outer circumferential surface of the intermediate transfer belt 10. Thus, a secondary transfer nip region is formed at a position at which the secondary transfer roller 12 and the intermediate transfer belt 10 contact each other. Similar to the primary transfer rollers 11Y, 11C, 11M, and 11K, the secondary transfer roller 12 is connected to a power source, and a given direct current (DC) voltage and/or an alternating current (AC) voltage are supplied to the secondary transfer roller 12.

Multiple sheet trays 13 are disposed below the apparatus body 200 to accommodate sheet-type recording medium P, such as sheets of paper or overhead projector (OHP) sheets.

Hereinafter, the recording medium P is referred to as a sheet P. Each sheet tray 13 is provided with a feed roller 14 to feed the sheet P stored therein.

An output tray 20 that functions as a sheet output unit is mounted on an outer circumferential surface of the apparatus body 200 at the left side in FIG. 1 to stack the sheet P discharged to an outside of the apparatus body 200.

Figure 2:
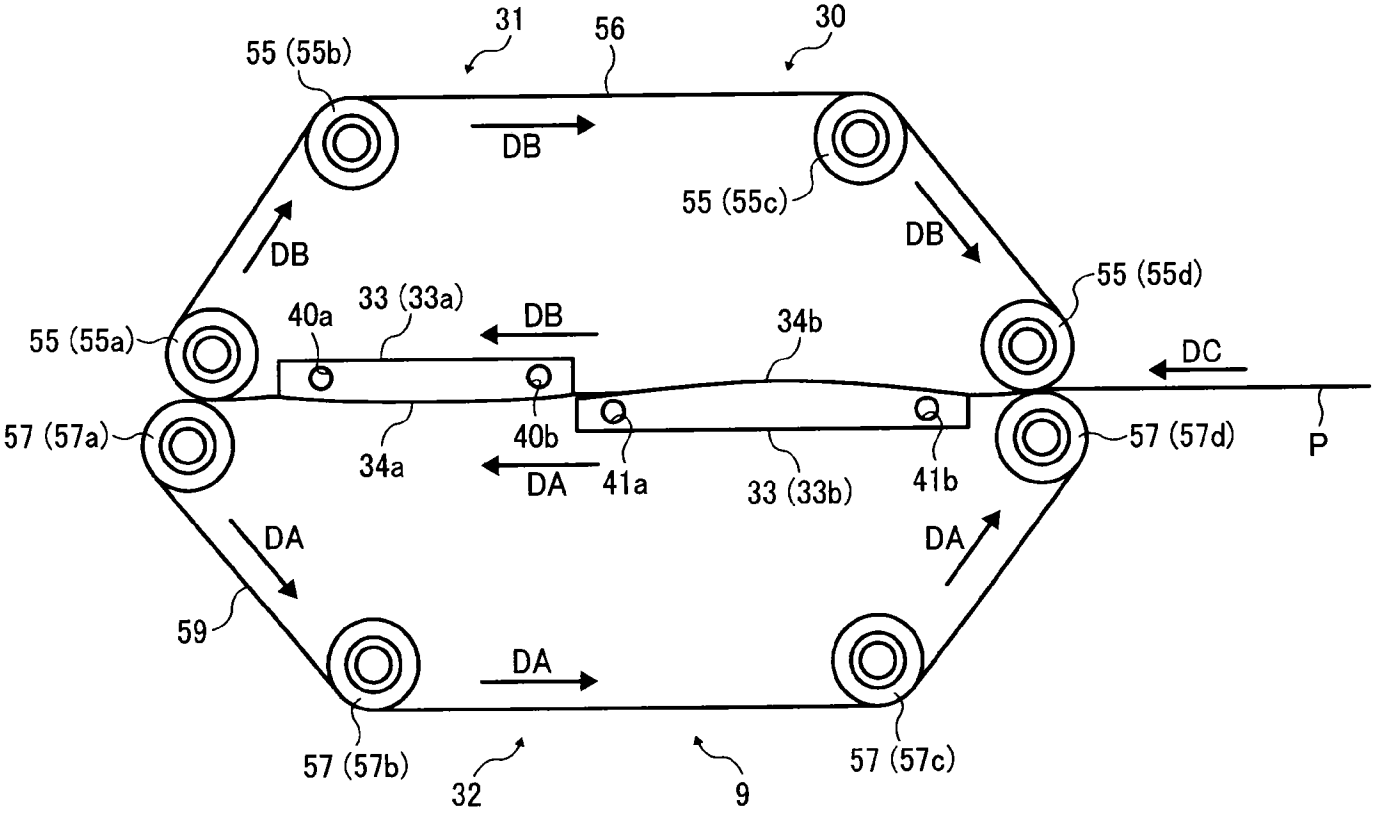
FIG. 2 is a schematic front view illustrating a cooling device and a sheet conveying device of FIG. 1.

It is to be noted that the sheet P that can be used in the image forming apparatus 500 is a recording medium having a possible thickness to be sandwiched and conveyed in a belt conveying device illustrated in FIG. 2, for example, thin paper, regular paper, thick paper, envelope, OHP sheet, and the like.

The apparatus body 200 includes a sheet conveying path R to transport the sheet P from the sheet trays 13 to the output tray 20 through the secondary transfer nip region. On the sheet conveying path R, a registration roller pair 15 are disposed upstream from the secondary transfer roller 12 in a transport direction of a recording medium (hereinafter, referred to as a sheet conveying direction).

A fixing device 8, a sheet conveying device 9, and output roller pair 16 are disposed in turn at positions downstream from the secondary transfer roller 12 in the sheet conveying direction. The fixing device 8 includes a fixing roller 17 and a pressure roller 18. The fixing roller 17 functions as a fixing member including an internal heater. The pressure roller 18 functions as a pressing member to press the fixing roller 17. A fixing nip region is formed at a position at which the fixing roller 17 and the pressure roller 18 contact each other.

Next, a description is given of a basic operation of the image forming apparatus 500 with reference to FIG. 1.

It is to be noted that the components and units having the identical configuration or structure except for toner color are occasionally described without suffixes. For example, the photoconductors 2Y, 2C, 2M, and 2K are hereinafter also referred to in a singular form as the photoconductor 2.

When imaging operation is started, the photoconductor 2 (i.e., the photoconductors 2Y, 2C, 2M, and 2K) of the process unit 1 (i.e., the process units 1Y, 1C, 1M, and 1K) is rotated counterclockwise in FIG. 1, and the charging roller 3 (i.e., the charging rollers 3Y, 3C, 3M, and 3K) uniformly charges the surface of the photoconductor 2 with a given polarity.

Based on image data of an original document read by a reading device, the exposure device 6 irradiates laser light onto the charged surface of the photoconductor 2. At this time, image data exposed to each photoconductor 2 is single-color image information obtained by separating a desired full-color image into single-color information on yellow, cyan, magenta, and black. The developing device 4 (i.e., the developing devices 4Y, 4C, 4M, and 4K) supplies toner onto the electrostatic latent image formed on the photoconductor 2, thus developing the electrostatic latent images into a visible image as a toner image.

One of the rollers 21 through 24 over which the intermediate transfer belt 10 is stretched is driven for rotation to circulate the intermediate transfer belt 10 in the direction indicated by arrow DD in FIG. 1.

A voltage having a polarity opposite a charged polarity of toner and subjected to constant voltage or current control is supplied to the primary transfer roller 11 (i.e., the primary transfer rollers 11Y, 11C, 11M, and 11K). As a result, a transfer electric field is formed at the primary transfer nip region formed between each primary transfer roller 11 and the opposing photoconductor 2. Toner images of respective colors on the photoconductors 2 are transferred one on another onto the intermediate transfer belt 10 by the transfer electric fields formed at the primary nip regions. Thus, the intermediate transfer belt 10 bears a full-color toner image on the surface of the intermediate transfer belt 10.

Residual toner remaining on each photoconductor 2 without being transferred onto the intermediate transfer belt 10 is removed by the cleaning blade 5.

With rotation of the feed roller 14, the sheet P is fed from the corresponding sheet tray 13. The sheet P is further sent to the secondary transfer nip region between the secondary transfer roller 12 and the intermediate transfer belt 10 by the registration roller pair 15 so as to synchronize with the full-color toner image on the intermediate transfer belt 10.

At this time, a transfer voltage of the polarity opposite the charged polarity of toner of the toner image on the intermediate transfer belt 10 is supplied to the secondary transfer roller 12. As a result, a transfer electric field is formed at the secondary transfer nip region. By the transfer electric field formed at the secondary transfer nip region, the toner image on the intermediate transfer belt 10 is collectively transferred onto the sheet P.

Then, the sheet P is sent into the fixing device 8, and the fixing roller 17 and the pressure roller 18 apply heat and pressure to fix the toner image on the sheet P. After the sheet P is cooled by a sheet cooling member (a sheet cooling device) of the sheet conveying device 9, the output roller pair 16 output the sheet P onto the output tray 20.

The above description relates to image forming operation for forming a full color image on a sheet functioning as a recording medium. In other image forming operation, a single color image can be formed by any one of the process units 1Y, 1C, 1M, and 1K, or a composite color image of two or three colors can be formed by two or three of the process units 1Y, 1C, 1M, and 1K.

Now, FIG. 2 is a schematic front view illustrating the sheet cooling member (the sheet cooling device) of the sheet conveying device 9 according to an example of this disclosure. As illustrated in FIG. 2, the sheet cooling member that functions as a sheet conveying device corresponds to cooling members 33 (i.e., cooling members 33*a* and 33*b*), each functioning as a cooler to cool a sheet P conveyed by traveling of belts of a belt conveying unit 30.

The belt conveying unit 30 includes a first conveyance assembly 31 and a second conveyance assembly 32. The first conveyance assembly 31 is disposed at one face side (front face side or upper face side) of the sheet P. The second conveyance assembly 32 is disposed at the other face side (rear face side or lower face side) of the sheet P.

Each of the first conveyance assembly 31 and the second conveyance assembly 32 has at least one of the cooling members 33*a* and 33*b*. The cooling member (liquid cooling plate) 33*a* functions as a first sheet cooler that is disposed at one face side (front face side or upper face side) of the sheet P. The cooling member (liquid cooling plate) 33*b* functions as a second sheet cooler that is disposed at the other face side (rear face side or lower face side) of the sheet P.

The cooling members 33*a* and 33*b* are displaced in the sheet conveying direction of the sheet P. The cooling member 33*a* disposed on the one face side has a heat absorbing surface 34*a* as a lower surface having an arc shape slightly protruding downward. The cooling member 33*b* disposed on the other face side has a heat absorbing surface 34*b* as an upper surface having an arc shape slightly protruding upward.

Figure 3:
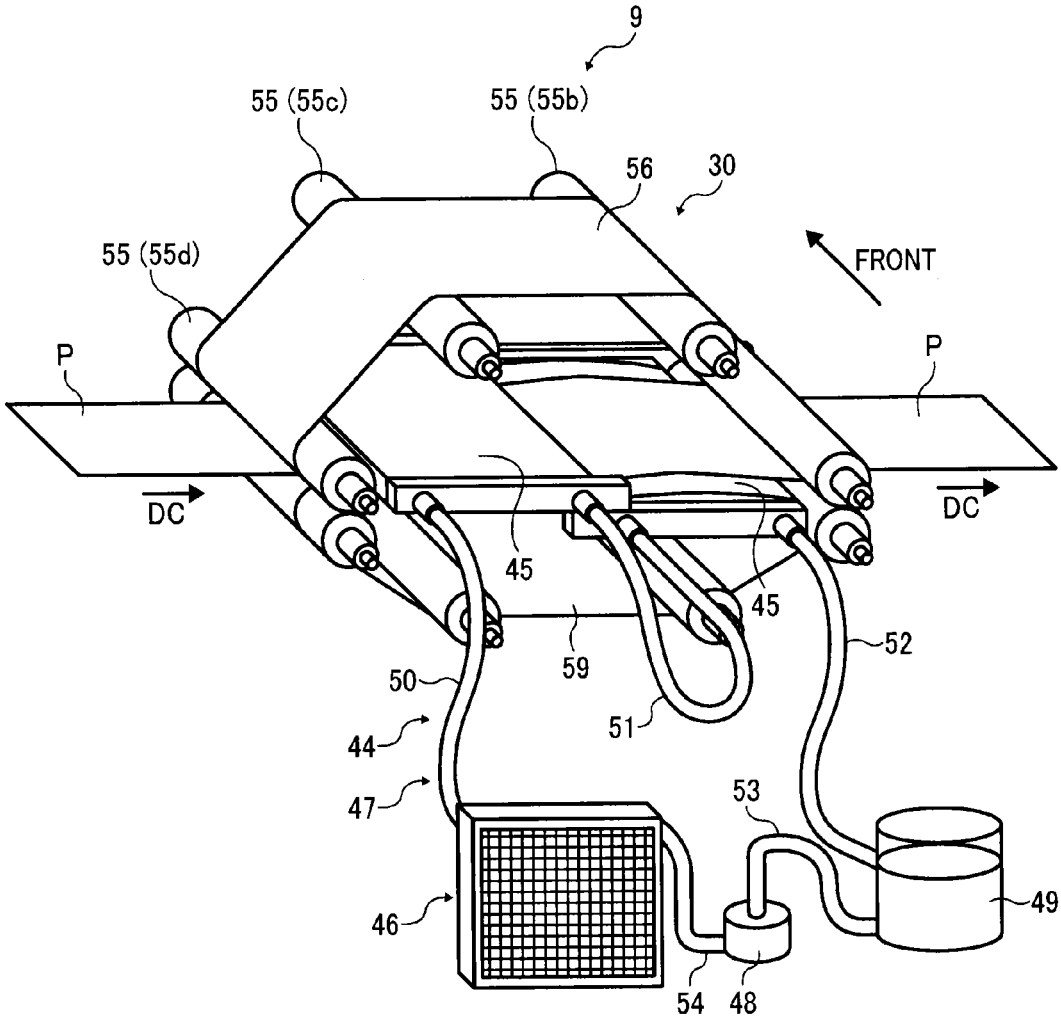
FIG. 3 is a perspective view illustrating a rear side of the cooling device and the sheet conveying device of FIG. 2.

In other words, as illustrated in FIG. 3, the sheet conveying device 9 has a cooling-liquid circuit 44. FIG. 3 is a schematic diagram illustrating a rear side of the sheet conveying device 9 of FIG. 2. The cooling-liquid circuit 44 includes a heat receiving part 45 to receive heat from a sheet P that functions as a heat generating part, a heat dissipating part 46 to radiate heat of the heat receiving part 45, and a circulation channel 47 to circulate cooling liquid through the heat receiving part 45 and the heat dissipating part 46. The circulation channel 47 includes a pump 48 to circulate cooling liquid and a liquid tank 49 to store cooling liquid. Each of the cooling members 33*a* and 33*b*, which are. e.g., liquid cooling plates, functions as the heat receiving part 45.

The cooling liquid is, for example, magnetic fluid that is prepared by stably dispersing ferromagnetic super fine particles such as highly concentrated magnetites in aqueous media such as water, hydrocarbon-based oils, and fluorinated oils and by forming with active agent that is firmly chemisorbed to a surface of the ferromagnetic super fine particles.

The circulation channel 47 includes pipes 50, 51, 52, 53, and 54. The pipe 50 connects a first opening 40*a* of the cooling member 33*a* to the liquid tank 49. The pipe 51 connects a second opening 40*b* of the cooling member 33*a* to a first opening 41*a* of the cooling member 33*b*. The pipe 52 connects a second opening 41*b* of the cooling member 33*b* and the liquid tank 49. The pipe 53 connects the liquid tank 49 to the pump 48. The pipe 54 connects the pump 48 to the heat dissipating part 46 as a radiator.

The first conveyance assembly 31 includes multiple rollers (driven rollers) 55 (e.g., four rollers 55*a*, 55*b*, 55*c*, and 55*d* in FIG. 2) and a belt (conveyance belt) 56. The belt 56 is an endless belt wound around the multiple rollers 55 (55*a*, 55*b*, 55*c*, and 55*d*).

The second conveyance assembly 32 includes multiple rollers (driven rollers) 57*b*, 57*c*, and 57*d* (e.g., four rollers 55*a*, 55*b*, 55*c*, and 55*d* in FIG. 2) and a belt (conveyance belt) 56. The belt 56 is an endless belt wound around the multiple rollers 55 (55*a*, 55*b*, 55*c*, and 55*d*).

When conveying the sheet P, the sheet P is sandwiched and conveyed by the belt 56 of the first conveyance assembly 31 and the belt 59 of the second conveyance assembly 32 disposed facing the first conveyance assembly 31, as illustrated in FIG. 2. In other words, as illustrated in FIG. 2, the belt 59 is traveled in a direction indicated by arrow DA (hereinafter, referred to as a direction DA) by driving of the driving roller 57*a*. Along with travel of the belt 59, the belt 56 of the first conveyance assembly 31 is traveled in a direction indicated by arrow DB (hereinafter, referred to as a direction DB) via the sheet P sandwiched between the belts 56 and 59. Thus, the sheet P is conveyed from an upstream side to a downstream side in a direction indicated by arrow DC in FIG. 2 (hereinafter, referred to as a direction DC).

Next, a description is given of operations of the cooling device of the sheet conveying device 9 having the above-described configuration.

When the sheet P is sandwiched and conveyed by the belts 56 and 59, as illustrated in, e.g., FIG. 2, the first conveyance assembly 31 and the second conveyance assembly 32 are placed adjacent to each other. In a state illustrated in FIG. 2, if the driving roller 57*a* of the second conveyance assembly 32 is rotated, as described above, the belts 56 and 59 travel in the directions DA and DB, respectively, to convey the sheet P in the direction DC. In such a state, cooling liquid is circulated in the cooling-liquid circuit 44. In other words, the pump 48 is activated to flow the cooling liquid through the cooling liquid channels of the cooling members 33*a* and 33*b*.

At this time, an inner circumferential surface of the belt 56 of the first conveyance assembly 31 slides over the heat absorbing surface 34*a* of the cooling member 33*a*. Similarly, an inner circumferential surface of the belt 59 of the second conveyance assembly 32 slides over the heat absorbing surface 34*b* of the cooling member 33*b*. From a back face (a lower face) side of the sheet P, the cooling member 33*b* absorbs heat of the sheet P via the belt 59. From a front face (an upper face) side of the sheet P, the cooling member 33*a* absorbs heat of the sheet P via the belt 56. In such a case, an amount of heat absorbed by the cooling members 33*a* and 33*b* is transported to the outside by the cooling liquid, thus maintaining the cooling members 33*a* and 33*b* at relatively low temperatures.

Specifically, by driving the pump 48, the cooling liquid is circulated through the cooling-liquid circuit 44. The cooling liquid flows through the cooling-liquid channels of the cooling members 33*a* and 33*b*, absorbs heat of the cooling members 33*a* and 33*b*, and turns into a relatively high temperature. The cooling liquid at high temperature passes the heat dissipating part 46 (e.g., the radiator), and heat of the cooling liquid is radiated to outside air, thus reducing the temperature of the cooling liquid. The cooling liquid at relatively low temperature flows through the cooling-liquid channels again, and the cooling members 33*a* and 33*b* act as the heat receiving part 45. By repeating the above-described cycle, the sheet P is cooled from both sides thereof.

In FIG. 1, an upper unit 60 and a lower unit 80 are illustrated with respective dashed lines.

The lower unit 80 is fixedly attached to the apparatus body 200.

The upper unit 60 has the rollers 55*a*, 55*b*, 55*c*, and 55*d* and the cooling member 33*a* therein. Specifically, both ends of the rollers 55*a*, 55*b*, 55*c*, and 55*d* forming the first conveyance assembly 31 illustrated in FIG. 2 are rotatably supported by the upper unit 60 and both ends of the cooling member 33*a* are fixed to the upper unit 60. The lower unit 80 has the rollers 57*a*, 57*b*, 57*c*, and 57*d* and the cooling member 33*b* therein. Specifically, both ends of the rollers 57*a*, 57*b*, 57*c*, and 57*d* forming the second conveyance assembly 32 illustrated in FIG. 2 are rotatably supported by the lower unit 80 and both ends of the cooling member 33*b* are fixed to the lower unit 80.

The upper unit 60 that functions as a third conveyor can switch between an open state and a closed state with respect to the lower unit 80 that functions as a fourth conveyor. Specifically, the upper unit 60 is substantially rotatably approach and separate from the lower unit 80 about a swing point. The swing point is disposed on a far side, which is a side located in the image forming apparatus 500 in a direction intersecting or perpendicular to the drawing sheet.

It is to be noted that a near side in a direction intersecting or perpendicular to the drawing sheet of FIG. 1 is also referred to a "front side" and a far side in the direction intersecting or perpendicular to the drawing sheet of FIG. 1 or the opposite side of the near side (the front side) in FIG. 1 is also referred to a "rear side". The far side of the image forming apparatus 500 in FIG. 1 is referred to as "one side" and the near side of the image forming apparatus 500 in FIG. 1 is referred to as "the other side". Further, the far side and the near side of the image forming apparatus 500 in FIG. 1 are referred to altogether as "both sides".

To separate the upper unit 60 from the lower unit 80, firstly a user stands at the front side of the image forming apparatus 500 in FIG. 1 to open a front door of the image forming apparatus 500. Along with the action, a lock mechanism that is included in the upper unit 60 (i.e., a lock mechanism 65 to be described below) is released. Then, as the user raises the upper unit 60 in a direction indicated by arrow U in FIG. 1, the upper unit 60 is released and separated from the lower unit 80.

It is to be noted that the direction U corresponds to an upward direction in a vertical direction. By releasing the upper unit 60 from the lower unit 80, a space is created in the sheet conveying path R between the lower unit 80 and the upper unit 60 for handling a paper jam. As a result, the user can facilitate cleaning and maintenance work including paper jam handlings.

It is to be noted that, as described above, the upper unit 60 and the lower unit 80 are disposed in the vertical direction with respect to the sheet conveying direction that is substantially a horizontal direction. However, various installation states can be expected based on layout of the image forming apparatus 500. Accordingly, it is obvious that the upper unit 60 may be referred to as "one unit" or "a first conveyor" and the lower unit 80 may be referred to as "the other unit" or "a second conveyor".

Now, a detailed description is given of the configurations of the upper unit 60 and the lower unit 80 with a unit operating device 100 with reference to FIGS. 4A through 9.

Figure 4A:
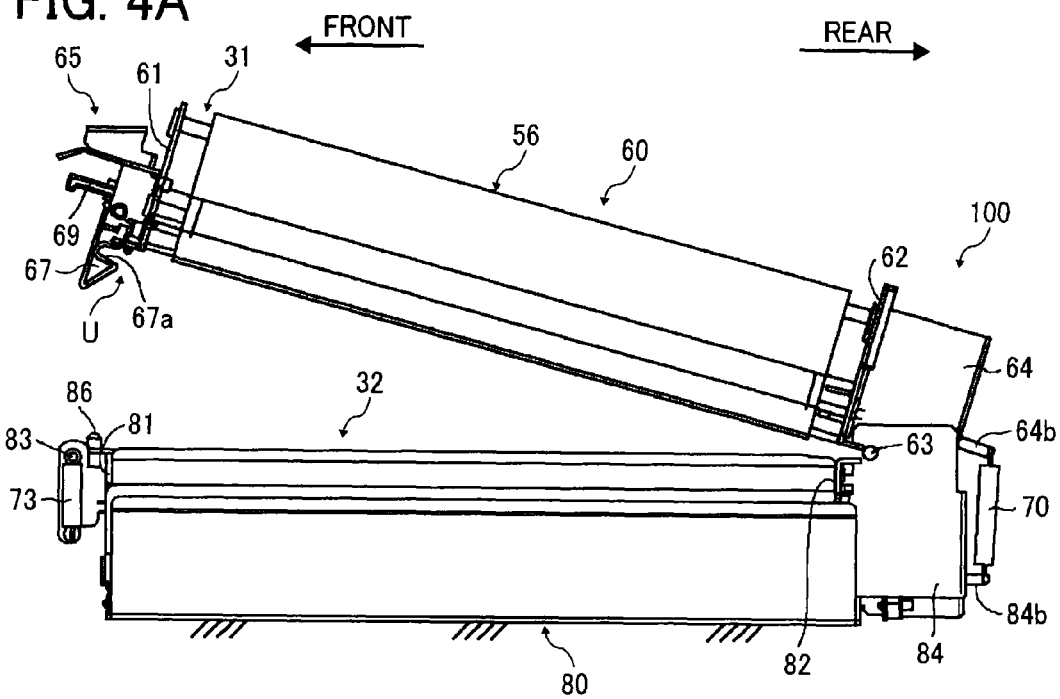
FIG. 4A is a front view illustrating an upper unit in a fully open state.
Figure 4B:
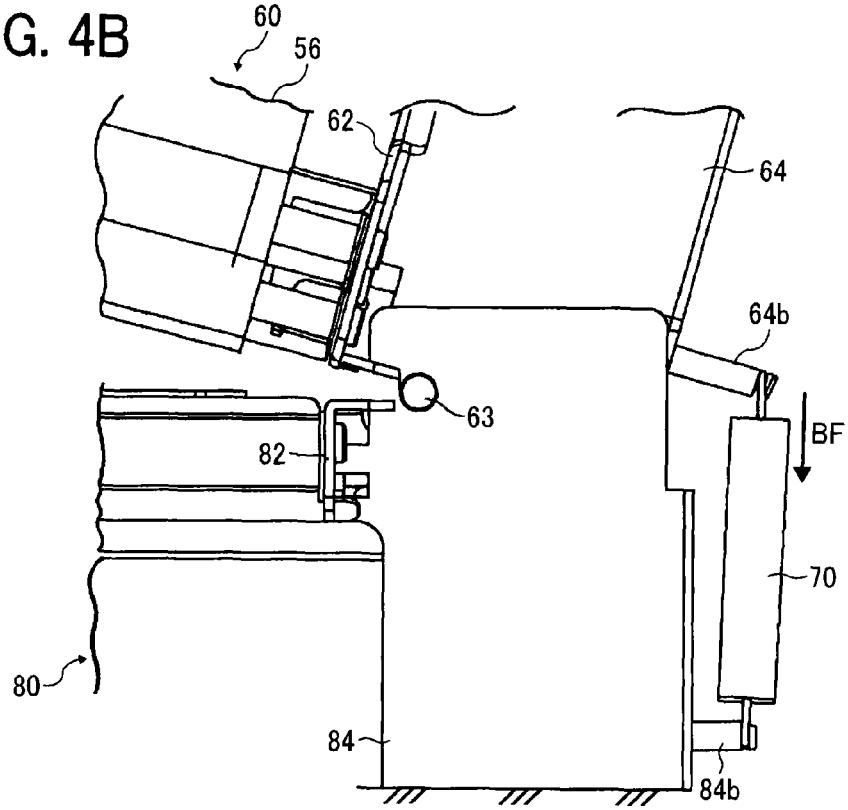
FIG. 4B is a partial enlarged front view illustrating the upper unit of FIG. 4A.
Figure 5:
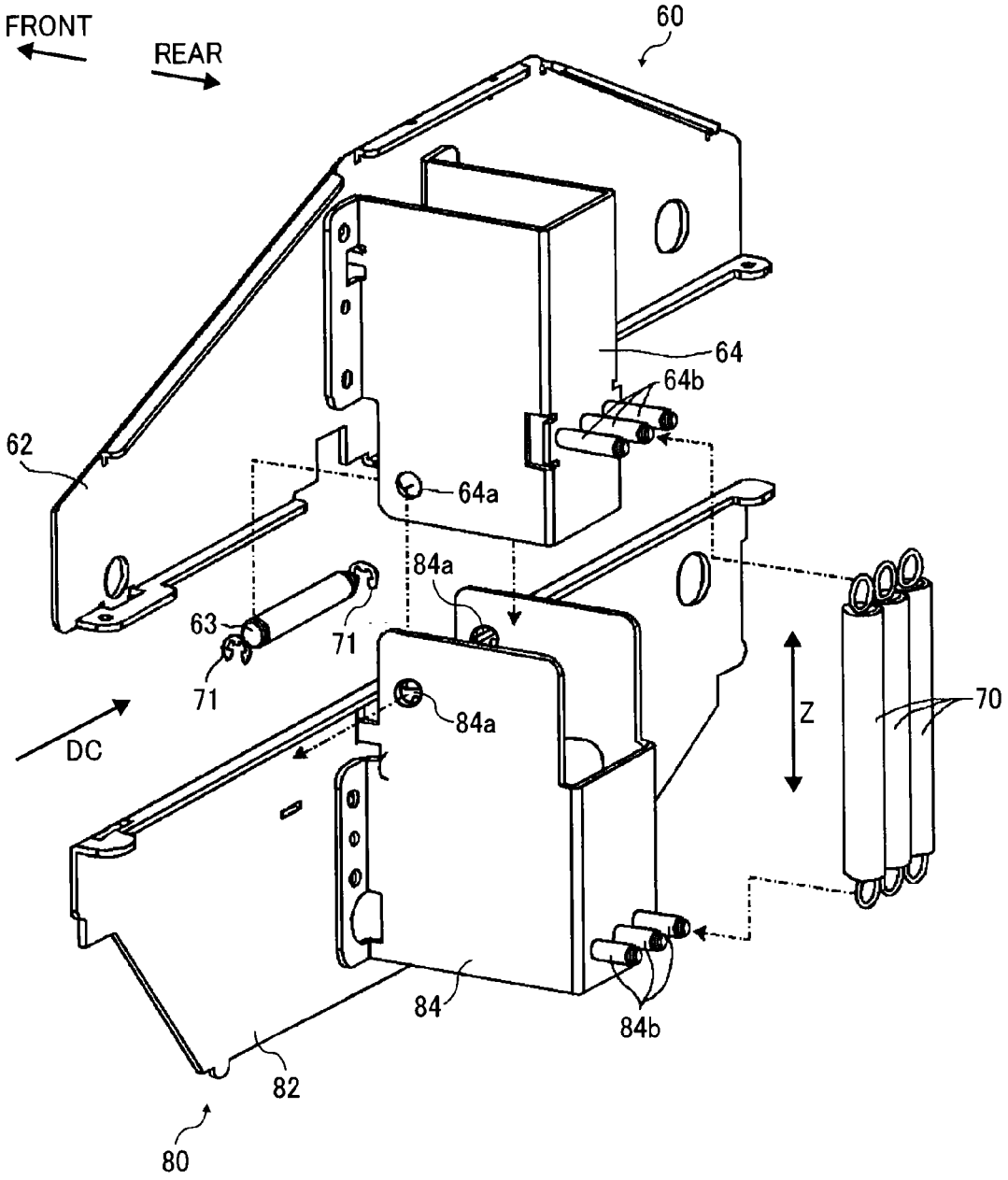
FIG. 5 is an exploded perspective view illustrating a rear side of the upper unit and a rear side of a lower unit.
Figure 6:
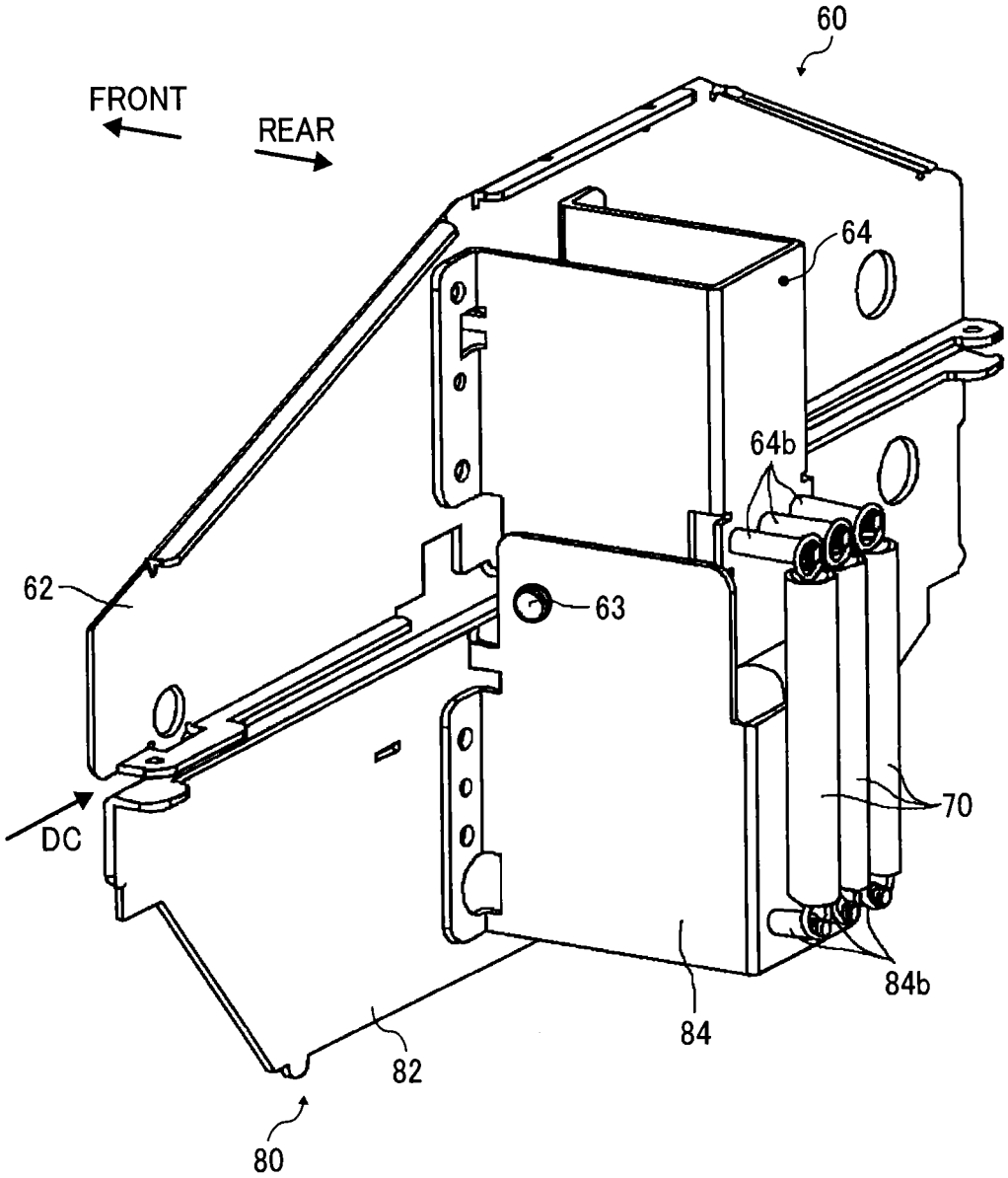
FIG. 6 is an assembly drawing illustrating the rear side of the upper unit and the rear side of the lower unit.
Figure 7:
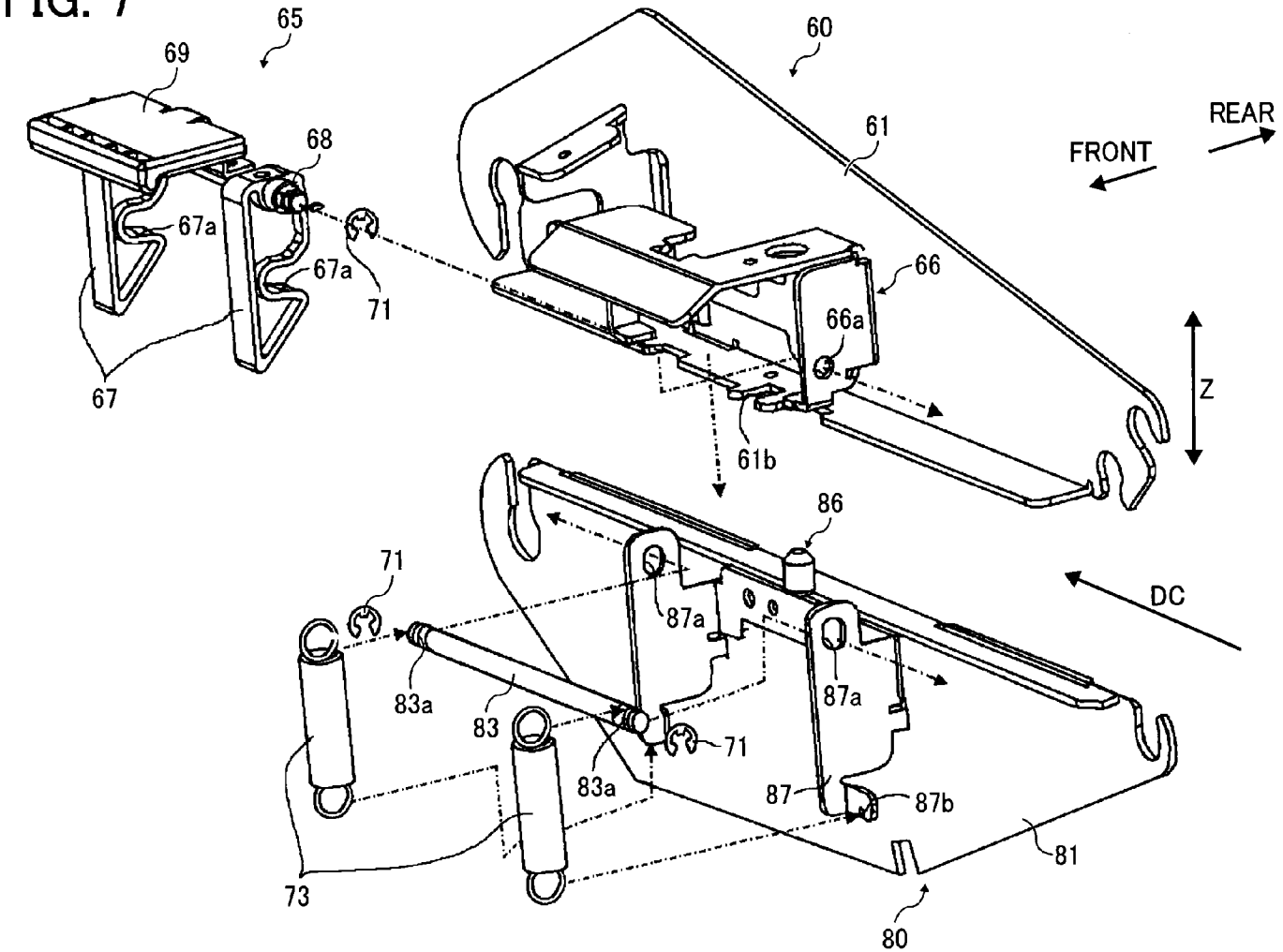
FIG. 7 is an exploded perspective view illustrating a front side of the upper unit and a front side of the lower unit.
Figure 8:
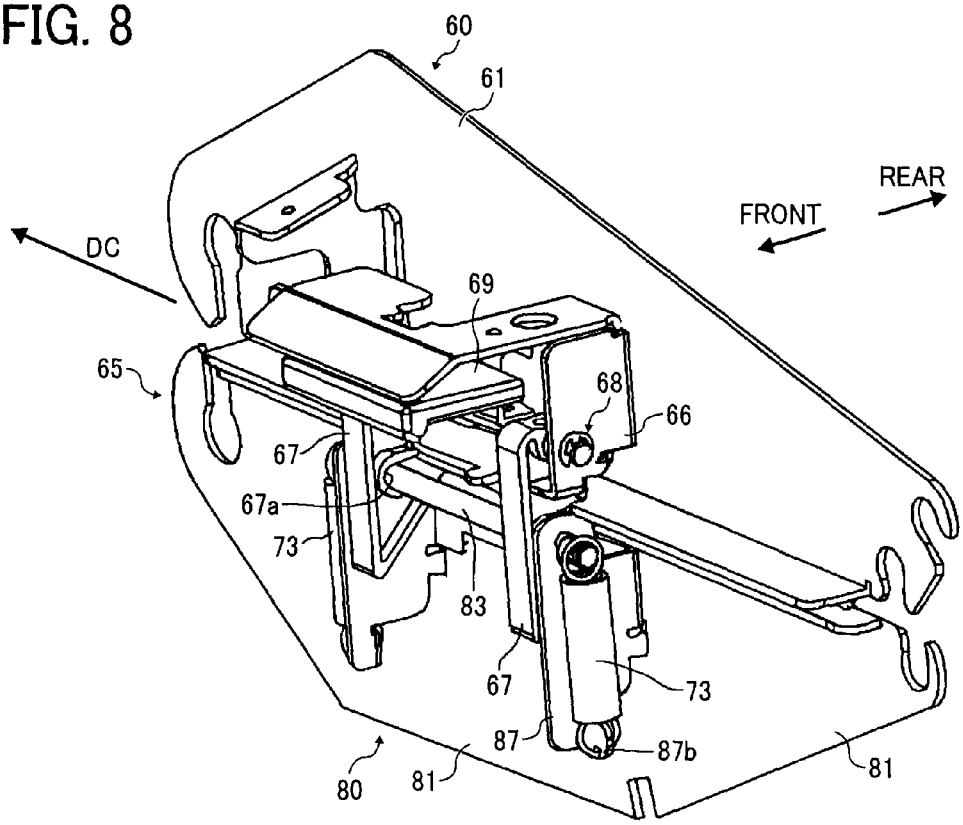
FIG. 8 is an assembly drawing illustrating the front side of the upper unit and the front side of the lower unit.

FIG. 4A is a front view illustrating the upper unit 60 in a fully open state. FIG. 4B is a partial enlarged front view illustrating the upper unit 60 of FIG. 4A. FIG. 5 is an exploded perspective view illustrating a rear side of the upper unit 60 and a rear side of the lower unit 80. FIG. 6 is an assembly drawing illustrating the rear side of the upper unit 60 and the rear side of the lower unit 80. FIG. 7 is an exploded perspective view illustrating a front side of the upper unit 60 and a front side of the lower unit 80. FIG. 8 is an assembly drawing illustrating the front side of the upper unit 60 and the front side of the lower unit 80.

In FIG. 4A and after, the front or the front side of the image forming apparatus 500 represents the near side or the front thereof in FIG. 1 and is indicated as "the opposite side" in this disclosure. Further, the rear or the rear side of the image forming apparatus 500 represents the far side that is opposite the near side or the front side of the image forming apparatus 500 and intersecting or perpendicular to the drawing sheet of FIG. 1 and is indicated as "one side" of this disclosure.

It is to be noted that the structures of the pipes and the cooling device illustrated in FIG. 3 are removed from FIG. 4A and after for explaining the upper unit 60 and the lower unit 80.

Figure 9:
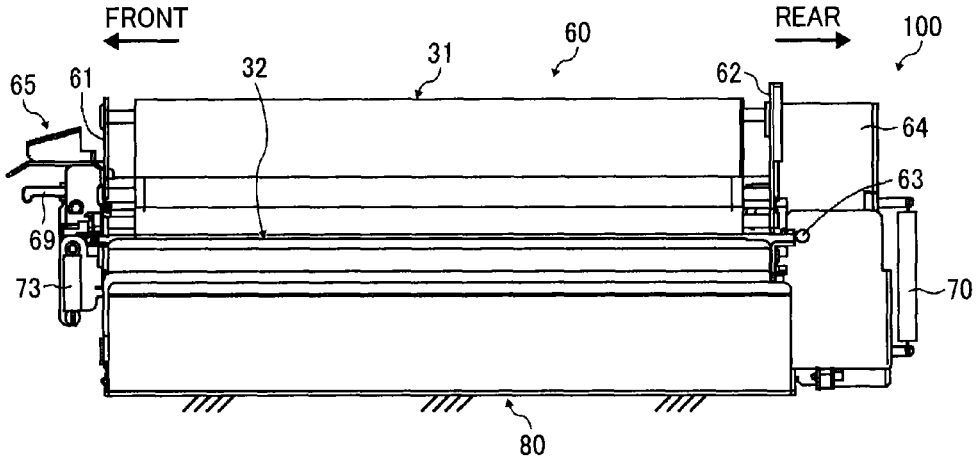
FIG. 9 is a front view illustrating the upper unit when the upper unit in a fully closed state.

The upper unit 60 is rotatably and openably supported between an approaching state (a fully closed state) in which the upper unit 60 approaches close to the lower unit 80 as illustrated in FIG. 9 and a separating state (a fully open state) in which the upper unit 60 separates from the lower unit 80 and fully opens as illustrated in FIGS. 4A and 4B.

Here, the approaching state represents a state in which the first conveyance assembly 31 of the upper unit 60 faces the second conveyance assembly 32 of the lower unit 80 illustrated in FIG. 2, so that the first conveyance assembly 31 and the second conveyance assembly 32 have reached respective positions ready to sandwich and hold the sheet P between the belt 56 of the first conveyance assembly 31 and the belt 59 of the second conveyance assembly 32. The separating state is a state that the paper jam handlings, cleaning and maintenance work can be performed, as described above.

The unit operating device 100 includes an opening and closing mechanism that can make the upper unit 60 openable and rotatable so that the upper unit 60 can have both the approaching state and the separating state.

The upper unit 60 and the lower unit 80 include a sheet metal that is a metallic thin plate or a steel to obtain rigidity. Rigidity is thus obtained so as to secure the positions of, especially, the cooling members 33*a* and 33*b* as illustrated in FIG. 2 in the closed state of the upper unit 60. By so doing, the cooling members 33*a* and 33*b* can sandwich and hold the sheet P to convey reliably.

As illustrated in FIG. 4A, the upper unit 60 includes a pair of side panels, which are a front side panel 61 and a rear side panel 62. Both ends of the respective shafts of the rollers 55*a*, 55*b*, 55*c*, and 55*d* forming the first conveyance assembly 31 illustrated in FIG. 2 are rotatably supported by the front side panel 61 and the rear side panel 62 of the upper unit 60. Further, the cooling member 33*a* is fixed between the front side panel 61 and the rear side panel 62 to a portion illustrated in FIG. 2.

In FIGS. 4A and 4B, the cooling member 33*a* is disposed behind the belt 56 and not shown.

The lower unit 80 includes a pair of side plates, which are a front side panel 81 and a rear side panel 82. Both ends of the respective shafts of the rollers 57*a*, 57*b*, 57*c*, and 57*d* forming the second conveyance assembly 32 illustrated in FIG. 2 are rotatably supported by the front side panel 81 and the rear side panel 82 of the lower unit 80. Further, the cooling member 33*b* is fixed between the front side panel 81 and the rear side panel 82 to a portion illustrated in FIG. 2. In FIGS. 4A and 4B, the cooling member 33*b* is disposed behind the belt 56 and not shown.

The front side panel 61 and the rear side panel 62 of the upper unit 60 are formed by sheet metal.

As illustrated in FIGS. 5 and 6, an upper bracket 64 is fixedly disposed to the rear side panel 62 included in the upper unit 60. The upper bracket 64 is made of sheet metal and functions as a mount to mount a rear shaft 63. The rear shaft 63 is a long round bar. Two shaft fixing openings 64*a* are formed on the upper bracket 64. The rear shaft 63 is fixedly attached by passing through the shaft fixing openings 64*a*.

Further, three spring locking pins 64*b* are provided in a manner of projecting to the rear side of the upper bracket 64 so that the spring locking pins 64*b* lock respective one end of three springs 70. Each of the three springs 70 functions as a tension spring. The three springs 70 are provided to the rear side of the upper bracket 64 so that each of the three springs 70 functions as a pressing member (or a biasing member) to press the first conveyance assembly 31 in a direction to approach the second conveyance assembly 32 of the lower unit 80 via the upper unit 60 at least in the approaching state. Further, the three springs 70 function as a second pressing member to press the first conveyance assembly 31 toward a direction to the separating direction via the upper unit 60. Each of the three springs 70 is based on specifications of a spring (spring constant, length of spring in tension, etc.) identical thereto.

A lower bracket 84 of sheet metal is fixed to the rear side panel 82 of the lower unit 80. Two rear shaft guide openings 84*a* are formed on the lower bracket 84. The rear shaft 63 passes through the rear shaft guide openings 84*a*. Further, three spring locking pins 84*b* are provided in a manner of projecting to the rear side of the lower bracket 84 so that the spring locking pins 84*b* lock the other end of respective three springs 70.

In FIGS. 5 and 6, the shaft fixing openings 64*a* formed on the upper bracket 64 on the side of the rear side panel 62 and the rear shaft guide openings 84*a* formed on the lower bracket 84 on the side of the rear side panel 82 are overlapped. In this state, the rear shaft 63 is inserted from the rear shaft guide openings 84*a* toward the shaft fixing openings 64*a*. Then, retaining rings 71 are attached to both ends of the rear shaft 63 so as to prevent the rear shaft 63 from coming off. Further, the three spring locking pins 64*b* of the upper bracket 64 and the three spring locking pins 84*b* of the lower bracket 84 so that the spring locking pins 64*b* lock the one ends of the springs 70 and the spring locking pins 84*b* lock the other ends of the springs 70. By so doing, the rear side panel 62 of the upper unit 60 is rotatably connected to the rear side panel 82 of the lower unit 80 via the rear shaft 63 as an assembly.

As illustrated in FIGS. 7 and 8, a lock mechanism 65 is disposed on the front side of the upper unit 60 and the lower unit 80. The lock mechanism 65 functions as a second attaching part to fix a position of the first conveyance assembly 31 that is provided to the upper unit 60 in a direction facing the second conveyance assembly 32 that is provided to the lower unit 80.

The lock mechanism 65 can also hold the first conveyance assembly 31 of the upper unit 60 in the approaching state. The lock mechanism 65 includes lock levers 67, a lever shaft 68, and a handle 69.

The handle 69 is fixed to an upper center of the lever shaft 68. A user operates the handle 69 to unlock the first conveyance assembly 31 from the second conveyance assembly 32. Further, the lock levers 67 having respective substantially U-shaped engaging recesses 67*a* are fixed to both ends of the lever shaft 68 on an upstream side and a downstream side in the sheet conveying direction DC. Each of the engaging recesses 67*a* functions as a constraint part to fix an opposite position of the first conveyance assembly 31 that is provided to the upper unit 60 by engaging with both ends of upstream and downstream sides of a front shaft 83 provided to the front side panel 81 in the sheet conveying direction DC.

A lever bracket 66 is fixed to the front side panel 61 included in the upper unit 60. The lever bracket 66 is formed by a bent sheet metal to attach the lock mechanism 65 to the upper unit 60.

Further, a recess 61*b* that functions as a restriction member is cut out on a lower plate of the front side panel 61. Further, a projection 86 is fixedly provided on an upper plate of the front side panel 81. The projection 86 is projected upwardly to engage with the recess 61*b*.

A front shaft 83 is a long round bar. Spring locking grooves 83*a* are formed at an upstream end and a downstream end of the front shaft 83 in the sheet conveying direction DC to lock one end of each spring 73 that functions as a tension spring.

A front bracket 87 is fixed to the front side panel 81 to attach the front shaft 83 to be movable in the vertical direction. Two front shaft guide openings 87*a* are formed on vertical walls of the front bracket 87. Each of the front shaft guide openings 87*a* functions as a guide the front shaft 83 to move vertically. Further, two spring locking pieces 87*b* are provided to the front bracket 87 to lock the other end of each of the springs 73.

The two springs 73 function as a pressing member (or a biasing member) to press the first conveyance assembly 31 in the direction to approach the second conveyance assembly 32 of the lower unit 80 via the upper unit 60 at least in the approaching state.

In FIGS. 7 and 8, the front shaft 83 is inserted into the front shaft guide openings 87*a* formed on the front bracket 87 of the front side panel 81 of the lower unit 80. Then, the retaining rings 71 are attached to both ends of the front shaft 83 to prevent the front shaft 83 from coming off. Further, one ends of the two springs 73 are fitted to both ends of the spring locking grooves 83*a* of the front shaft 83 and the other ends of the two springs 73 are fitted to the two spring locking pieces 87*b* formed on the front bracket 87. At this time, due to a pressure force (a biasing force BF) of each of the springs 73, the front shaft 83 is pressed to a bottom edge of each of the front shaft guide openings 87*a* of the front bracket 87.

In FIGS. 7 and 8, the lever shaft 68 of the lock mechanism 65 is inserted into a lever shaft support opening 66*a* of the lever bracket 66 that is fixed to the front side panel 61 of the upper unit 60. Then, the retaining rings 71 are attached to both ends of the lever shaft 68 to prevent the lever shaft 68 from coming off.

With the upper unit 60 and the lower unit 80 assembled as described above, the upper unit 60 can rotatably separate from and approach close to the lower unit 80 and the sheet conveying path R. Specifically, the upper unit 60 can be rotatably and openably supported between the separating state in which the upper unit 60 is fully open and is separated from the lower unit 80 as illustrated in FIGS. 4A and 4B and the approaching state in which the upper unit 60 is fully closed to approach the lower unit 80 as illustrated in FIG. 9.

Figure 14:
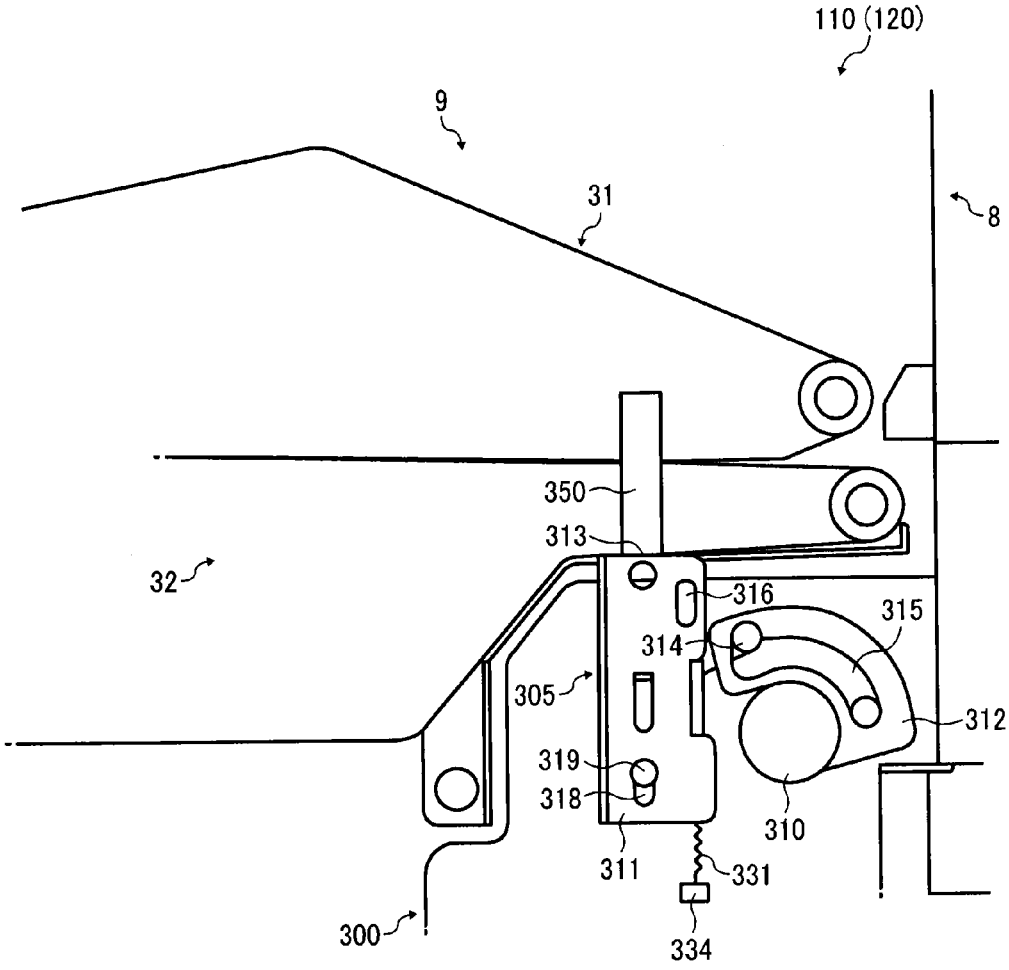
FIG. 14 is a front view illustrating the fixing device stored in the image forming apparatus and detachment of the fixing device restricted.

A description is given of a series of operations of the upper unit 60 from the fully open state to the fully closed state with reference to FIGS. 4A, 4B, and 9. FIG. 14 is a front view illustrating the upper unit 60 in the fully closed state.

Referring to FIGS. 4A and 4B, the operations to retaining the upper unit 60 in the fully open state are described. A user moves the handle 69 of the lock mechanism 65 illustrated in FIGS. 7 and 8 to release the engaging recess 67*a* of the lock lever 67 that is locked with the front shaft 83. Along with the action, the upper unit 60 is open in the direction indicated by arrow U in FIG. 1.

At this time, due to the moment based on the biasing force of the three springs 70 supported by the rear shaft 63 as a fulcrum, the upper unit 60 is retained fully open in the separating state.

Then, the user holds the handle 69 of the lock mechanism 65 and/or the front side end of the upper unit 60 to rotate the upper unit 60 toward a direction to close the upper unit 60 against the moment based on the biasing force of the three springs 70.

As a result of this action, the upper unit 60 is fully closed to the lower unit 80 as the fully closed state, as illustrated in FIG. 9. To fully close the upper unit 60, the user moves the handle 69 of the lock mechanism 65 illustrated in FIG. 9 to fit the engaging recess 67*a* of the lock lever 67 with the front shaft 83. At this time, the front shaft 83 is stretched in a vertically downward direction by the biasing force of the two springs 73. The handle 69 is moved against the biasing force exerted by the two springs 73.

As the user moves the handle 69 of the lock mechanism 65 to fit the engaging recess 67*a* of the lock lever 67 with the front shaft 83, the upper unit 60 becomes completely in the approaching state. Specifically, the front shaft 83 is pulled by the biasing force exerted by the two springs 73 in the vertically downward direction. By so doing, a position of the front side of the upper unit 60 and the front side of the lower unit 80 in a vertical direction Z is determined. At this time, due to the biasing force exerted by the two springs 73, the front shaft 83 is raised at a substantially middle position of the front shaft guide openings 87*a* in the vertical direction without contacting or fitting to the upper and lower edges within the front shaft guide openings 87*a*. At the same time, the projection 86 is fitted to the recess 61*b* of the upper unit 60 to position the upper unit 60 in a rotation direction.

At the same time, the upper unit 60 on the rear side is pulled by the biasing force exerted by the three springs 70 in the vertically downward direction. By so doing, respective positions of the rear side of the upper unit 60 and the rear side of the lower unit 80 in the vertical direction Z are determined. Consequently, the respective positions of the front and rear sides of the upper unit 60 and the lower unit 80 in the vertical direction Z are determined.

At the same time, the projections 86 provided to the front side and the rear side of the lower unit 80 are fitted to the recesses 61*b* provided to the front side and the rear side of the upper unit 60 to position the rear side of the upper unit 60 in the rotation direction.

It is to be noted that detailed descriptions of the operations to open the upper unit 60 from which the upper unit 60 is fully closed with the lower unit 80 in the approaching state and locked by the lock mechanism 65 to which the upper unit 60 is fully open from the lower unit 80 in the separating state are omitted because the detailed operation to open the upper unit 60 is performed in the opposite procedures of the above-described operations to close the upper unit 60.

Further, it is to be noted that the sheet conveying device 9 may have the configuration that does not include the cooling member 33. Such the configuration of the sheet conveying device 9 can achieve the same effect as the configuration thereof described above.

Figure 10:
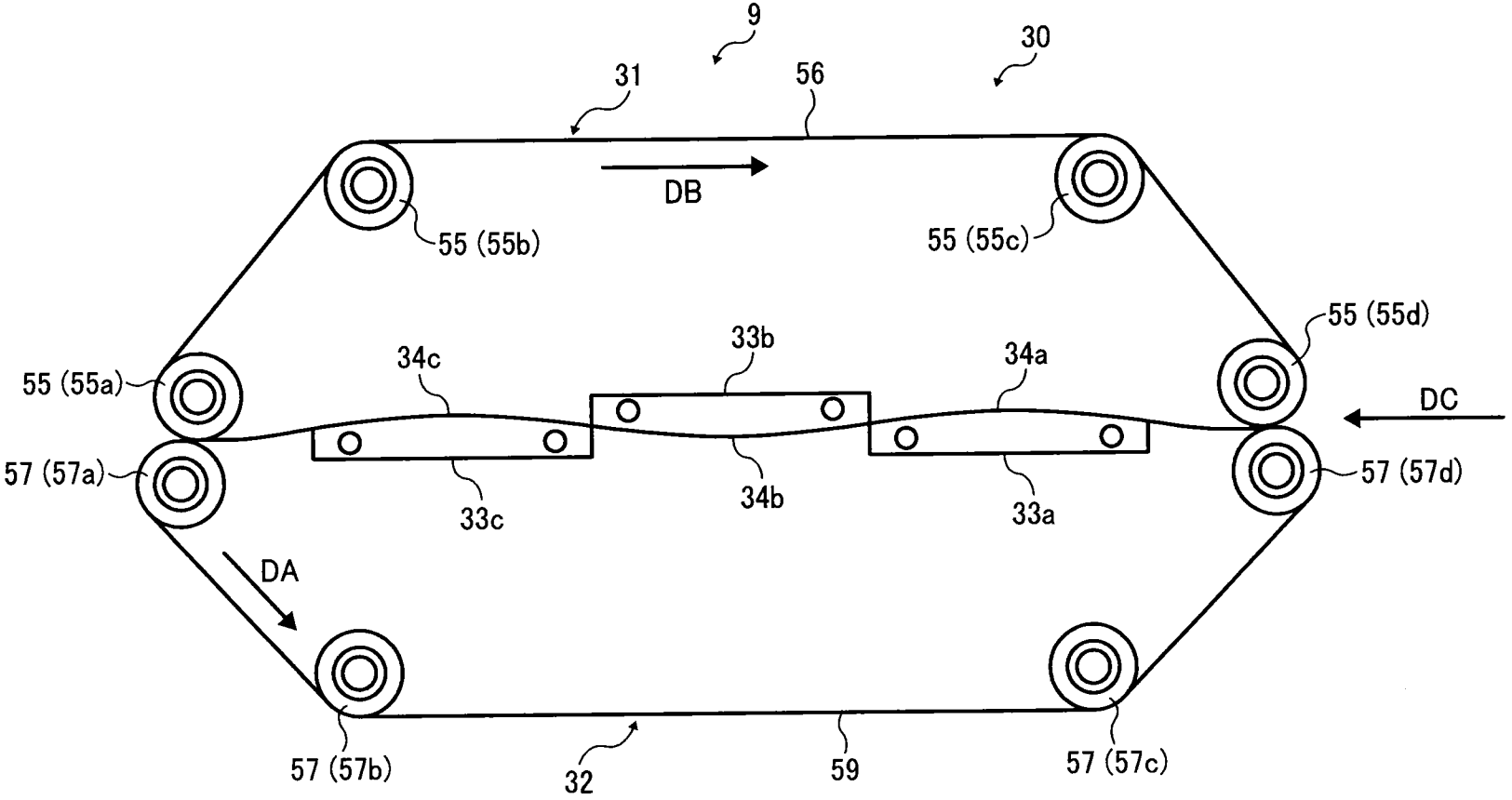
FIG. 10 is a schematic front view illustrating a sheet conveying device including cooling members (a sheet cooling device) according to another example of this disclosure.
Figure 11:
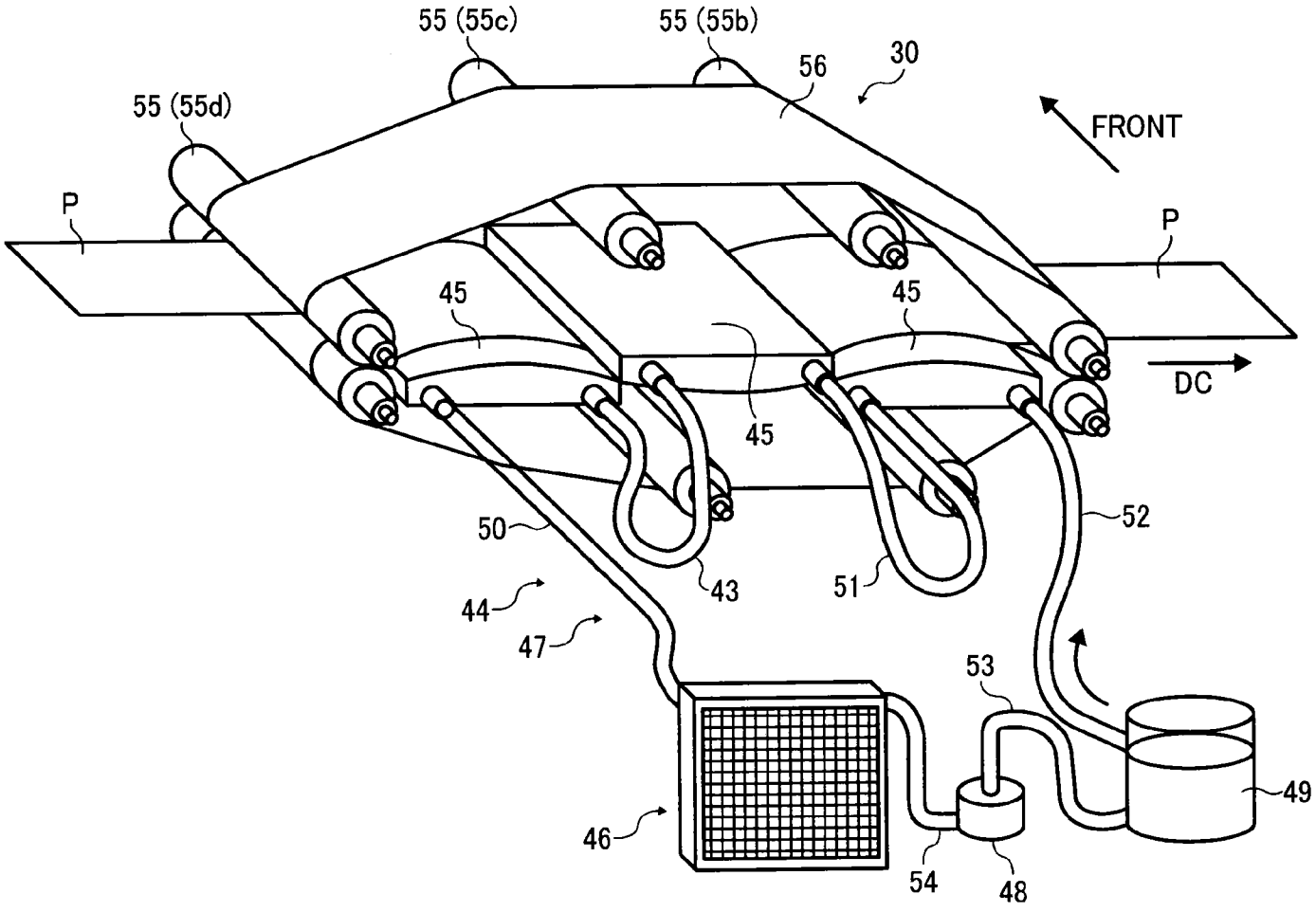
FIG. 11 is a perspective view illustrating a rear side of the sheet cooling members (the sheet cooling device) of the sheet conveying device of FIG. 10.

Now, a description is given of a configuration of the sheet conveying device 9 according to another example of this disclosure with reference to FIGS. 10 and 11.

FIG. 10 is a schematic front view illustrating the sheet conveying device 9 including a cooling device according to another example of this disclosure. FIG. 11 is a perspective view illustrating the rear side of the cooling device of the sheet conveying device 9 of this example. Comparing with the cooling device illustrated in FIGS. 2 and 3, the cooling device according to this example additionally includes a cooling member 33*c* that functions as a third cooling member. The cooling device according to this example is further different in a structure of the pipes according to this change.

A description is given of a configuration of the cooling device, focusing on the above-described differences.

In this example, the cooling member 33*a* that functions as a first sheet cooler is disposed at one face side (rear face side or lower face side) of the sheet P. The cooling member (liquid cooling plate) 33*b* that functions as a second sheet cooler is disposed at the other face side (front face side or upper face side) of the sheet P. Further, the cooling member 33*c* that functions as a third sheet cooler is disposed at one face side (rear face side or lower face side) of the sheet P, which is the same face side as the cooling member 33*a*.

The cooling members 33*a*, 33*b*, and 33*c* are displaced in the sheet conveying direction DC of the sheet P. The cooling members 33*a* and 33*c* disposed on the other face side have heat absorbing surfaces 34*a* and 34*c*, respectively, as an upper surface having an arc slightly protruding upwardly. The cooling member 33*b* disposed on one face side has a heat absorbing surface 34*b* as a lower surface having an arc slightly protruding downwardly. Each of the cooling members 33*a*, 33*b*, and 33*c* includes a cooling-liquid channel through which cooling liquid flows.

As illustrated in FIG. 11, the pipe structure that communicates the cooling members 33*a*, 33*b*, and 33*c* when compared with the sheet cooling members of the sheet conveying device 9 according to the example illustrated in FIG. 3, the pipe structures are different. Specifically, as illustrated in FIG. 11, the circulation channel 47 includes the pipes 43, 50, 51, 52, 53, and 54. The pipe 50 connects the first opening of the cooling member 33*a* to the heat dissipating part 46 as a radiator. The pipe 43 connects the second opening of the cooling member 33*a* to the first opening of the cooling member 33*b*. The pipe 51 connects the second opening of the cooling member 33*b* to the first opening of the cooling member 33*c*. The pipe 52 connects the second opening of the cooling member 33*c* and the liquid tank 49. The pipe 53 connects the liquid tank 49 and the pump 48. The pipe 54 connects the pump 48 and the radiator, i.e., the heat dissipating part 46.

The operations of the sheet cooling member having the above-described configuration according to this example are basically same as the operations of the sheet cooling member illustrated in FIGS. 2 and 3, except that additional procedure associated with the cooling member 33*c*. A person skilled in the art can fully understand such operations and reliably perform the operations based on this example, and therefore a detailed description of the operations of the sheet cooling member according to this example are omitted. This disclosure can be applied to the sheet conveying device 9 having the sheet cooling member illustrated in FIGS. 10 and 11 by including an unit operating device that is openably closable with the upper unit and the lower unit, which is similar to the unit operating device 100 illustrated in FIGS. 4A through 8.

Figure 12:
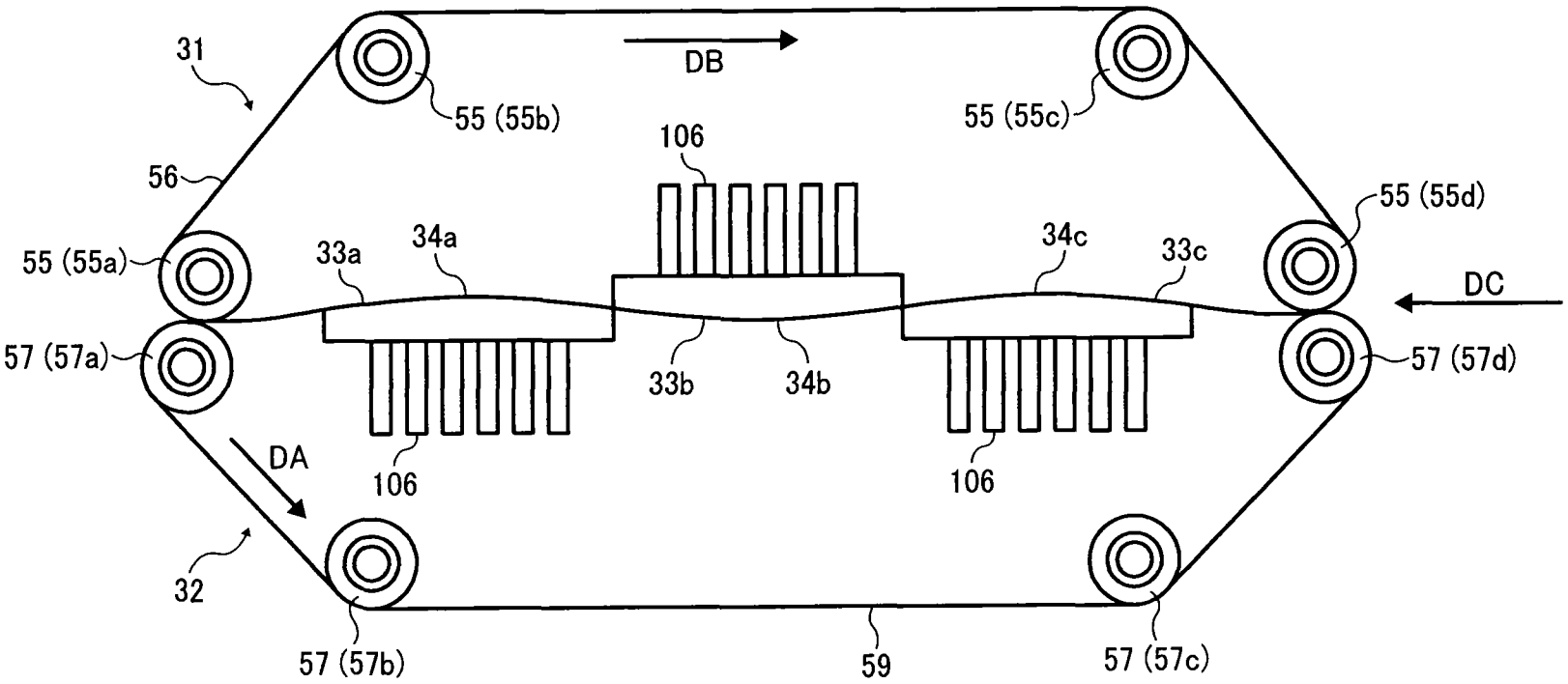
FIG. 12 is a schematic front view illustrating a sheet conveying device including sheet cooling members (a sheet cooling device) according to yet another example of this disclosure.

Now, a description is given of a configuration of the sheet conveying device 9 according to yet another example of this disclosure with reference to FIG. 12.

FIG. 12 is a schematic front view illustrating the sheet conveying device 9 including the sheet cooling member (the sheet cooling device) according to yet another example of this disclosure.

Comparing with the cooling device provided with the cooling-liquid circuit 44 as illustrated in FIGS. 2, 3, and 11, the cooling device according to this example includes a heat dissipating promoter 106 instead of the cooling-liquid circuit 44. The heat dissipating promoter 106 is, for example, an air-cooling heat sink having multiple fins. The relation of the heat absorbing surfaces 34*a*, 34*b*, and 34*c* and the belts 56 and 59 is the same as that described in the configuration according to the example illustrated in FIGS. 10 and 11.

As described above, by providing the air-cooling heat sink in the configuration according to this example, the cooling-liquid circuit 44 can be removed from the configuration, which facilitates a reduction in the image forming apparatus 500 and a reduction in cost.

This disclosure can be applied to the sheet conveying device 9 having the sheet cooling members illustrated in FIG. 12 by including an unit operating device that is openably closable with the upper unit and the lower unit, which is similar to the unit operating device 100 illustrated in FIGS. 4A through 8.

Next, a description is given of a sheet conveying mechanism 110 with reference to FIGS. 13 through 24.

The sheet conveying mechanism 110 functions as a sheet conveyor and includes the fixing device 8 that is movable in the direction intersecting the sheet thickness direction of the sheet P with respect to the sheet conveying path R and the sheet conveying device 9 that includes the upper unit 60 and the lower unit 80 approaching and separating from each other via the sheet conveying path R in the sheet thickness direction of the sheet P. The fixing device 8 and the sheet conveying device 9 have the sheet conveying path R therein. It is to be noted that a sheet cooling conveyor 120 includes the sheet conveying mechanism 110 provided with the sheet conveying device 9 having the cooling members 33 to cool the sheet P.

Figure 13A:
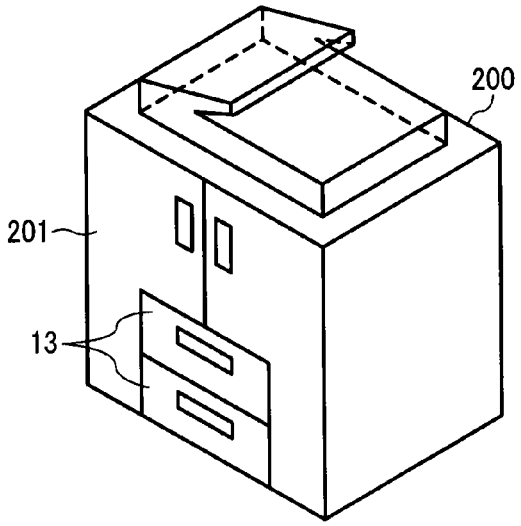
FIG. 13A is a perspective view illustrating the image forming apparatus and a fixing device with a cover of an apparatus body closed.
Figure 13B:
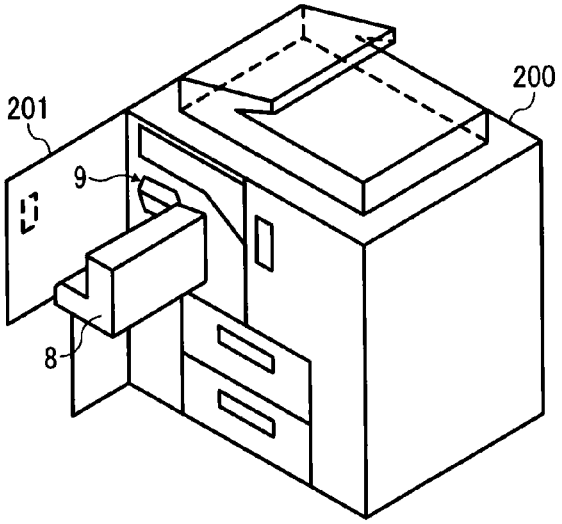
FIG. 13B is a perspective view illustrating the image forming apparatus and the fixing device with the cover of the apparatus body open.
Figure 13C:
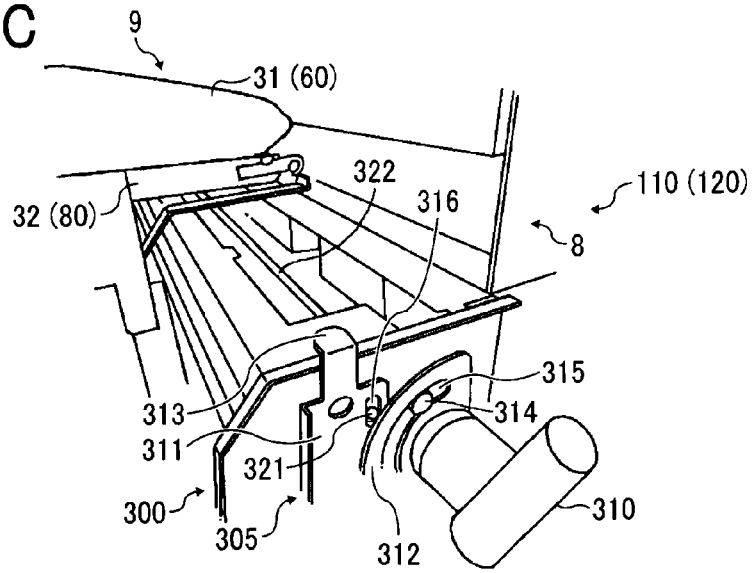
FIG. 13C is a perspective view illustrating the image forming apparatus and the fixing device with the cover of the apparatus body open.

FIG. 13A is a perspective view illustrating the apparatus body 200 with a cover 201 closed. FIGS. 13B and 13C are perspective views illustrating the apparatus body 200 with the cover 201 open and with the fixing device 8 removed therefrom. FIG. 14 is a front view illustrating the fixing device 8 stored in the apparatus body 200 of the image forming apparatus 500 and detachment of the fixing device 8 restricted.

As described above, the apparatus body 200 has the cover 201 that is openably closable to rotate about a shaft that is attached to the apparatus body 200. By opening the cover 201, the fixing device 8 can be pulled out therefrom and the upper unit 60 of the sheet conveying device 9 can be approached to or separated from the lower unit 80, which facilitates maintenance work.

The fixing device 8 includes a protrusion 300 that protrude in the sheet conveying direction toward the sheet conveying device 9. The protrusion 300 is disposed below the second conveyance assembly 32. At least part of the second conveyance assembly 32 is arranged between the first conveyance assembly 31 and the protrusion 300.

As illustrated in FIG. 13, by holding the lever 310 that is provided to the front face of the protrusion 300 in an unlocked state of the fixing device 8 and pulling the lever 310 toward a user, the fixing device 8 can be detached from the apparatus body 200. The lever 310 has a fan-shaped frame 312 fixed thereto. The fan-shaped frame 312 rotates integrally with the lever 310 about a shaft 322 of the lever 310.

Figure 23:
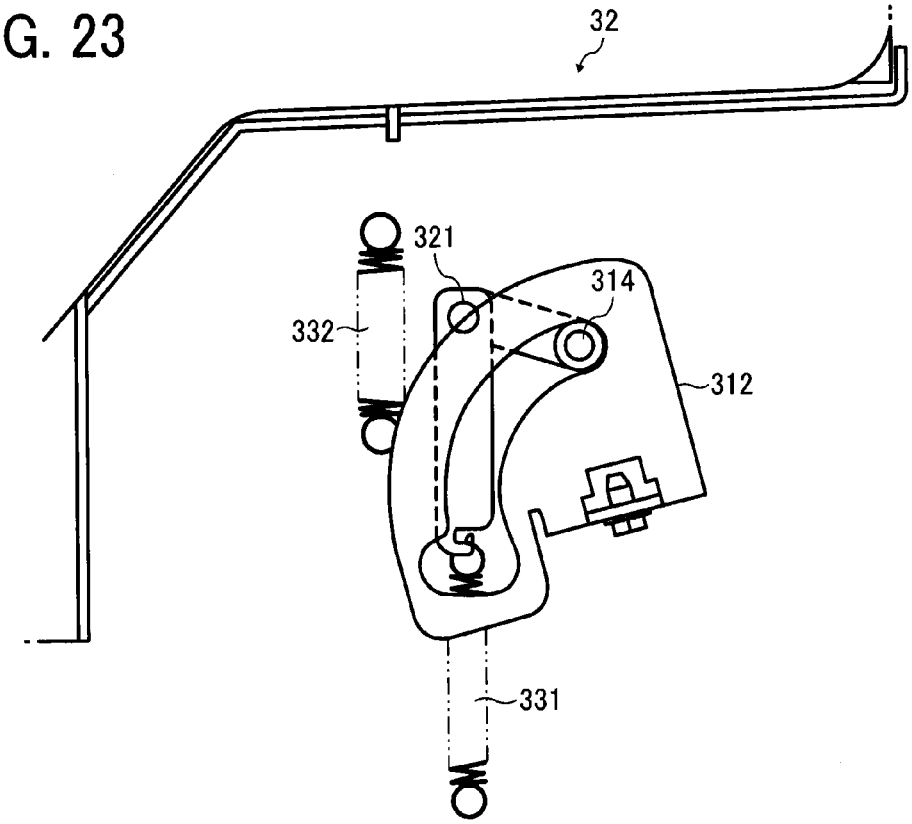
FIG. 23 is a schematic diagram illustrating the fixing device removed from an apparatus body of the image forming apparatus.

The fan-shaped frame 312 has a slit 315 formed thereon. The slit 315 is engaged with an engagement projection 314 provided to the front side of the protrusion 300. The engagement projection 314 that functions as a first engaging member can move within the slit 315, and therefore the lever 310 can rotate about the shaft 322. When the lever 310 rotates, the position of the engagement projection 314 is not changed and the fan-shaped frame 312 and the slit 315 rotate, as illustrated in FIG. 23.

Figure 15A:
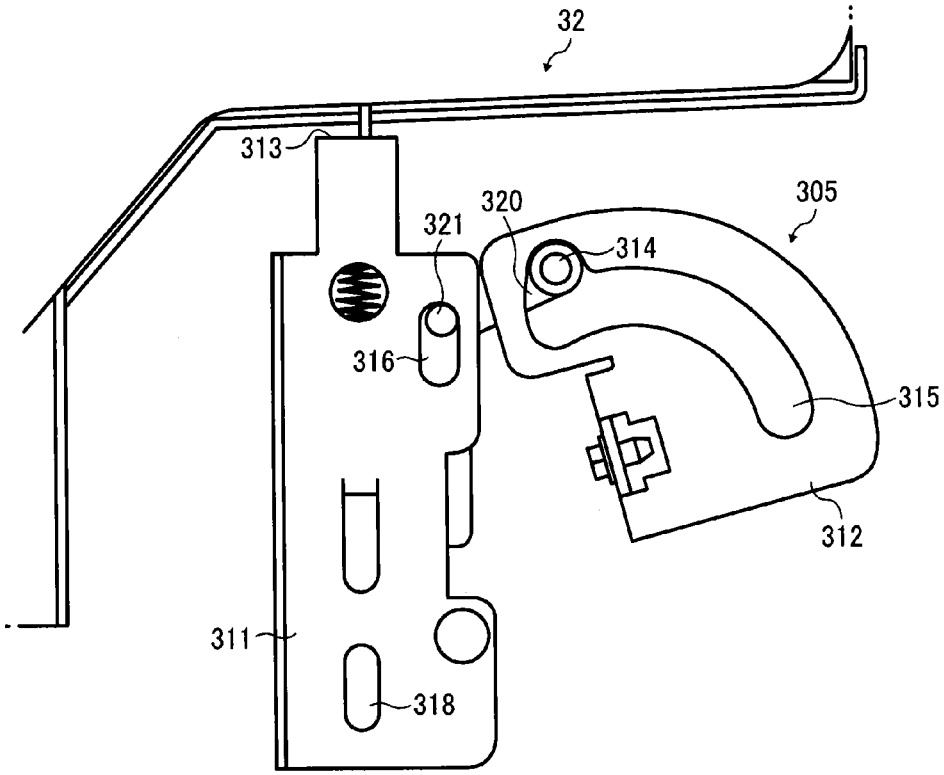
FIG. 15A is a schematic enlarged front view illustrating a link mechanism.
Figure 15B:
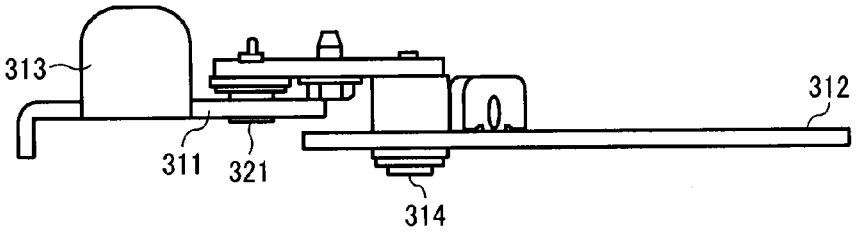
FIG. 15B is a schematic plan view illustrating the link mechanism of FIG. 15A.
Figure 16:
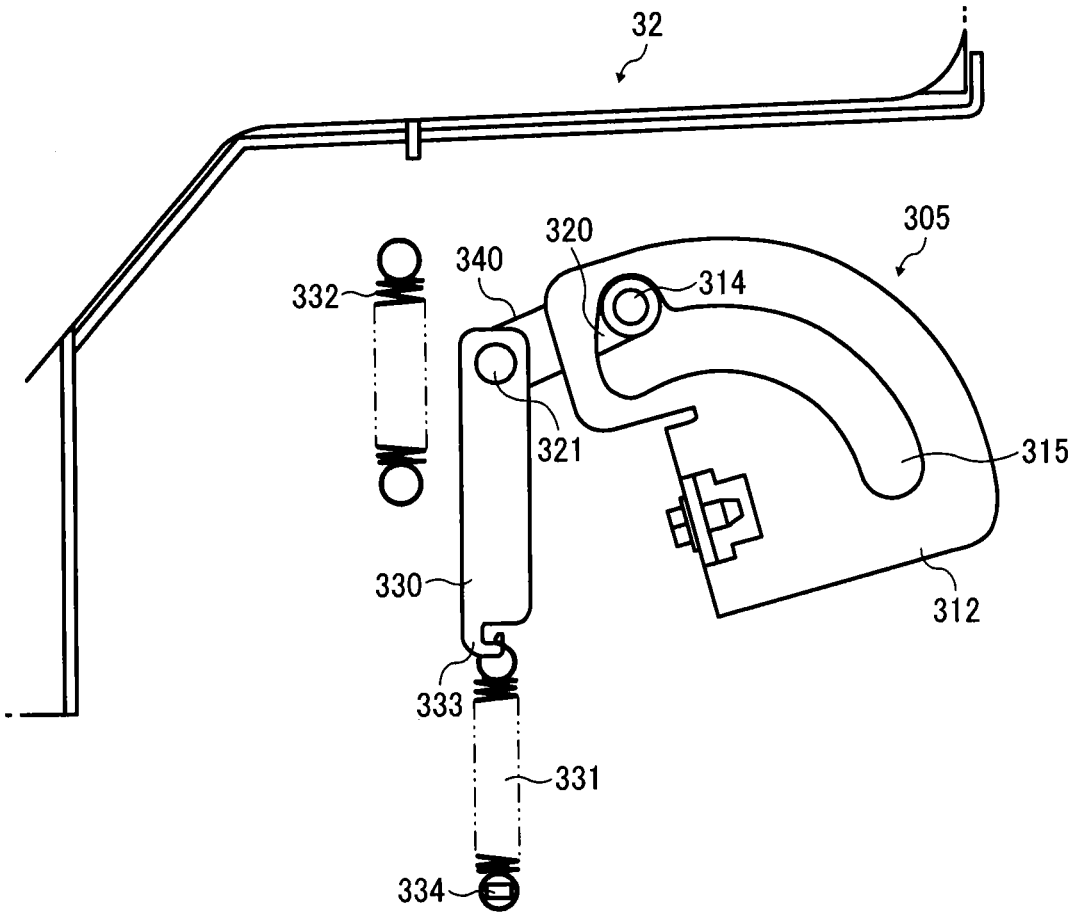
FIG. 16 is a schematic diagram illustrating the link mechanism of FIG. 15A without an elevation plate.

As illustrated in FIGS. 15A, 15B, and 16, a long slit 320 is formed at the left end of the slit 315 in an upward direction or a direction different from a rotation direction of the fan-shaped frame 312.

Figure 20A:
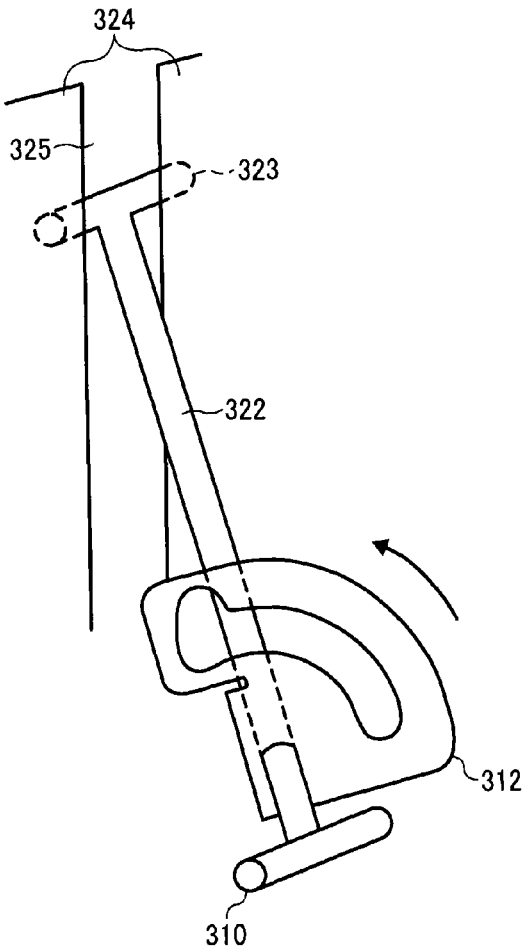
FIGS. 20A and 20B are schematic diagrams illustrating a mechanism restricting removal of the fixing device.
Figure 20B:
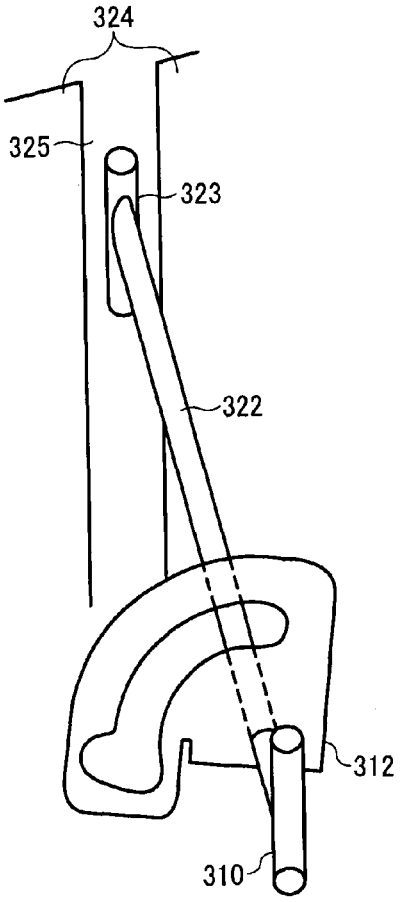

In FIGS. 14, 15A, and 15B, the engagement projection 314 is engaged with the long slit 320. In this case, respective rotations of the lever 310 and the fan-shaped frame 312 are restricted. As a result, the detachment of the fixing device 8 is also restricted. Specifically, as illustrated in FIGS. 20A and 20B, a stopper 323 is disposed at the leading end of the shaft 322 of the lever 310. The stopper 323 extends in a direction perpendicular to the shaft 322, and therefore the shaft 322 of the lever 310 has a T-shaped leading end. The stopper 323 is inserted into a slit 325 formed between rear side members 324 of the apparatus body 200 at a rotational position of the lever 310 and the fan-shaped frame 312 as illustrated in FIGS. 14, 15A, 15B, and 16. Consequently, the stopper 323 is obstructed by the rear side members 324, and therefore detachment of the fixing device 8 with the protrusion 300 integrally provided thereto is limited, as illustrated in FIG. 20A.

By contrast, as illustrated in FIG. 20B, when the lever 310 and the fan-shaped frame 312 are rotated to the left, the stopper 323 passes through the slit 325 and pulled out between the rear side members 324. Therefore, the fixing device 8 can be pulled out reliably.

Next, a description is given of a link mechanism 305 with reference to FIGS. 15A through 18.

The link mechanism 305 functions as a state changer to restrict or allow rotation of the lever 310.

FIG. 15A is a schematic enlarged front view illustrating the link mechanism 305. FIG. 15B is a schematic plan view illustrating the link mechanism 305 of FIG. 15A. FIG. 16 is a schematic diagram illustrating the link mechanism 305 of FIG. 15A without an elevation plate 311. FIG. 17 is a schematic diagram illustrating the link mechanism 305 of FIG. 16 without the fan-shaped frame 312. FIG. 18 is a schematic perspective view illustrating the rear side of the link mechanism 305 of FIG. 15A.

The link mechanism 305 that functions as a state changer includes the elevation plate 311, the fan-shaped frame 312, a rotation arm 340, the engagement projection 314, an engagement projection 321, a frame 330, and springs 331 and 332.

The lever 310 that functions as a first attaching part is attached to the fixing device 8 and provided in the image forming apparatus 500. The lever 310 fixes movement of the fixing device 8.

The fan-shaped frame 312 that functions as a movable frame is fixed to the shaft 322 of the lever 310 used for detachment of the fixing device 8.

Figure 17A:
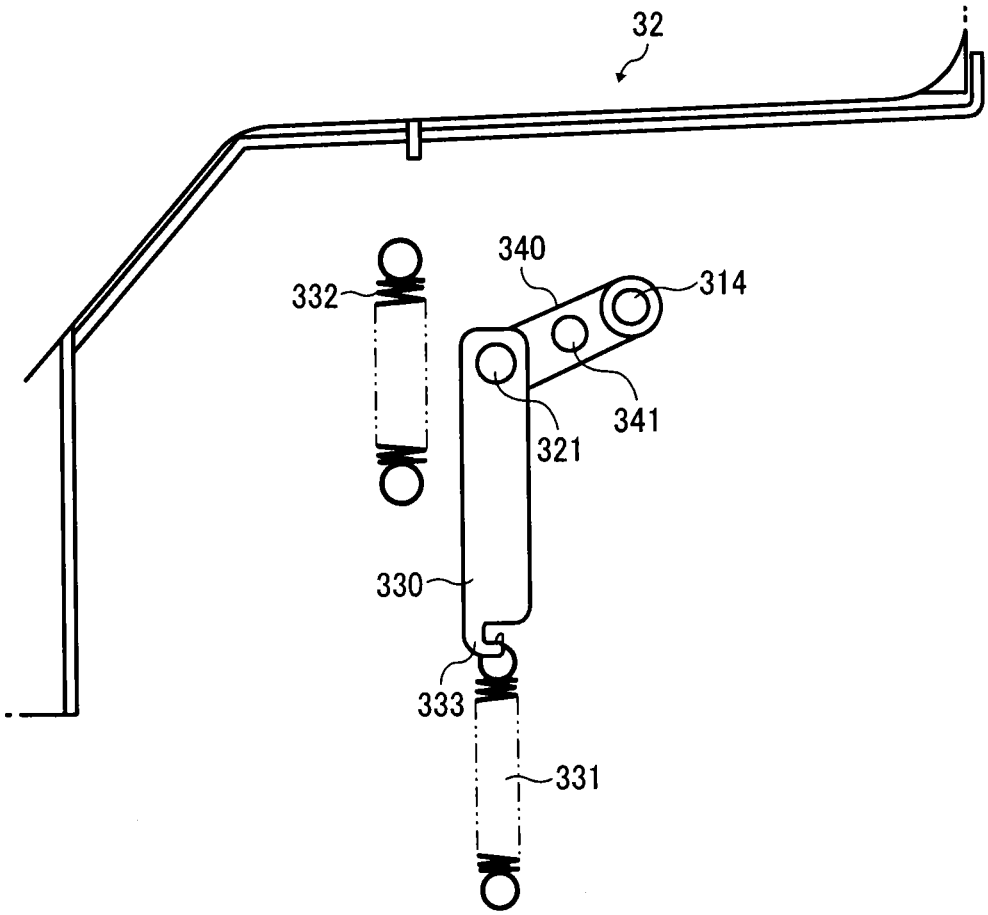
FIGS. 17A and 17B are schematic diagrams illustrating the link mechanism of FIG. 16 without a fan-shaped frame.
Figure 17B:
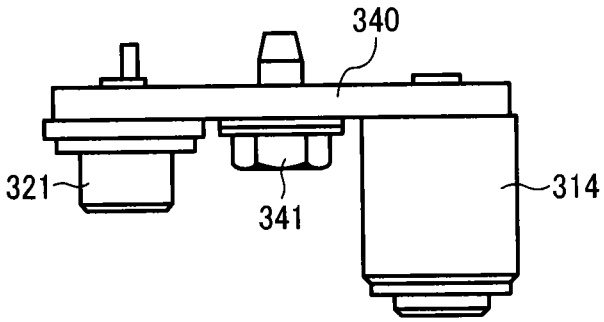
Figure 18:
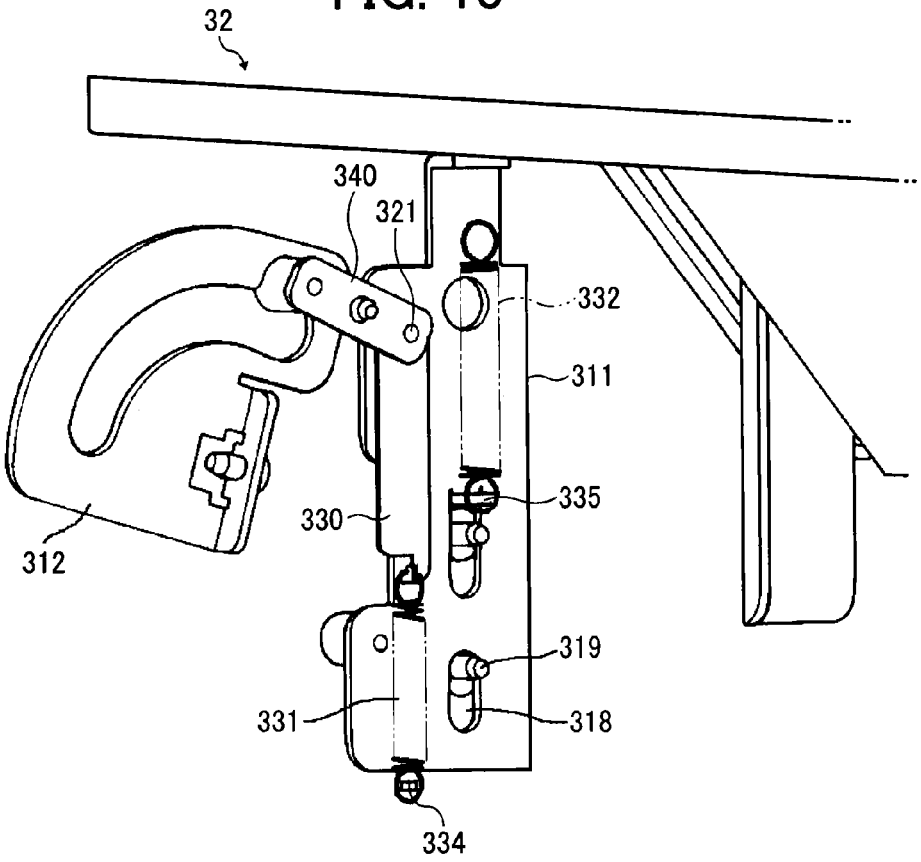
FIG. 18 is a schematic perspective view illustrating the rear side of the link mechanism of FIG. 15A.

As illustrated in FIGS. 17A and 17B, the engagement projection 314 is attached to the right end of the rotation arm 340. The rotation arm 340 has a rotational shaft 341 to rotate thereabout. The rotational shaft 341 that functions as a rotational shaft is fixed to the protrusion 300 as illustrated in FIG. 13C.

The engagement projection 321 that functions as a second engaging member is provided to the left end of the rotation arm 340. The engagement projection 321 is rotatably fitted to the frame 330 that is an elongated flat plate extending in a vertical direction. Further, as illustrated in FIG. 15A, the engagement projection 321 is engaged with a slot 316 that is formed on the elevation plate 311.

As illustrated in FIG. 16, a hook 333 is formed at the lower end of the frame 330 to fix the upper end of the spring 331. The lower end of the spring 331 is fitted to a hook 334 that is provided to the protrusion 300 as illustrated in FIG. 14. Accordingly, the frame 330 is biased to a downward direction by a tension force exerted by the spring 331, so that the long slit 320 and the engagement projection 314 are engaged.

As illustrated in FIGS. 13, 15A, and 15B, the elevation plate 311 is a flat plate and has a bent portion 313 at the upper end of the elevation plate 311. The bent portion 313 is bent toward the rear side of the image forming apparatus 500. Further, second slots 318 are formed on a lower part of the elevation plate 311. Engagement projections 319 illustrated in FIG. 14 are fixed to the protrusion 300. The engagement projections 319 are inserted into the respective second slots 318.

The engagement projection 321 that is vertically rotatable is guided in the slot 316 and the second slots 318 move with respect to the fixedly provided engagement projections 319. With this configuration, the elevation plate 311 can move vertically.

In FIG. 13, a stopper 350 attached to the first conveyance assembly 31 is not in contact with the bent portion 313. Therefore, the link mechanism 305 is at a movement allowed position at which the link mechanism 305 can move. At this time, the elevation plate 311 is at a top dead center.

By contrast, in FIGS. 14, 15A, 15B, and 18, the stopper 350 is in contact with the bent portion 313. Therefore, the link mechanism 305 is at a movement restricted position at which the link mechanism 305 cannot move. At this time, the elevation plate 311 is at a bottom dead center.

As illustrated in FIG. 18, a hook 335 is formed at the rear face of the elevation plate 311. The lower end of the spring 332 is hooked to the hook 335. The upper end of the spring 332 is fitted to a different hook that is provided to the protrusion 300. Accordingly, the elevation plate 311 is biased to an upward direction by a tension force exerted by the spring 332.

Figure 19A:
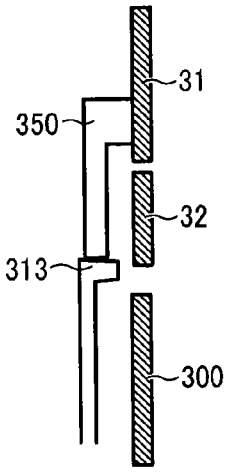
FIG. 19A is a schematic diagram illustrating a bent portion in a locked state, where the belt portion is linked with opening and closing actions of a first conveying assembly.

At this time, however, the elevation plate 311 is at the bottom dead center. Since the bent portion 313 is biased to the downward direction by the stopper 350 that is provided to the first conveyance assembly 31 with a force greater than the tension force exerted by the spring 332, as illustrated in FIGS. 14 and 19A, the elevation plate 311 is at the bottom dead center. The stopper 350 is fixed to the front side of the first conveyance assembly 31 at the right side of the lock mechanism 65 and extends downwardly. When the first conveyance assembly 31 (the upper unit 60) is closed, the stopper 350 causes the link mechanism 305 to remain at the movement restricted position, and therefore the bent portion 313 is locked. In this state, the rotation of the fan-shaped frame 312 is restricted. As a result, the fixing device 8 is locked, and therefore the detachment of the fixing device 8 is restricted. Due to the gravity of the first conveyance assembly 31, the stopper 350 presses the bent portion 313 in the downward direction. Accordingly, no specific action is taken to move the link mechanism 305 to the movement restricted position.

Figure 19B:
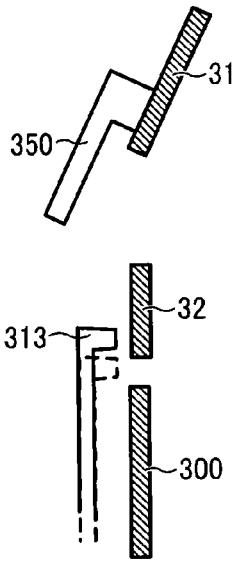
FIG. 19B is a schematic diagram illustrating the bent portion in an unlocked state.
Figure 21:
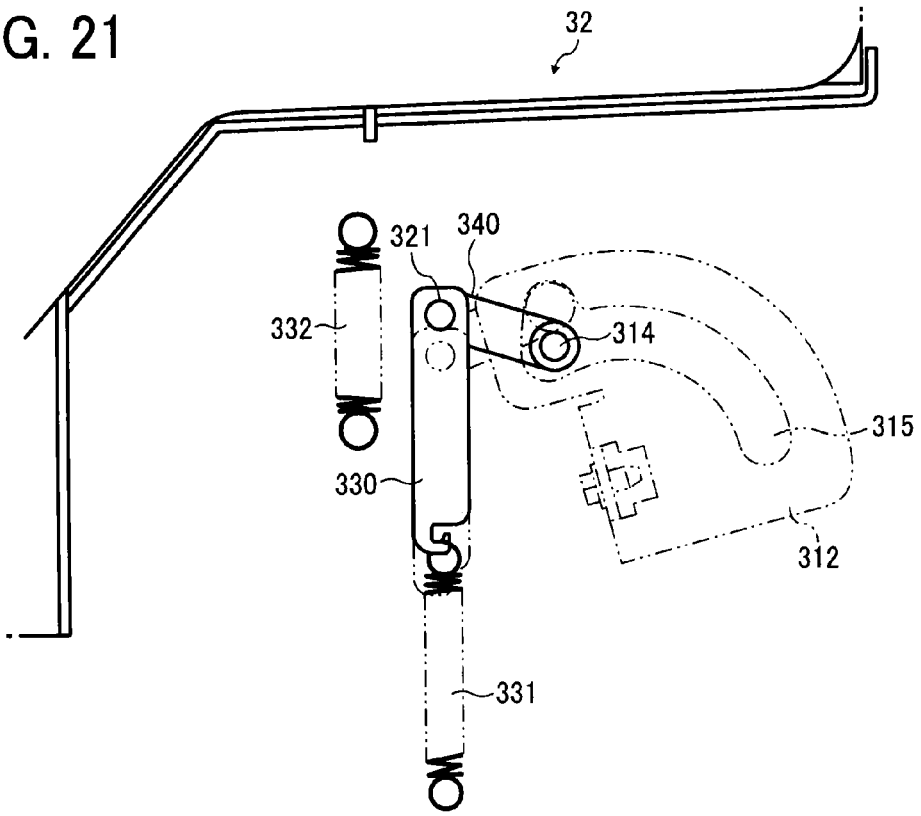
FIG. 21 is a schematic diagram illustrating a state in which an engaging projection is lowered.
Figure 22:
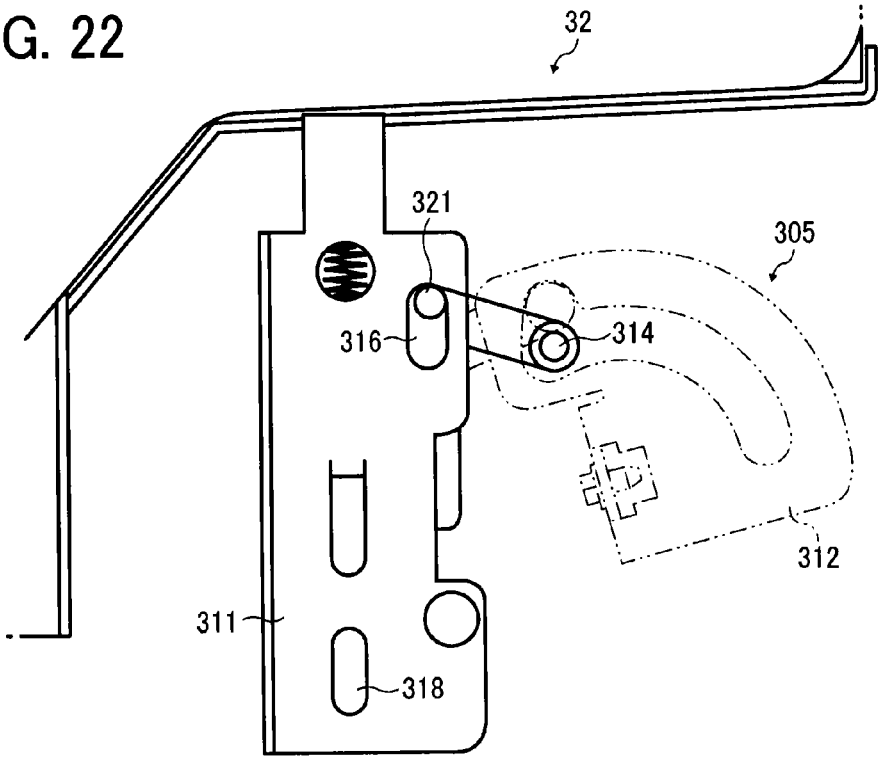
FIG. 22 is a schematic diagram illustrating a state in which an elevation plate is raised and the engaging projection is raised.

By contrast, when the lock mechanism 65 of the first conveyance assembly 31 is released and the first conveyance assembly 31 (the upper unit 60) is moved upwardly to separate from the lower unit 80, the elevation plate 311 is raised due to the tension force exerted by the spring 332, as illustrated in FIG. 19B. At this time, as illustrated in FIGS. 21 and 22, the engagement projection 321 of the rotation arm 340 contacts the bottom edge of the slot 316 of the elevation plate 311, and then the elevation plate 311 is raised. As a result, the engagement projection 321 is moved upwardly. Along with the elevation of the engagement projection 321, the rotation arm 340 rotates clockwise about the rotational shaft 341 and the engagement projection 314 is lowered to the slit 315 of the fan-shaped frame 312.

In this state, the link mechanism 305 is changed from a movement restricted state to a movement allowed state in conjunction with separation of the first conveyance assembly 31 of the sheet conveying device 9. Consequently, the fan-shaped frame 312 can rotate counterclockwise. Accordingly, as illustrated in FIGS. 20B and 23, when the lever 310 and the fan-shaped frame 312 are rotated counterclockwise, the fixing device 8 is released from the locked state, and therefore can be detached from the apparatus body 200.

Figure 24:
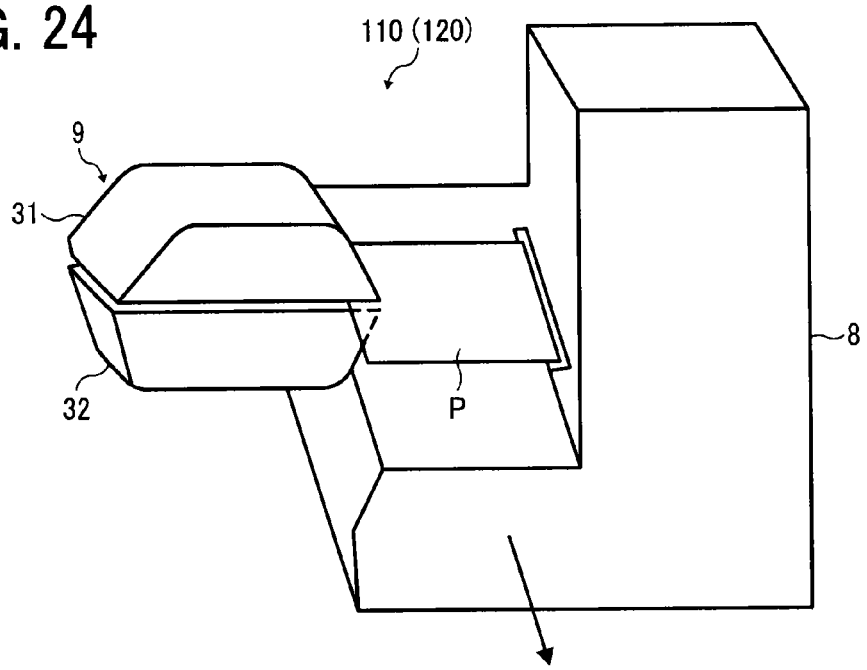
FIG. 24 is a schematic diagram illustrating the fixing device removed from an apparatus body of the image forming apparatus.

At this time, even when the sheet P exists across the fixing device 8 and the sheet conveying device 9 as illustrated in FIG. 24, the sheet holding state of the sheet P in the sheet conveying device 9 is released, the jammed sheet tearing of the sheet P can be prevented.

A known configuration does not allow the first conveyor to move while the jammed sheet remains in the second conveyor. However, such a known configuration cannot provide good operability.

Next, a description is given of the lock mechanism 65 of the sheet conveying device 9 according to another example of this disclosure.

In the configuration according to the example illustrated in FIGS. 19A and 19B, when the first conveyance assembly 31 is closed, the stopper 350 presses the bent portion 313 downwardly, so that the link mechanism 305 remains at the movement restricted position as illustrated in FIGS. 15A and 15B.

Figure 25:
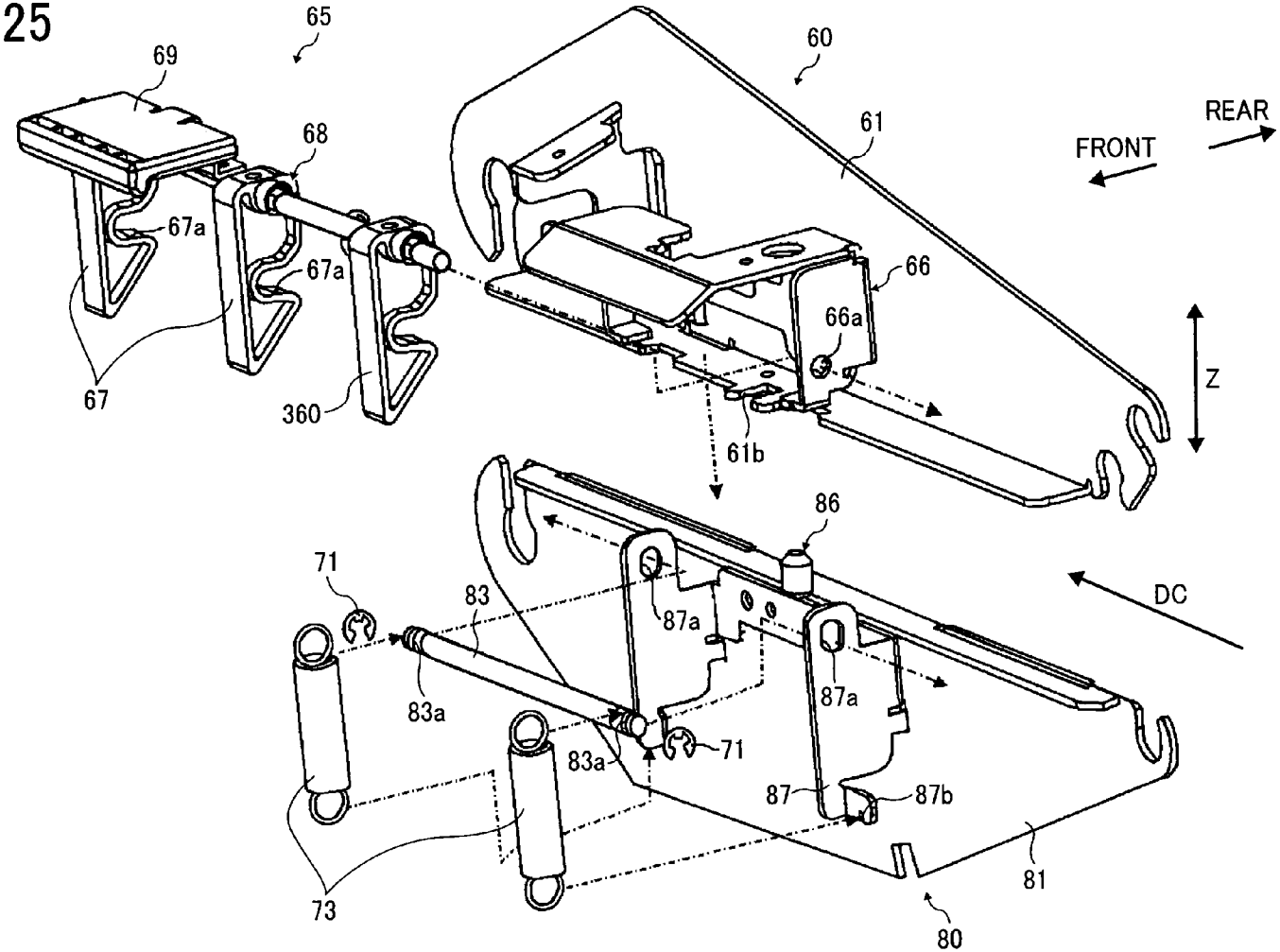
FIG. 25 is a schematic diagram illustrating a lock mechanism of the sheet conveying device according to another example of this disclosure.

By contrast, in the configuration according to this example, as illustrated in FIG. 25, the lever shaft 68 of the lock mechanism 65 illustrated in FIG. 7 is extended toward the elevation plate 311. By so doing, a rotary member 360 (FIG. 25) is fixed at a position corresponding to an upper part of the elevation plate 311. In this case, the first conveyance assembly 31 is closed to rotate the lock lever 67 to engage with the front shaft 83. Then, the rotary member 360 rotates together with the rotation of the lock lever 67. As a result, the rotary member 360 can be locked to the bent portion 313. Accordingly, respective rotations of the lever 310 and the fan-shaped frame 312 are restricted. As a result, the detachment of the fixing device 8 is also restricted.

By contrast, by rotating the lock lever 67 to separate the upper unit 60 from the lower unit 80, the engagement of the rotary member 360 and the bent portion 313 are released. By so doing, the link mechanism 305 remains at the movement allowed position. Therefore, the lever 310 can be rotated and the fixing device 8 can be detached. Specifically, the link mechanism 305 causes the lever 310 to change from the movement restricted state to the movement allowed state in conjunction with a state change of the lock mechanism 65 from a locked state to an unlocked state.

The rotary member 360 can use any common parts to the lock lever 67. Employing the common parts between the rotary member 360 and the lock lever 67 can achieve a reduction in cost when compared to creating any new parts.

Next, a description is given of respective configurations of the lock mechanism 65 and the link mechanism 305 according to another example of this disclosure.

In the configuration according to the example illustrated in FIGS. 19A and 19B, the stopper 350 or the rotary member 360 provided to the first conveyance assembly 31 presses the bent portion 313 of the elevation plate 311 downwardly. Therefore, the link mechanism 305 includes the elevation plate 311, the fan-shaped frame 312, the rotation arm 340, the engagement projections 314 and 321, the frame 330, the springs 331 and 332, and the swing member 370. The swing member 370 swings so as to contact or separate from the elevation plate 311.

The lock mechanism 65 functions as a second attaching part that fixes a position facing the first conveyance assembly 31 provided to the upper unit 60 with respect to the second conveyance assembly 32 provided to the lower unit 80. The lock mechanism 65 includes the lever shaft 68, the handle 69, a locking member 375, and a frame 400.

It is to be noted that the structure of the elevation plate 311 according to this example is identical to the structure of the elevation plate 311 according to the above-described examples. Therefore, the same reference numerals are used and a detailed description according to these examples is omitted.

Figure 26:
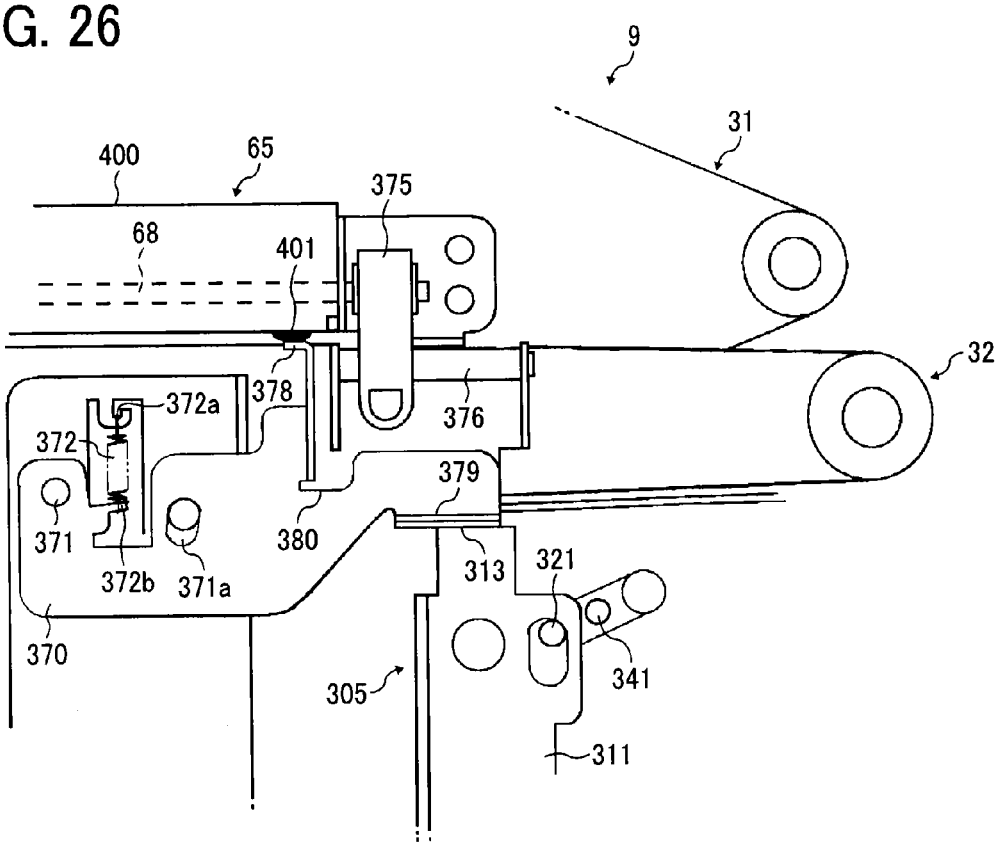
FIG. 26 is a schematic diagram illustrating a lock mechanism and a link mechanism of the sheet conveying device according to another example of this disclosure.

In the state as illustrated in FIG. 26, the first conveyance assembly 31 of the sheet conveying device 9 is closed, the link mechanism 305 is at the movement restriction position and the elevation plate 311 is at a locked position. Here, the swing member 370 that is provided to the second conveyance assembly 32 has a pressing portion 379. The pressing portion 379 of the swing member 370 is in contact with the bent portion 313 of the elevation plate 311 at an upward position from the elevation plate 311. The pressing portion 379 is formed by bending the swing member 370 from the far side toward the near side of the drawing sheet of FIG. 26. The bending direction of the pressing portion 379 is opposite to the bending direction of the bent portion 313. That is, the bent portion 313 is formed by bending from the near side toward the far side of the drawing sheet of FIG. 26.

As illustrated in FIG. 26, the swing member 370 is biased upwardly by a spring 372 and is rotatable about a shaft 371 that is provided to one end side of the second conveyance assembly 32. An upper end of the spring 372 is hooked to a hook 372*a* of the second conveyance assembly 32 and a lower end of the spring 372 is hooked to a hook 372*b* of the swing member 370. Further, the swing member 370 is rotatable about the shaft 371 by a swing guide 371*a* that includes a projection of the second conveyance assembly 32 and a guide opening of the swing member 370.

As illustrated in FIG. 26, the frame 400 has a pressing portion 401 that is attached to the lower part of the frame 400 and the swing member 370 has a contact 378 that contacts the pressing portion 401 to be pressed thereby. The contact 378 is formed by bending a flat right side of the swing member 370 to project toward the near side of FIG. 26 and further bending the leading end of the bent right side of the swing member 370 from the right side toward the left side in the drawing sheet of FIG. 26.

Figure 27:
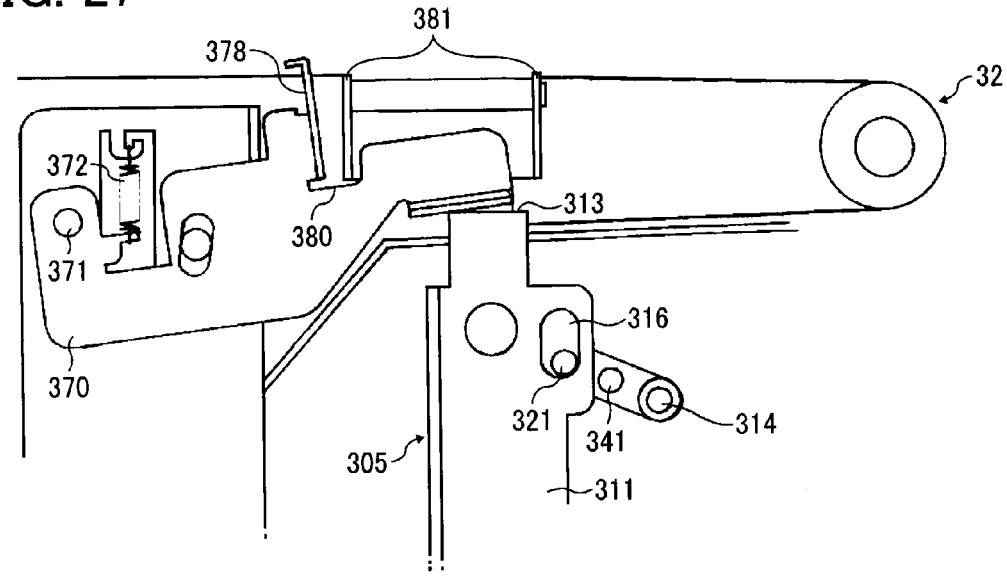
FIG. 27 is a schematic diagram illustrating the sheet conveying device of FIG. 26 with a first conveying mechanism open.

In the state illustrated in FIG. 27, the first conveyance assembly 31 of the sheet conveying device 9 is open, i.e., in the separating state. In this state, the link mechanism 305 is at the movement allowed state and the elevation plate 311 and the swing member 370 are at the top dead center. A restriction part 380 that is an upper side of the swing member 370 is arranged at a lower right part from the contact 378. As illustrated in FIG. 27, when the locked state of the lock mechanism 65 is released and as the swing member 370 rotates counterclockwise about the shaft 371, the restriction part 380 abuts against a lower end of an abutment part 381, thereby restricting further movement of the swing member 370. The abutment part 381 also functions as a frame to support a lock shaft 376 that is provided to the second conveyance assembly 32.

Figure 28:
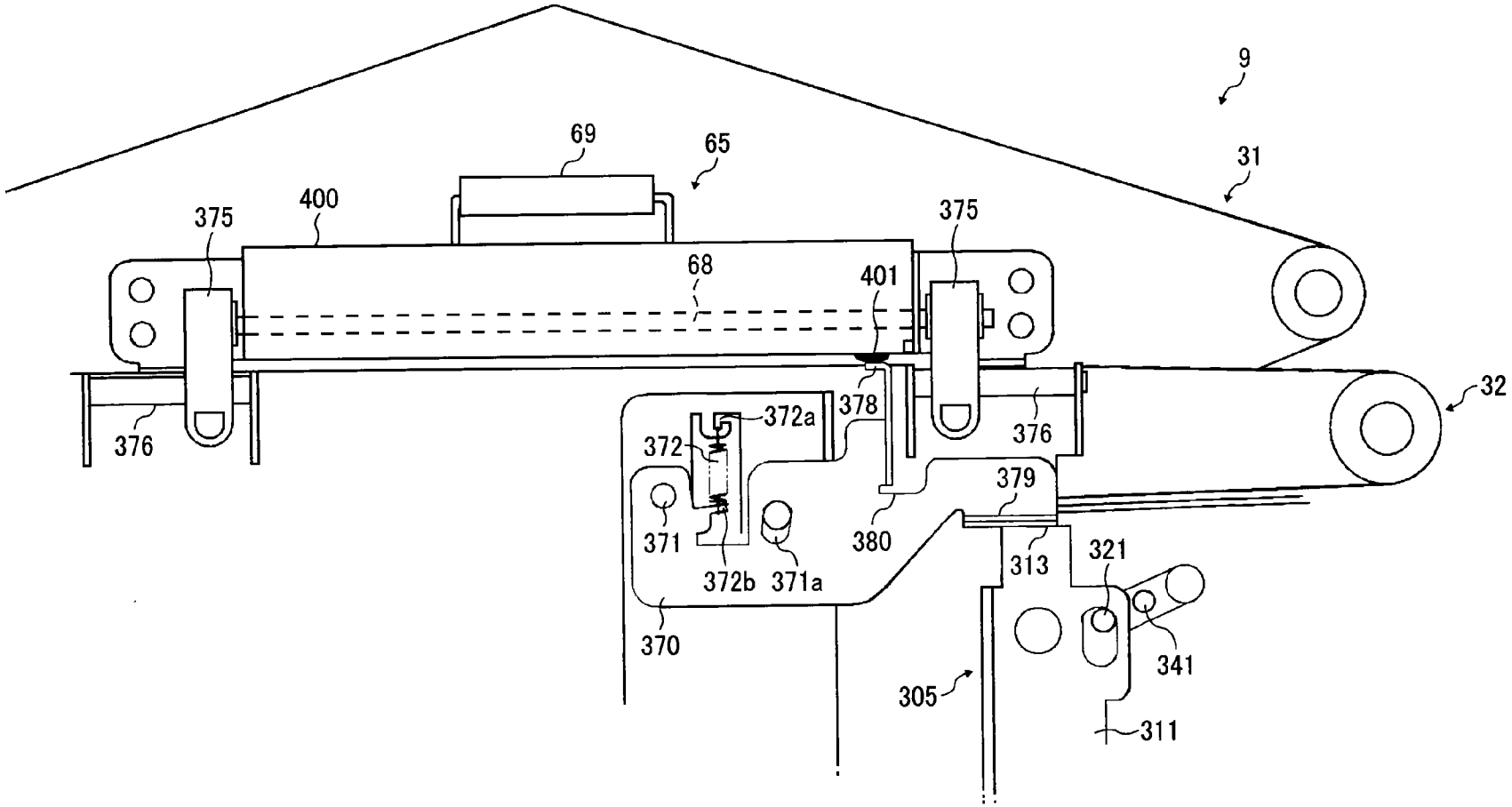
FIG. 28 is a schematic diagram illustrating the lock mechanism of FIG. 26.

As illustrated in FIG. 28, the lock mechanism 65 according to this example is different from the lock mechanism 65 according to the example illustrated in FIGS. 7 and 8, in which the locking members 375 are located horizontally separate from each other at right and left positions and in which the frame 400 is disposed between the locking members 375.

The frame is bent toward the far side to form the front, right, left, and bottom faces thereof. The frame 400 is projected closer to the near side of the image forming apparatus 500 than the swing member is. The height of the frame 400 is substantially equal to that of each locking member 375 and that of the lock shaft 376. Openings through which the lever shaft 68 that fixes the locking members 375 passes are formed on both left and right sides of the frame 400. Further, the pressing portion 401 is arranged in the vicinity of one of the locking members 375 and on the bottom face at the far side of the frame 400, as illustrated in FIG. 26. The pressing portion 401 is a hemispherical resin member to firmly engage with the metallic contact 378.

Next, a description is given of steps of pulling out the fixing device 8 from the apparatus body 200 of the image forming apparatus 500.

In the state illustrated in FIG. 26, the first conveyance assembly 31 is closed and rotation of the lever 310 of the fixing device 8 is restricted by the frame 400 and the swing member 370. As the handle 69 is raised, the locking members 375 rotate to separate from the lock shaft 376.

Then, as the first conveyance assembly 31 is moved in the upward direction, the pressing portion 401 is raised together with the first conveyance assembly 31. Accordingly, the swing member 370 rotates counterclockwise due to the biasing force exerted by the spring 372. Along with the rotation of the swing member 370, the elevation plate 311 moves upwardly due to the biasing force exerted by the spring 332. Elevation of the elevation plate 311 causes the engagement projection 321 of the rotation arm 340 that is engaged with the top edge of the slot 316 to engage with the bottom edge of the slot 316. Since the elevation plate 311 further moves upwardly, the engagement projection 321 is raised. Along with the elevation of the engagement projection 321, the engagement projection 314 moves downwardly to change to the state as illustrated in FIG. 27. This state is a rotation allowed state of the lever 310 of the fixing device 8.

By providing the swing member 370 as described in this example, the same effect as the configuration according to the above-described example can be achieved without providing the stopper 350 illustrated in FIGS. 14, 15A, 15B, and 18. Accordingly, in the configuration with the stopper 350, a jammed sheet P may contact the stopper 350 when the jammed sheet P is removed by raising the first conveyance assembly 31. However, with the configuration according to this example, the pressing portion 401 and the swing member 370 provided to the second conveyance assembly 32 do not hinder removal of the sheet P.

Next, a description is given of another configuration of the lock mechanism 65 and yet another configuration of the link mechanism 305.

Figure 29:
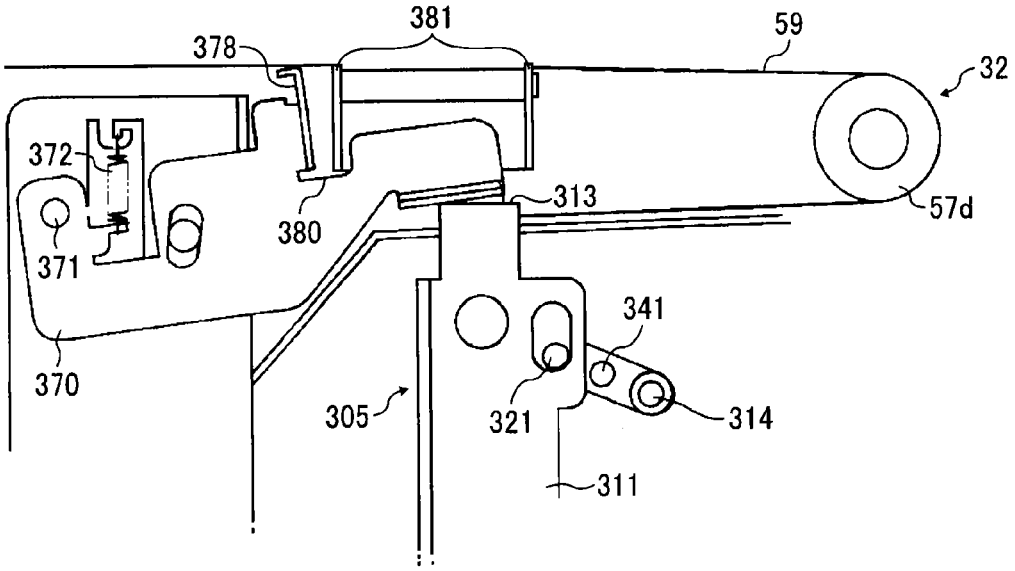
FIG. 29 is a schematic diagram illustrating a lock mechanism and a link mechanism of the sheet conveying device according to yet another example of this disclosure.

FIG. 29 is a schematic diagram illustrating the lock mechanism 65 and the link mechanism 305 of the sheet conveying device 9 according to yet another example of this disclosure.

As illustrated in FIG. 29, compared with the example illustrated in FIGS. 26 through 28, the contact 378 is shorter in the vertical direction and the pressing portion 401 is longer. Specifically, as illustrated in FIG. 29, the first conveyance assembly 31 is moved upwardly and, when the swing member 370 comes to the top dead center, the top edge of the contact 378 reaches a position substantially equal to or lower than the upper face of the belt 59 of the second conveyance assembly 32.

Even though the contact 378 of this example is shorter than that of the example illustrated in FIGS. 26 through 28, the pressing portion 401 of this example can extend downwardly like the stopper 350 illustrated in FIGS. 19A and 19B. However, the bottom position of the pressing portion 401 is at a position substantially same as or higher than the bottom edge of the locking member 375 illustrated in FIG. 26. With this configuration, when the first conveyance assembly 31 is raised to remove the jammed sheet P from the image forming apparatus 500, the pressing portion 401 does not hinder removal of the sheet P. Further, the rotated contact 378 does not project beyond the upper surface of the belt 59 of the second conveyance assembly 32, and therefore the contact 378 does not hinder removal of the jammed sheet P when the first conveyance assembly 31 is raised to remove the jammed sheet P from the image forming apparatus 500.

Next, a description is given of the fan-shaped frame 312 according to another example of this disclosure.

In the example illustrated in FIGS. 13C through 23, the respective heights and positions of the engagement projections 314 are equal in FIGS. 21 and 23 when the fan-shaped frame 312 moves from the state illustrated in FIG. 21 to the state illustrated in FIG. 23. Further, the slit 315 is formed to be coaxial with the rotation center of the fan-shaped frame 312 in FIGS. 21 and 23. Therefore, when the fan-shaped frame 312 moves from the state illustrated in FIG. 21 to the state illustrated in FIG. 23, the vertical and horizontal positions of the engagement projections 314 do not change. Accordingly, the movement of the fan-shaped frame 312 from the state illustrated in FIG. 21 to the state illustrated in FIG. 23 does not change the height and position of the elevation plate 311, either.

By contrast, this example is different from the example illustrated in FIGS. 13C through 23 in which the configuration of this example has the slit 315 so that, as the fan-shaped frame 312 rotates counterclockwise about a rotation center 312*a*, the engagement projections 314 are gradually raised to be located at respective positions higher than the engagement projections 314 illustrated with a dashed line in FIG. 21.

Figure 30:
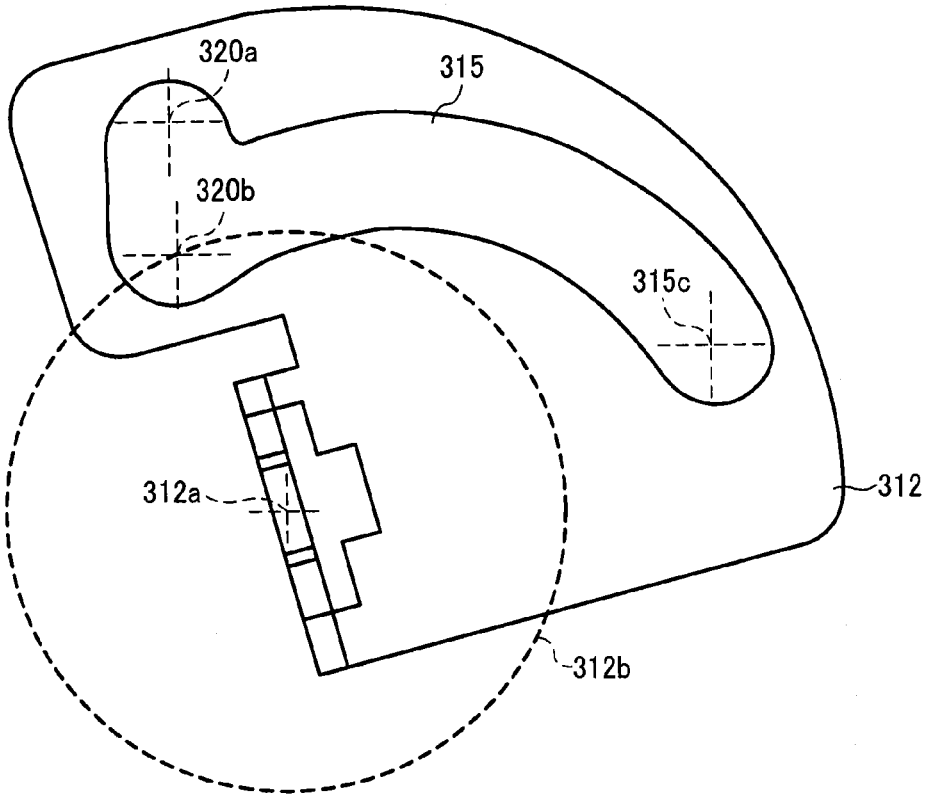
FIG. 30 is a schematic diagram illustrating a fan-shaped frame.

As illustrated in FIG. 30, the slit 315 is not formed along a virtual circle 312*b* having the rotation center 312*a* of the fan-shaped frame 312 but is formed to be outside of the virtual circle 312*b*. The virtual circle 312*b* is a virtual circle that passes the center of the engagement projection 314 in the state illustrated in FIG. 21. Accordingly, the slit 315 in the example illustrated in FIGS. 13C through 23 is formed along the virtual circle 312*b*.

In this example, as illustrated in FIG. 30, a center 320*a* of the engagement projection 314 illustrated with a two-dot chain line in FIG. 21 (in a rotation restricted state of the lever 310) and a center 320*b* of the engagement projection 314 illustrated with a solid line in FIG. 21 (in the rotation allowed state of the lever 310) are the same as those in the example illustrated in FIGS. 13C through 23. However, the slit 315 from the center 320*b* to a center 315*c* of the engagement projection 314 that corresponds to the position of the fixing device 8 in a detachable state is formed to be outside of the virtual circle 312*b*. In addition, the center 315*c* of the engagement projection 314 in the detachable state of the fixing device 8 that corresponds to the state illustrated in FIG. 23 is arranged to be higher than the center 320*a* of the engagement projection 314 in the rotation restricted state (FIG. 30) of the lever 310. That is, when the engagement projection 314 is placed on the center 320*a* in FIG. 30, the elevation plate 311 is in a locked position as illustrated in FIG. 26. Similarly, when the engagement projection 314 is placed on the center 320*b* in FIG. 30, the elevation plate 311 is at the top dead center. Further, when the engagement projection 314 is placed on the center 315*c*, the elevation plate 311 reaches the lowest position that is lower than the locked position due to the action of the engagement projection 321 that is lowered than the locked position. Accordingly, the engagement projection in the rotation allowed state moves to a lower position than that in the rotation restricted state, and therefore the elevation plate 311 moves to the lowest position as described above.

Figure 31A:
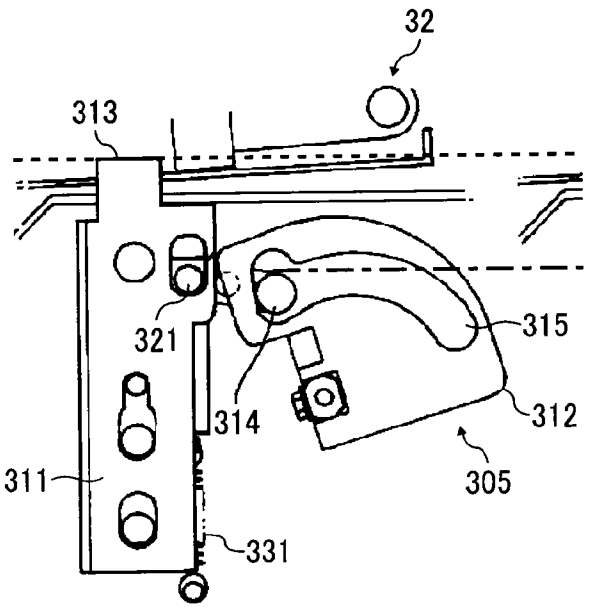
FIGS. 31A through 31C are schematic diagrams illustrating displacements of the elevation plate and an engagement projection from a rotation restricted state of a lever to a rotation allowed state of the fixing device.
Figure 31B:
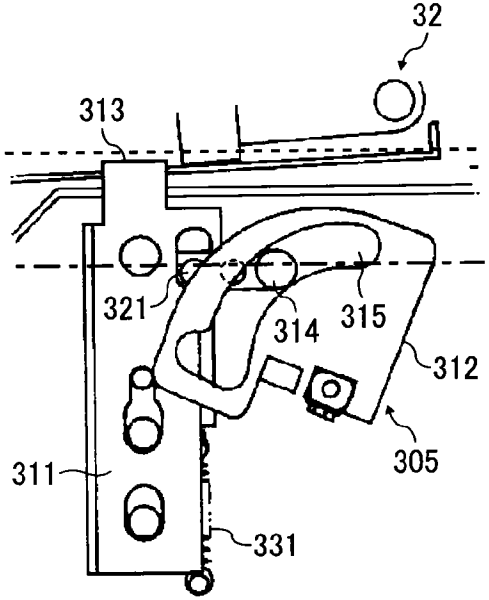
Figure 31C:
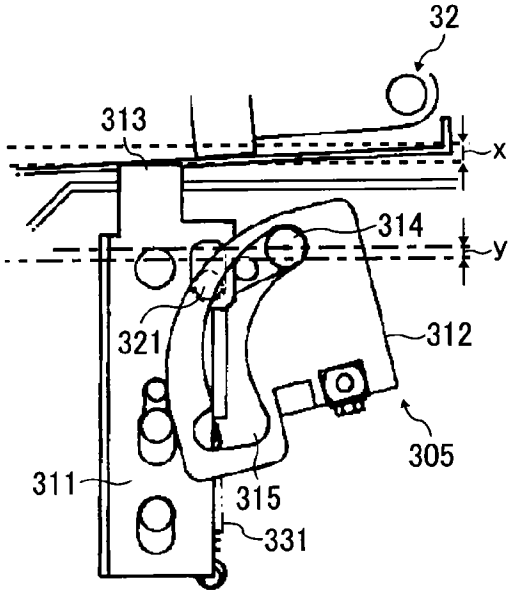

Next, a description is given of changes of the elevation plate 311 and the engagement projection 314 from the rotation restricted state of the lever 310 to the detachable state of the fixing device 8 with reference to FIGS. 31A, 31B, and 31C.

It is to be noted that, in order to explain movement of the fan-shaped frame 312 clearly, the shaft 322 of the lever 310 is illustrated without showing the lever 310.

First, a user moves the handle 69 upwardly. The locking members 375 rotate to detach from the lock shaft 376. By so doing, the first conveyance assembly 31 elevates. According to the movement of the first conveyance assembly 31, the pressing portion 401 separates from the contact 378 to move the elevation plate 311 form the locked position illustrated in FIG. 26 to the top dead center, as illustrated in FIG. 31A. As a result, the engagement projection 321 is raised to engage with the bottom edge of the slot 316 and the engagement projection 314 is lowered.

Then, as the lever 310 is rotated counterclockwise (in the left direction in FIG. 31A), the engagement projection 314 is guided in the slit 315 while contacting the fan-shaped frame 312 having the slit 315 to move upward as illustrated in FIG. 31B. At this time, the rotation arm 340 also rotates, and therefore the engagement projection 321 moves downward. Along with the movement of the engagement projection 321 to the downward direction, the elevation plate 311 moves downward.

Then, as the lever 310 is further rotated until the engagement projection 314 reaches a position equal to the center 320*a*, the elevation plate 311 comes to the same level as the locked position thereof. As the lever 310 is rotated further until the engagement projection 314 reaches a position equal to the center 315*c* as illustrated in FIG. 31C, the elevation plate 311 moves down to the lowest position (i.e., the bottom dead center) as illustrated in FIG. 31C. As illustrated with dashed lines in FIGS. 31A through 31C, the elevation plate 311 moves downward by an amount "x" from the top dead center in FIG. 31A to the lowest position (i.e., the bottom dead center) in FIG. 31C. That is, the locked position of the elevation plate 311 is located between the dashed lines. At this time, as illustrated with dot-dashed lines in FIGS. 31A through 31C, the center of the engagement projection 314 in FIG. 31C is higher by an amount "y" than the center 320*a* of the engagement projection 314 in FIG. 30. In the state of FIG. 31C that corresponds to the state of FIG. 20B, the fixing device 8 can be detached. It is to be noted that the link mechanism 305 is integrally attached to the fixing device 8. Therefore, even if the fixing device 8 has been detached, the elevation plate 311 can maintain the position illustrated in FIG. 31C.

As previously described, the elevation plate 311 in the detachable state of the fixing device 8 is lower than the locked position of the lever 310 in the rotation restricted state in FIG. 26. Accordingly, after the fixing device 8 has been pulled out from the apparatus body 200 of the image forming apparatus 500, firstly the fixing device 8 may be attached to the image forming apparatus 500, secondly the first conveyance assembly 31 may be downward, and lastly the locking member 375 may be locked to the lock shaft 376. Alternatively, after the fixing device 8 has been pulled out from the apparatus body 200 of the image forming apparatus 500, firstly the first conveyance assembly 31 may be moved downward, secondly the locking members 375 may be locked to the lock shaft 376, and lastly the fixing device 8 may be attached (stored) to the image forming apparatus 500.

FIGS. 31A through 31C are schematic diagrams illustrating displacements of the elevation plate 311 and the engagement projection 314 from the rotation restricted state of the lever 310 to the rotation allowed state of the fixing device 8.

The elevation plate 311 is raised in the order of FIGS. 31A, 31B, and 31C in a case in which the fixing device 8 is pulled out from and then is attached to the image forming apparatus 500 again, and the first conveyance assembly 31 is lowered to lock the locking member 375 to the lock shaft 376. Then, as the first conveyance assembly 31 is lowered to lock the locking member 375 to the lock shaft 376, the elevation plate 311 is moved downward, so that the engagement projection 314 is placed on the center 320*a* as illustrated in FIG. 30. Consequently, the lever 310 is changed to the rotation restricted state.

Next, a description is given of a case in which the first conveyance assembly 31 is lowered before attaching the fixing device 8 to the image forming apparatus 500.

FIGS. 31A through 31C illustrate the first conveyance assembly 31 to be elevated. However, the following description is given on the assumption that the first conveyance assembly 31 is locked, with reference to FIGS. 31A through 31C.

It is assumed that FIG. 31C illustrates the state in which the fixing device 8 is attached and stored in the image forming apparatus 500 after the first conveyance assembly 31 is lowered. In this case, the pressing portion 379 is located at a lower position. At this time, the pressing portion 379 and the bent portion 313 are not in contact with each other.

Then, the lever 310 is rotated clockwise (in the right direction in FIG. 31C), the bent portion 313 of the elevation plate 311 contacts the pressing portion 379 in the state illustrated in FIG. 31B. Then, as the lever 310 is further rotated, the engagement projection 314 is moved downward to elevate the engagement projection 321. At this time, a gap or space exists between the engagement projection 321 and the bottom edge of the slot 316. Accordingly, while the engagement projection 321 is being elevated, the height of the elevation plate 311 remains as illustrated in FIG. 31B. Then, as the lever 310 is further rotated until the long slit 320 reaches the engagement projection 314, the engagement projection 314 moved upward due to the downward biasing force exerted by the spring 331. As a result, the engagement projection 314 is placed on the center 320*a* of the long slit 320 and the lever 310 is changed to the rotation restricted state.

The example illustrated in FIGS. 30 through 31C has shown that, after being pulled out from the image forming apparatus 500, the fixing device 8 can be attached and stored to the image forming apparatus 500 regardless of whether the first conveyance assembly 31 is closed or not.

In this example, another description is given of the pressing portion 379 of the swing member 370 and the bent portion 313 of the elevation plate 311 when the example illustrated in FIGS. 30 through 31C is employed.

Figure 32A:
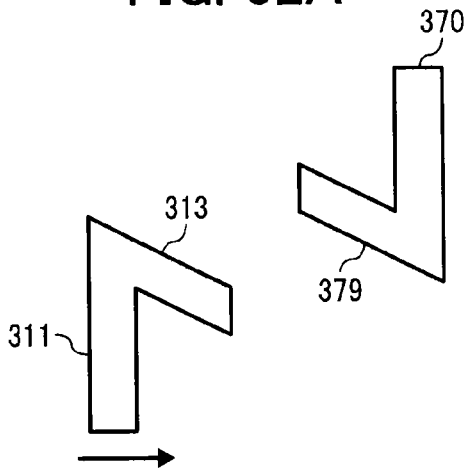
FIGS. 32A through 32C are schematic diagrams illustrating respective leading ends of a pressing portion and the bent portion.
Figure 32B:
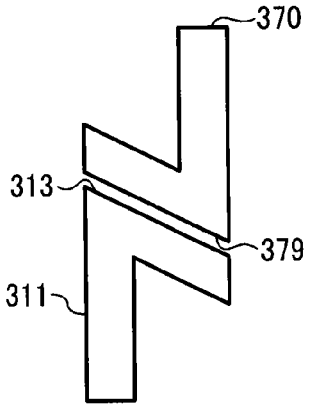
Figure 32C:
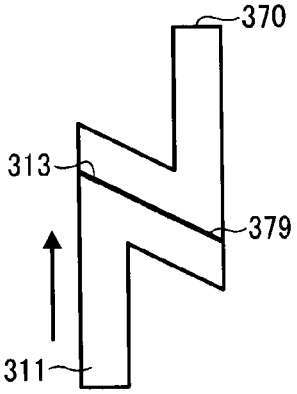

FIGS. 32A through 32C are schematic diagrams illustrating the leading end of the pressing portion 379 and the leading end of the bent portion 313.

As illustrated in FIGS. 32A through 32C, the leading end of the pressing portion 379 is bent upward and is projected toward the near side of the image forming apparatus 500. By contrast, the leading end of the bent portion 313 is bent downward and is projected toward the far side of the image forming apparatus 500. Further, the leading end of the pressing portion 379 is higher than the leading end of the bent portion 313.

Accordingly, as illustrated in FIG. 32A, after the fixing device 8 is detached from the image forming apparatus 500, even when the first conveyance assembly 31 is closed and locked and the swing member 370 is at the bottom dead center, the fixing device 8 is prevented from contact of the leading end of the pressing portion 379 and the leading end of the bent portion 313 when the fixing device 8 is attached to and stored in the image forming apparatus 500 again, as illustrated in FIG. 32B.

After the fixing device 8 is inserted into the image forming apparatus 500, as the lever 310 is rotated to a rotation restricted position thereof, the elevation plate 311 is elevated, and therefore the pressing portion 379 and the bent portion 313 contact to each other, as illustrated in FIG. 32C. At this time, the leading end and inclined surface of the pressing portion 379 and the leading end and inclined surface of the bent portion 313 contact with each other. Accordingly, the elevation plate 311 and the swing member 370 are locked reliably. Further, by providing respective slopes or inclined surfaces to the pressing portion 379 and the bent portion 313, a vertical gap between the pressing portion 379 and the bent portion 313 for avoiding contact of the leading end of the pressing portion 379 and the leading end of the bent portion 313 in the state illustrated in FIG. 32B.

The pressing portion 379 and the bent portion 313 have the respective inclined surfaces in this example illustrated in FIGS. 32 through 32C. However, the surfaces of the pressing portion 379 and the bent portion 313 are not limited to the inclined surface. For example, both the pressing portion 379 and the bent portion 313 may be bent to have respective horizontal surfaces.

In the example illustrated in FIGS. 30 through 31C, the center 315*c* in the detachable state of the fixing device 8 is arranged higher than the center 320*a* in the rotation restricted state of the lever 310 so that the elevation plate 311 in the detachable state of the fixing device 8 is lower than the rotation restricted state of the lever 310 (FIG. 26). However, the positions of the center 315*c* and the center 320*a* are not limited thereto. For example, the center 315*c* of the engagement projection 314 in the detachable state of the fixing device 8 is arranged to be the same level as the center 320*a* of the engagement projection 314 in the rotation restricted state of the lever 310. At this time, by making the pressing portion 379 and the bent portion 313 have the respective inclined surfaces as illustrated in FIGS. 32A through 32C, the leading end of the pressing portion 379 and the leading end of the bent portion 313 engage reliably without contacting each other when the fixing device 8 is returned to the image forming apparatus 500, as illustrated in FIG. 32B. In other words, when the engagement projection 314 is placed on the center 315*c* in the detachable state of the fixing device 8, the elevation plate 311 is at the same level as in the locked position as illustrated in FIG. 26. Therefore, even when the first conveyance assembly 31 is closed and then the fixing device 8 is stored in the image forming apparatus 500, the bent portion 313 of the elevation plate 311 can engage with the pressing portion 379 of the swing member 370 at the bottom dead center without colliding with the pressing portion 379.

Next, a description is given of the sheet conveying device 9 according to another example of this disclosure with reference to FIGS. 33A through 36.

In the above-described example illustrated with the FIGS. 30 through 32C, when the first conveyance assembly 31 of the sheet conveying device 9 is closed or the lock mechanism 65 is locked, the link mechanism 305 that functions as a state changer is changed from the movement allowed position to the movement restricted position to restrict detachment of the fixing device 8 from the image forming apparatus 500.

In this example, when the link mechanism 305 that functions as a state changer is changed from the movement restricted position to the movement allowed position, the sheet conveying device 9 is unlocked.

The following description is given of the link mechanism 305 having a different configuration from that of the above-described example illustrated in FIGS. 30 through 32C.

Figure 33A:
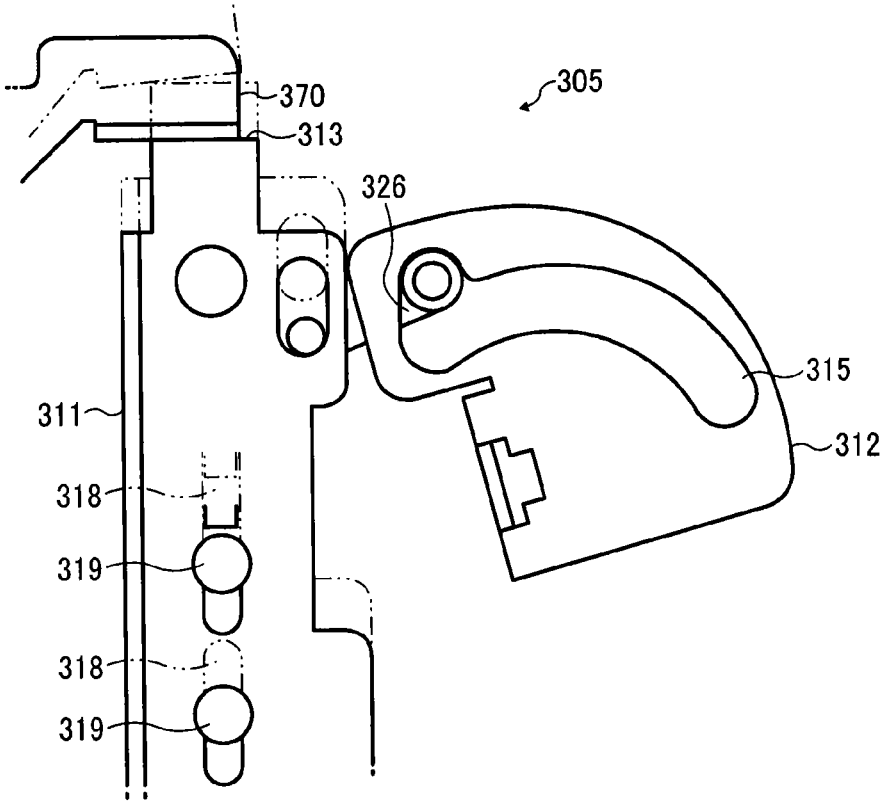
FIGS. 33A and 33B are schematic diagrams illustrating a link mechanism of the sheet conveying device according to another example of this disclosure.
Figure 33B:
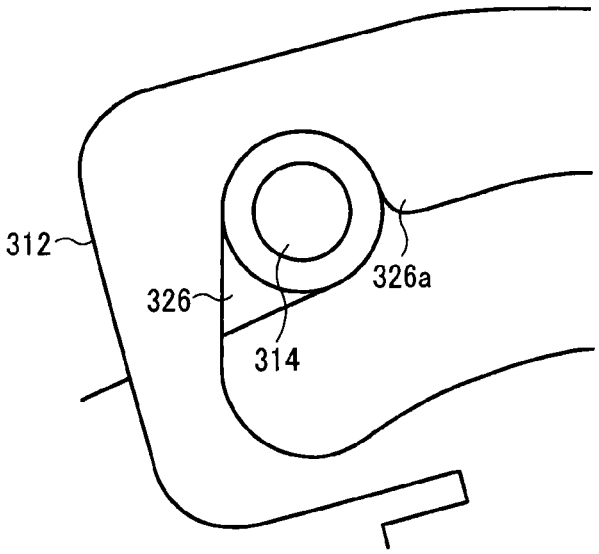
Figure 34A:
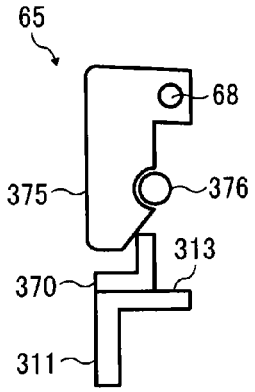
FIGS. 34A through 34C are schematic side views illustrating the lock mechanism and a swing member.
Figure 34B:
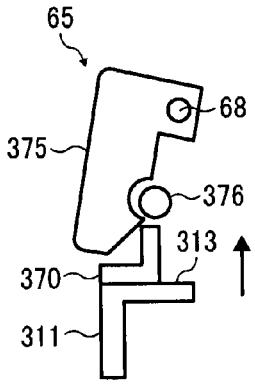
Figure 34C:
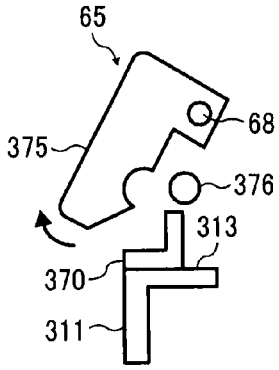
Figure 35:
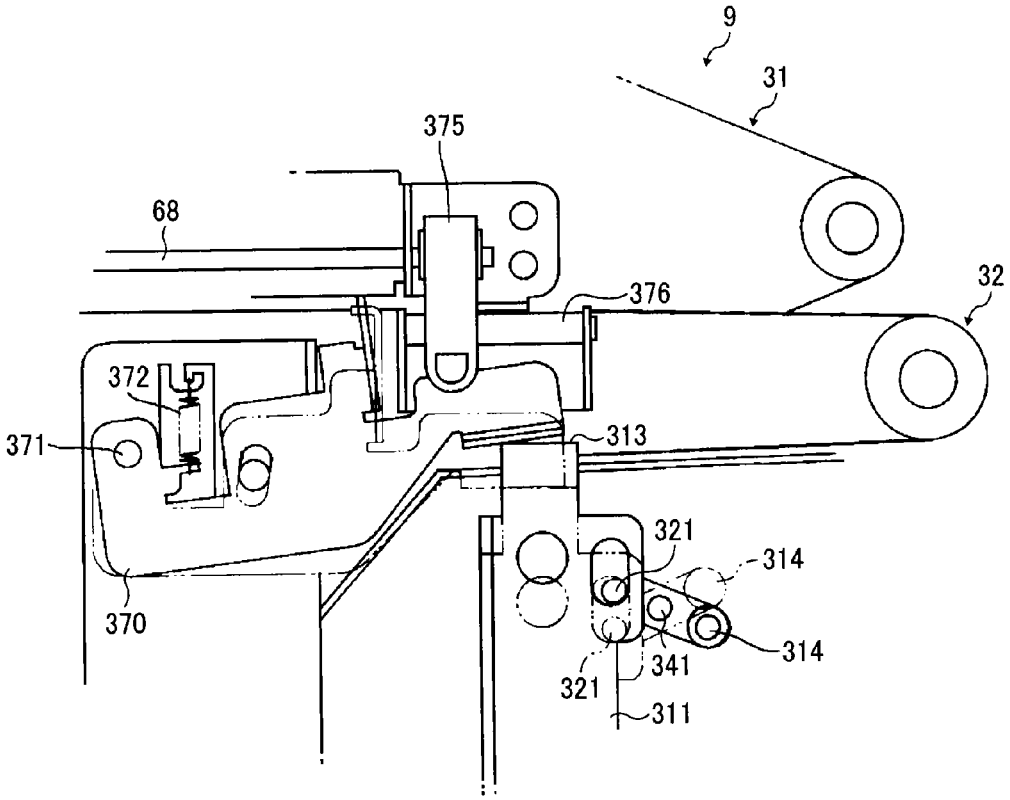
FIG. 35 is a schematic front view illustrating the swing member and other components.
Figure 36:
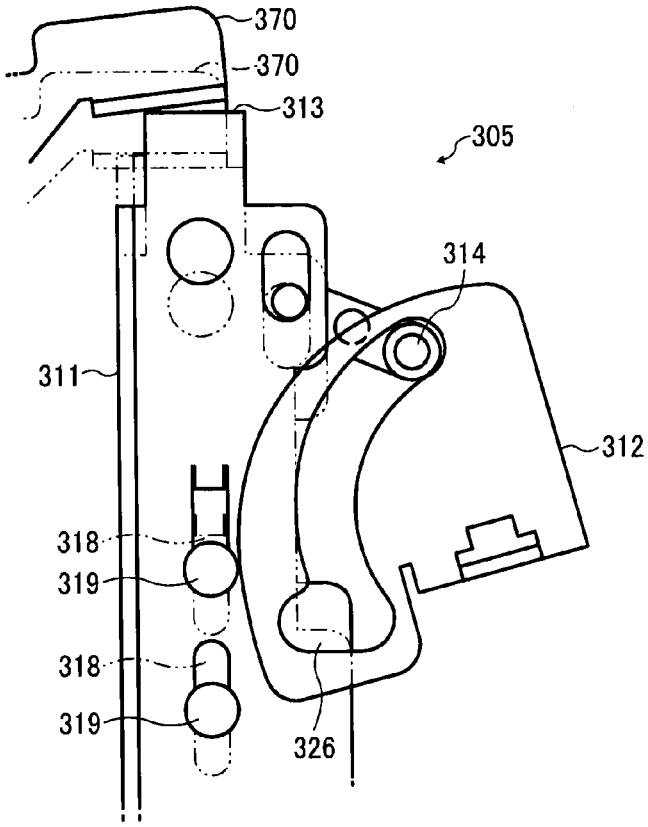
FIG. 36 is a schematic diagram illustrating a state in which the fixing device is unlocked.

FIGS. 33A and 33B are schematic diagrams illustrating the link mechanism 305 that functions as a state changer according to another example of this disclosure. FIGS. 34A through 34C are schematic side views illustrating the lock mechanism 65 and the swing member 370. FIG. 35 is a schematic front view illustrating the swing member 370 and other components. FIG. 36 is a schematic diagram illustrating a state in which the fixing device 8 is unlocked.

The link mechanism 305 includes the elevation plate 311, the fan-shaped frame 312, the rotation arm 340, the engagement projections 314 and 321, the frame 330, the springs 331 and 332, and the swing member 370. The lever 310 that functions as a first attaching part is attached to the fixing device 8 and provided in the image forming apparatus 500. The lever 310 fixes or locks movement of the fixing device 8. The fan-shaped frame 312 that functions as a movable frame is fixed to the shaft 322 of the lever 310 used for detachment of the fixing device 8 (FIGS. 13 and 20).

In the state as illustrated in FIGS. 33A, 33B, and 34A, the first conveyance assembly 31 of the sheet conveying device 9 is closed, the link mechanism 305 is at the movement restriction position and the elevation plate 311 is at the bottom dead center. Here, the swing member 370 that is provided to the second conveyance assembly 32 is in contact with the bent portion 313 of the elevation plate 311. As illustrated in FIG. 35, the swing member 370 is biased downwardly by the spring 372 and is rotatable about the shaft 371 that is provided to the one end side of the second conveyance assembly 32.

As illustrated in FIGS. 33A and 33B, a short slit 326 is formed at the left end of the slit 315 in an upward direction or a direction different from the rotation direction of the fan-shaped frame 312. The engagement projection 314 engages with the short slit 326. The short slit 326 is shorter than the long slit 320 illustrated in FIGS. 15A and 16. As the lever 310 and the fan-shaped frame 312 are rotated counterclockwise, the engagement projection 314 and the short slit 326 are disengaged from each other. As illustrated in FIG. 33B, the lowest end position where a short slit forming part 326*a* that forms the short slit 326 and the engagement projection 314 contact with each other is higher than a virtual line that intersects the center of the engagement projection 314. In addition, the short slit forming part 326*a* inclines from the lowest end position to the downward direction toward a direction separating from the engagement projection 314. This configuration facilitates disengagement of the engagement projection 314 and the short slit 326 when the lever 310 is rotated counterclockwise. When the engagement projection 314 is disengaged from the short slit 326, the lever 310 is unlocked and the elevation plate 311 is moved upward due to the tension force exerted by the spring 332 and the engagement projection 314 is moved downward. Accordingly, the fan-shaped frame 312 that is rotatable in a counterclockwise direction is rotated together with the lever 310 as illustrated in FIG. 36 and the link mechanism 305 is changed to the movement allowed position. At this time, the fixing device 8 is unlocked.

In this example, the elevation plate 311 is further raised gradually along with rotation of the fan-shaped frame 312. With the elevation of the elevation plate 311, the bent portion 313 pushes the swing member 370 upward. Consequently, as illustrated in FIG. 35, the swing member 370 moves upward against the downward biasing force of the spring 372 and reaches the top dead center.

In this example, the lock mechanism 65 includes the locking member 375 that functions as a lock lever. Before the swing member 370 reaches the top dead center, a free end of the swing member 370 pushes a lower part of the inclined surface of the locking member 375 upward, as illustrated in FIG. 34B. The locking member 375 is fixed to the lever shaft 68 above the swing member 370 and is rotatable with the lever shaft 68. In the locked state, the locking member 375 is engaged with the lock shaft 376 that is provided to the second conveyance assembly 32. The locking member 375 is unlocked by being raised by the swing member 370, so that the locking member 375 is detached from the lock shaft 376, as illustrated in FIG. 34C.

It is to be noted that the lock lever 67 of the lock mechanism 65 is also provided to the lever shaft 68 to which the locking member 375 is attached. The lock lever 67 is unlocked in conjunction with unlocking of the locking member 375. Accordingly, each unit in the configuration illustrated in FIG. 35 is unlocked at the moment in the drawing. In FIG. 35, the link mechanism 305 is at the movement allowable position and the sheet holding state of the upper unit 60 and the lower unit 80 is released.

When the link mechanism 305 is changed from the movement restricted position to the movement allowed position in conjunction with the unfixing action of the lever 310, the lock mechanism 65 of the sheet conveying device 9 is also unlocked. At this time, the sheet P is released from the sheet holding state of the sheet conveying device 9, and therefore the upper unit 60 separates form the lower unit 80 due to a force exerted by the spring 70 to fully open, as illustrated in FIG. 4. Accordingly, the fixing device 8 in the detachable state may be pulled out from the image forming apparatus 500 while the sheet conveying device 9 is in this fully open state. At this time, the jammed sheet P left across the fixing device 8 and the sheet conveying device 9 is not torn. As a result, the jammed sheet P left in the sheet conveying device 9 can be removed smoothly.

Next, a description is given of a different configuration of the link mechanism 305 that functions as a state changer of FIGS. 33A through 36 according to another example of this disclosure, with reference to FIGS. 37 through 44D.

Figure 37:
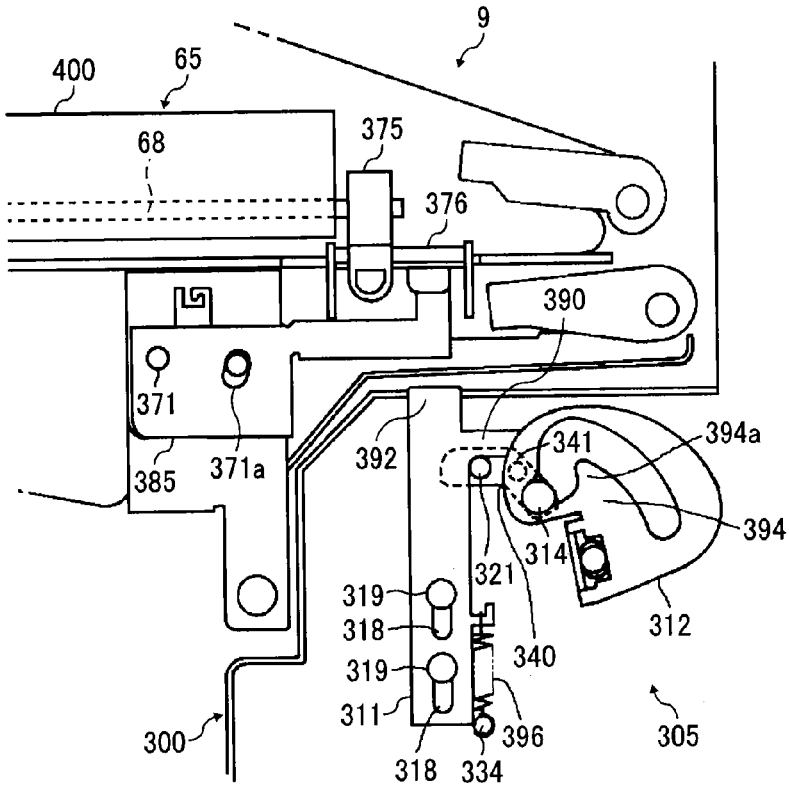
FIG. 37 is a schematic diagram illustrating a link mechanism of the sheet conveying device according to yet another example of this disclosure.
Figure 38:
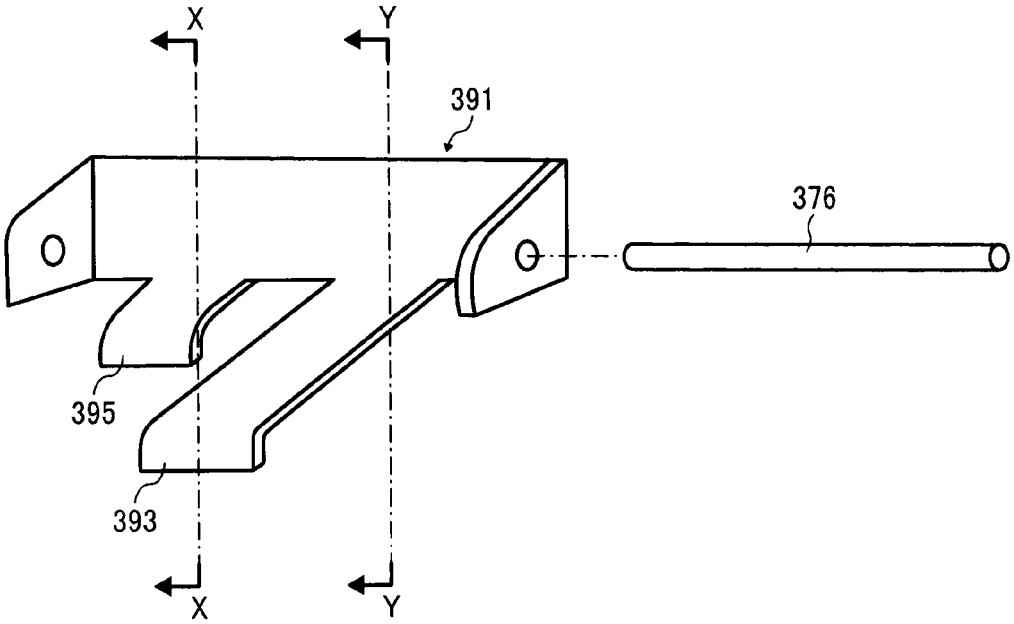
FIG. 38 is a schematic perspective view illustrating a second swing member attached to the link mechanism of FIG. 37.
Figure 39A:
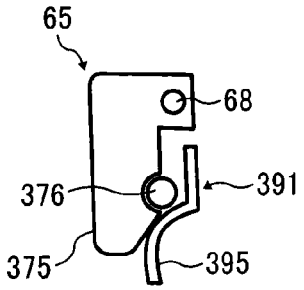
FIG. 39A is a schematic side view illustrating the second swing member along a line X-X of FIG. 38.
Figure 39B:
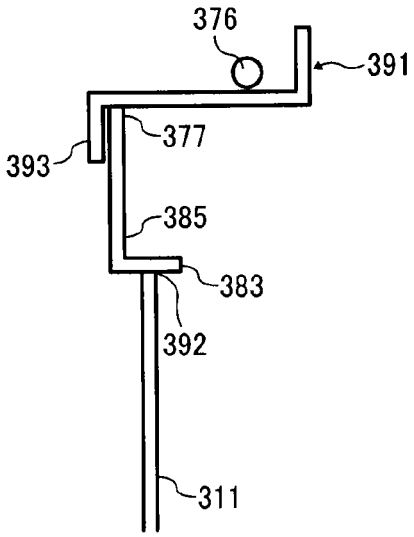
FIG. 39B is a schematic side view illustrating the second swing member along a line Y-Y of FIG. 38.

FIG. 37 is a schematic diagram illustrating the link mechanism 305 of the sheet conveying device 9. FIG. 38 is a schematic perspective view illustrating a second swing member 391 provided to the link mechanism 305 of FIG. 37. FIG. 39A is a schematic side view illustrating the second swing member 391 and adjacent units thereto along a line X-X of FIG. 38. FIG. 39B is a schematic side view illustrating the second swing member 391 and the adjacent units thereto along a line Y-Y of FIG. 38. FIGS. 40A through 40D are schematic diagrams illustrating displacements of the elevation plate 311 and the fan-shaped frame 312 from the rotation restricted state of the lever 310 to the detachable state of the fixing device 8.

In this example, when the link mechanism 305 is changed from the movement restricted position to the movement allowed position in conjunction with the unfixing action of the lever 310, the lock mechanism 65 of the sheet conveying device 9 is also unlocked. The link mechanism 305 includes the elevation plate 311, the fan-shaped frame 312, the rotation arm 340, the engagement projections 314 and 321, a spring 396, a first swing member 385, and the second swing member 391. Different from the configuration of the link mechanism 305 according to the example illustrated in FIGS. 33A through 36, the link mechanism 305 according to this example illustrated in FIGS. 37 through 44D includes the first swing member 385 and the second swing member 391. The first swing member 385 swings by contacting the raised elevation plate 311 and the second swing member 391 swings by contacting the first swing member 385 that is swung. Swinging the second swing member 391, the sheet conveying device 9 is changed from the sheet holding state to the sheet releasing state. Specifically, as the first swing member 385 swings upward, the second swing member 391 also swings upward to push up the locking member 375. Due to this action, the lock mechanism 65 of the sheet conveying device 9 is unlocked.

Here, the elevation plate 311 according to this example is different in shape from the example illustrated in FIGS. 33A through 36. In addition, the link mechanism 305 according to this example does not include the frame 330 and the springs 331 and 332. Instead, an upper end of the spring 396 is hooked to a hook that is projected from the right side plane of the elevation plate 311 and a lower end of the spring 396 is hooked to the hook 334 of the protrusion 300. Further, the second slots 318 are formed on a lower part of the elevation plate 311. The engagement projections 319 fixed to the protrusion 300 are inserted into the corresponding second slots 318.

A planar engaging part 390 is projected from the top plane of the elevation plate 311 toward the right side thereof to be engaged with the engagement projection 321. Further, in this example, an upper end 392 of the elevation plate 311 is a planar part and does not include a bent portion that is bent toward the inside of the image forming apparatus 500.

The second swing member 391 is fitted to the lock shaft 376 as illustrated in FIGS. 37 through 39B and is rotatable about the lock shaft 376.

As illustrated in FIG. 38, the second swing member 391 includes a contact 393 and a pressing portion 395. The contact 393 contacts an upper end of the first swing member 385. The pressing portion 395 presses up the locking member 375. The contact 393 is longer than the pressing portion 395. When the fixing device 8 and the cooling device of the sheet conveying device 9 are locked as illustrated in FIG. 37, the contact 393 and the pressing portion 395 extend in a substantially horizontal direction.

As illustrated in FIG. 37, the rotation arm 340 according to this example is different from the above-described example illustrated in FIG. 21, for example. That is, the rotation arm 340 is disposed to have a given obtuse angle formed by a line connecting the engagement projection 321 and the rotational shaft 341 and a line connecting the engagement projection 314 and the rotational shaft 341. The engagement projection 314 contacts the fan-shaped frame 312 that functions as a movable frame.

As the fan-shaped frame 312 rotated counterclockwise, the rotation arm 340 rotates clockwise about the rotational shaft 341. Along with this action, the engagement projection 321 is engaged with the engaging part 390 of the elevation plate 311 (see FIGS. 40A through 40D). That is, the rotation arm 340 includes the engagement projection 314 on one side to the rotational shaft 341 and the engagement projection 321 on the other side thereto. The engagement projection 314 functions as a first engaging member to contact the fan-shaped frame 312 that functions as a movable frame and the engagement projection 321 functions as a second engaging member to contact the elevation plate 311.

As the engagement projection 321 pushes up the elevation plate 311 to raise the elevation plate 311, the upper end 392 of the elevation plate 311 contacts a lower end 383 of the first swing member 385, as illustrated in FIG. 39B. An upper end 377 that is disposed opposite the lower end 383 of the first swing member 385 contacts the contact 393. The lower end 383 of the first swing member 385 is bent to an L-shape in cross section, as illustrated in FIG. 39B.

As illustrated in FIG. 37, the slit in the fan-shaped frame 312 is different from the above-described example illustrated in FIG. 36, for example. In this example, a pressing portion 394 is provided to push the engagement projection 314 to move along with the counterclockwise rotation of the fan-shaped frame 312 and to rotate the rotation arm 340 clockwise.

Further, the first swing member 385 is not connected to a spring but can swing about the shaft 371 and stop by its own gravity at a position (the bottom dead center) as illustrated in FIG. 37. The first swing member 385 can swing about the shaft 371 by the swing guide 371*a* that includes a projection of the second conveyance assembly 32 and a guide opening of the first swing member 385.

Next, a description is given of steps of unlocking the sheet conveying device 9 having the sheet cooling members 33 along with unlocking the fixing device 8.

Figure 40A:
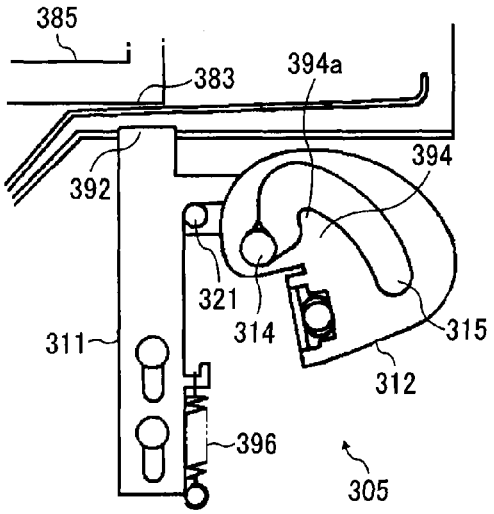
FIGS. 40A through 40D are schematic diagrams illustrating displacements of the elevation plate and the fan-shaped frame from the rotation restricted state of the lever to a detachable state of the fixing device.
Figure 40B:
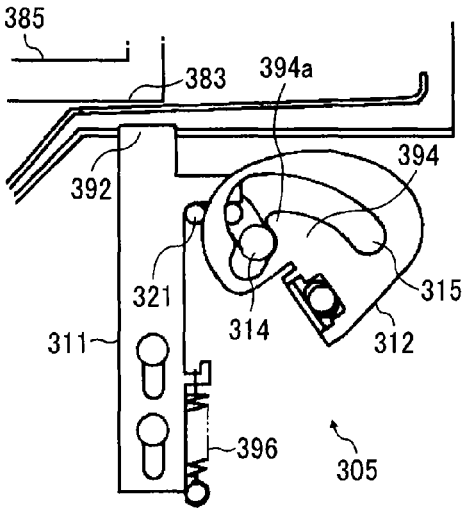

In FIGS. 37 and 40A, both the fixing device 8 and the cooling members 33 of the sheet conveying device 9 are locked and both the first swing member 385 and the second swing member 391 are located at the bottom dead center. When the lever 310 (FIG. 13C) of the fixing device 8 is rotated counterclockwise, the pressing portion 394 contacts the right side of the engagement projection 314, as illustrated in FIG. 40B.

The lever 310 is further rotated counterclockwise, a top end 394*a* of the pressing portion 394 presses the engagement projection 314. Then, the engagement projection 314 rotates clockwise about the rotational shaft 341 to contact the engaging part 390. This action elevates the elevation plate 311. Accordingly, the upper end 392 of the elevation plate 311 contacts the lower end 383 of the first swing member 385.

Figure 40C:
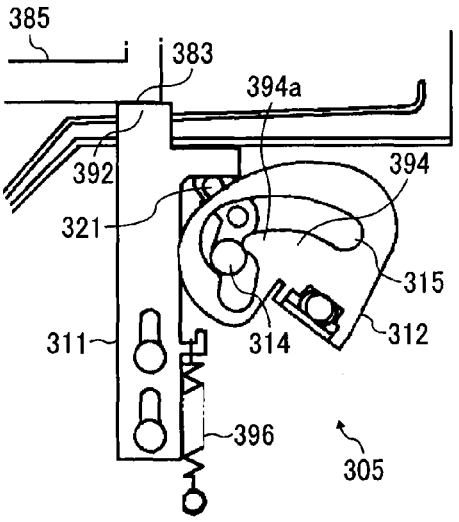
Figure 40D:
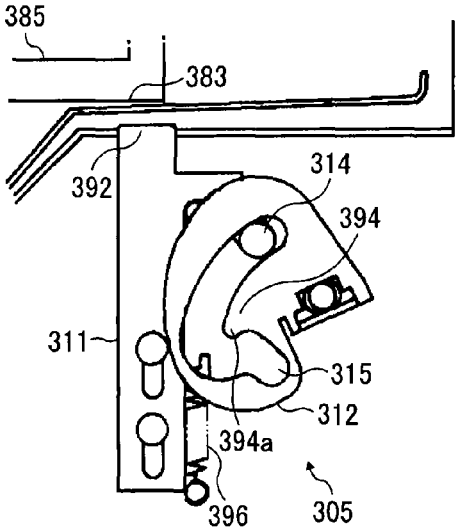

The lever 310 is further rotated counterclockwise, the engagement projection 321 is further raised to elevate the elevation plate 311. Then, the upper end 392 of the elevation plate 311 rotates the first swing member 385 counterclockwise, as illustrated in FIG. 40C. In FIG. 40C, the elevation plate 311 is located at the top dead center. The upper end 377 of the first swing member 385 swings the contact 393 of the second swing member 391 upward about the lock shaft 376. Along with the upward rotation of the contact 393 of the second swing member 391, the pressing portion 395 pushes the locking member 375 in an obliquely upward direction. Accordingly, in FIG. 40C, the locking member 375 is released from the fitting with the lock shaft 376, and therefore the sheet conveying device 9 having the cooling members 33 is unlocked. When the lever 310 is further rotated counterclockwise, the top end 394*a* and the engagement projection 314 are disengaged from each other. Accordingly, the engagement projection 314 passes through the slit 315 and the elevation plate 311 returns to its original position due to the biasing force exerted by the spring 396, as illustrated in FIG. 40D. As a result, the rotation arm 340 also returns to its original position.

When the fan-shaped frame 312 is rotated to the position illustrated in FIG. 40D that corresponds to FIG. 20B, the fixing device 8 becomes detachable.

It is to be noted that, when the lever 310 (i.e., the fan-shaped frame 312 in FIG. 40D) is rotated clockwise from the state illustrated in FIG. 40D to the state illustrated in FIG. 40A, the elevation plate 311 remains at the position illustrated in FIG. 40D (i.e., the bottom dead center). Accordingly, after the fixing device 8 has been pulled out from the apparatus body 200 of the image forming apparatus 500 in the state illustrated in FIG. 40D, firstly the first conveyance assembly 31 is moved downward, secondly the locking members 375 are locked to the lock shaft 376, thirdly the fixing device 8 is attached (stored) to the image forming apparatus 500, and lastly the lever 310 is rotated from the state illustrated in FIG. 40D to the state illustrated in FIG. 40D to lock the lever 310. Alternatively, after the fixing device 8 has been pulled out from the apparatus body 200 of the image forming apparatus 500 in the state illustrated in FIG. 40D, firstly the fixing device 8 is attached (stored) to the image forming apparatus 500, secondly the lever 310 is rotated from the state illustrated in FIG. 40D to the state illustrated in FIG. 40D to lock the lever 310, thirdly the first conveyance assembly 31 is moved downward, and lastly the locking members 375 are locked to the lock shaft 376.

It is to be noted that, in the above-described examples, it is not limited to the configuration in which the upper unit 60 fully opens when the lock mechanism 65 of the sheet conveying device 9 is unlocked. For example, this disclosure can be applied to a configuration in which the upper unit 60 is lifted and separated from the lower unit 80 due to the force exerted by the spring 70 (up to a position at which the sheet holding state of the sheet P is released).

Further, the above-described examples are not limited to the configuration in which the upper unit 60 is separated from the lower unit 80. For example, this disclosure can be applied to a configuration in which the lower unit 80 is separated from the upper unit 60 or in which both the upper unit 60 and the lower unit 80 are separated from the conveying path R.

Further, the above-described examples are not limited to the configuration in which the sheet conveying device 9 has the upper unit 60 and the lower unit 80 vertically with the conveying path R located therebetween. This disclosure can be applied to any configuration in which the upper unit 60 and the lower unit 80 are provided in the sheet thickness direction of the sheet P such that the upper unit 60 and the lower unit 80 hold the sheet P that is passing through the conveying path R.

Further, the lock shaft 376 is preferably located at a position equal to or lower than where the belts 56 and 59 contact with each other and hold the sheet P. This configuration can prevent the sheet P from interring with the lock shaft 376 when the fixing device 8 is detached from the apparatus body 200 of the image forming apparatus 500.

Further, the above-described examples are not limited to the configuration in which the locking member 375 engages with the lock shaft 376. For example, this disclosure can be applied to a configuration in which, as the locking member 375 rotates, the lock lever 67 also rotates to disengage from the front shaft 83, which is similar to a relation of the lock lever 67 and the rotary member 360.

The above-described examples of this disclosure can be applied to the transfer device 7 and at least one adjacent roller. Specifically, in this case, a transfer mechanism that integrally includes the transfer device 7 and the secondary transfer roller 12 is constructed. The transfer mechanism is movable in a direction intersecting the sheet thickness direction of the sheet P to approach and separate relative to an adjacent conveying roller pair (e.g., the registration roller pair 15 in FIG. 1). In addition, the state changer of the fixing device 8 in the above-described examples can be provided to the transfer mechanism and the state changer of the sheet conveying device 9 in the above-described examples can be provided to the conveying roller pair. Accordingly, this configuration corresponds to the sheet conveying mechanism 110.

In the examples illustrated in FIGS. 1 through 32C, it can be described that the link mechanism 305 that functions as a state changer releases the lever 310 that functions as a first attaching part in conjunction with unfixing of the sheet conveying device 9 that functions as a second conveyor.

Further, in the examples illustrated in FIGS. 33A through 40D, it can be described that the link mechanism 305 that functions as a state changer releases the sheet conveying device 9 that functions as a second conveyor in conjunction with unlocking of the lever 310 that functions as a first attaching part.

Namely, in the examples illustrated in FIGS. 1 through 40D, it can be described that the link mechanism 305 that functions as a state changer releases one of the sheet conveying device 9 that functions as a second conveyor and the lever 310 that functions as a first attaching part in conjunction with a releasing action of the other one of the sheet conveying device 9 and the lever 310.

Accordingly, this disclosure further includes a sheet conveying mechanism that functions as a sheet conveyor according to the following example.

At least one aspect of this disclosure provides a sheet conveyor that includes a first conveyor having a sheet conveying path therein to convey a sheet via the sheet conveying path and moving in a direction intersecting a sheet thickness direction of the sheet, a second conveyor having the sheet conveying path therein to convey the sheet via the sheet conveying path, the first conveyor and the second conveyor approaching and separating from the sheet conveying path in the sheet thickness direction of the sheet, a first attaching part provided to the first conveyor to attach the first conveyor to the sheet conveyor, and a state changer to change a state of one of the first attaching part and the second conveyor to a movement allowed state in conjunction with a releasing action of the other one of the first attaching part and the second conveyor.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveyor, comprising:

a first body including a first conveyor including a first sheet conveying path therein to convey a sheet via the first sheet conveying path, the first body including a first attaching part to retain a position of the first conveyor;

a second body including a second sheet conveying path to convey the sheet, the second body including:

a second conveyor; and a third conveyor disposed facing the second conveyor via the second sheet conveying path, the second conveyor and the third conveyor separated from each other in a sheet releasing state, and a state changer to change a state of the second body from a sheet holding state to the sheet releasing state by a releasing action of the first attaching part.

2. The sheet conveyor according to claim 1, wherein the first attaching part has a shaft, wherein the state changer comprises:

a movable frame fixed to the shaft of the first attaching part; and an elevation plate to move vertically in conjunction with movement of the movable frame, and wherein, as the first attaching part and the movable frame rotates, the elevation plate moves and the second conveyor changes from the sheet holding state to the sheet releasing state.

3. The sheet conveyor according to claim 2, wherein the state changer further comprises a swing member, wherein the second body includes a second attaching part which comprises:

a lever shaft; and a locking member fixed to the lever shaft, and wherein, as the elevation plate lifts the swing member, the swing member pushes up the locking member to change the state of the second conveyor from the sheet holding state to the sheet releasing state.

4. The sheet conveyor according to claim 2, wherein the state changer further comprises:

a rotational shaft; and a rotation arm rotatable about the rotational shaft, wherein the rotation arm comprises:

a first member disposed on one end to the rotational shaft and contacting the movable frame; and a second member disposed on the other end to the rotational shaft and contacting the elevation plate.

5. The sheet conveyor according to claim 2, wherein the state changer further comprises:

a first swing member to contact and swing the elevation plate at a lifted position; and a second swing member to contact and swing the first swing member swung by the elevation plate, and wherein, as the second swing member swings, the state of the second conveyor changes from the sheet holding state to the sheet releasing state.

6. The sheet conveyor according to claim 1,
wherein the first attaching part includes a lever connected to a shaft,
wherein the shaft includes a stopper extending in a direction intersecting the shaft,
wherein the stopper is to be inserted through a slit between rear side members of an apparatus body of the image forming apparatus.

7. The sheet conveyor according to claim 1, further comprising a cooler to cool the sheet.

8. An image forming apparatus comprising:
the sheet conveyor according to claim 1; and
an image forming part to form a toner image on the sheet,
wherein the first body includes a fixing device to fix the toner image formed in the image forming part.

9. A sheet conveyor, comprising:
a first body including a first conveyor including a first sheet conveying path therein to convey a sheet via the first sheet conveying path, the first body including a first attaching part to retain a position of the first conveyor;
a second body including a second sheet conveying path to convey the sheet, the second body including:
a second conveyor; and
a third conveyor disposed facing the second conveyor via the second sheet conveying path, the second conveyor and the third conveyor separated from each other in a sheet releasing state, and
a state changer to change a state of the first attaching part from a movement restricted state to a movement allowed state by a separating action of the second conveyor and the third conveyor.

10. The sheet conveyor according to claim 9,
wherein the second body further comprises a second attaching part to attach the second conveyor and the third conveyor at a position where the second conveyor and the third conveyor face each other,
wherein the state changer changes the state of the first attaching part from the movement restricted state to the movement allowed state by a change of the second attaching part from a locked state to an unlocked state.

11. The sheet conveyor according to claim 10,
wherein the first attaching part includes a shaft,
wherein the state changer further comprises:
a movable frame fixed to the shaft of the first attaching part; and
an elevation plate to move vertically in conjunction with movement of the movable frame,
wherein the second attaching part comprises:
a lever shaft;
a rotary member fixed to the lever shaft; and
a lock lever fixed to the lever shaft,
wherein, as the lock lever is rotated and secured, the rotary member rotates and fits to the elevation plate and a position of the state changer changes from a movement allowed position to a movement restricted position.

12. The sheet conveyor according to claim 11,
wherein, when the first attaching part and the movable frame are rotated, the first body is released and allowed to move.

13. The sheet conveyor according to claim 9,
wherein the second body further comprises a stopper,
wherein, as the stopper biases the state changer disposed to the first conveyor in a closing direction of the second conveyor in a sheet thickness direction when the second conveyor is closed, a position of the state changer changes from a movement allowable position to a movement restricted position.

14. The sheet conveyor according to claim 9,
wherein the second body further comprises a second attaching part to fix the second conveyor and the third conveyor at respective positions facing each other,
wherein the first attaching part includes a shaft,
wherein the state changer comprises
a movable frame fixed to the shaft of the first attaching part;
an elevation plate to move vertically in conjunction with movement of the movable frame; and
a swing member to swing to either approach or separate with respect to the elevation plate,
wherein the second attaching part has a pressing portion to press the swing member,
wherein, by unlocking the second attaching part, the pressing portion and the swing member separate from each other,
wherein, by raising the elevation plate due to swing of the swing member, movement of the first attaching part changes from the movement restricted state to the movement allowed state.

15. The sheet conveyor according to claim 14,
wherein the swing member comprises a restriction part to restrict movement of the swing member after the swing member has swung due to release of the second attaching part,
wherein the third conveyor includes a frame to restrict movement of the restriction part.

16. The sheet conveyor according to claim 14,
wherein, in conjunction with change of the second attaching part from the locked state to the unlocked state, movement of the first attaching part changes from the movement restricted state to the movement allowed state and the elevation plate is lifted,
wherein, by rotating the movable frame in the movement allowed state, the elevation plate is lowered to a position lower than a bottom dead center of the swing member.

17. The sheet conveyor according to claim 9,
wherein, after the second conveyor and the third conveyor of the second body have been separated and moved in a direction in which the first body intersect with a sheet thickness direction of the sheet, regardless of an approaching state and a separating state of the second body, the first body is inserted into the image forming apparatus.

18. The sheet conveyor according to claim 9,
wherein the first attaching part includes a lever connected to a shaft,
wherein the shaft includes a stopper extending in a direction intersecting the shaft,
wherein the stopper is to be inserted through a slit between rear side members of an apparatus body of the image forming apparatus.

19. The sheet conveyor according to claim 9, further comprising a cooler to cool the sheet.

20. An image forming apparatus comprising:
the sheet conveyor according to claim 9; and
an image forming part to form a toner image on the sheet,
wherein the first body includes a fixing device to fix the toner image formed in the image forming part.

* * * * *